US008563206B2

(12) United States Patent
Matsuura

(10) Patent No.: US 8,563,206 B2
(45) Date of Patent: Oct. 22, 2013

(54) DEVELOPER, DEVELOPMENT DEVICE, IMAGE FORMING DEVICE AND METHOD OF FORMING DEVELOPER

(75) Inventor: Yuki Matsuura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 140 days.

(21) Appl. No.: 13/221,008

(22) Filed: Aug. 30, 2011

(65) Prior Publication Data

US 2012/0052432 A1 Mar. 1, 2012

(30) Foreign Application Priority Data

Aug. 31, 2010 (JP) ..... 2010-195203

(51) Int. Cl.
*G03G 9/08* (2006.01)

(52) U.S. Cl.
USPC ..... 430/108.4; 430/137.1; 430/137.14; 430/137.15; 399/252

(58) Field of Classification Search
USPC ..... 430/108.4, 137.1, 137.14, 137.15; 399/252
See application file for complete search history.

(56) References Cited

U.S. PATENT DOCUMENTS

2003/0124446 A1* 7/2003 Nakanishi et al. ..... 430/106.2
2007/0134578 A1* 6/2007 Choi et al. ..... 430/108.2

FOREIGN PATENT DOCUMENTS

| | | | |
|---|---|---|---|
| JP | 11-024372 | A | 1/1999 |
| JP | 11-352723 | A | 12/1999 |
| JP | A-2003-295500 | | 10/2003 |
| JP | 2005-173065 | A | 6/2005 |
| JP | 2007-140368 | A | 6/2007 |
| JP | 2009-025809 | A | 2/2009 |
| JP | 2010-039264 | A | 2/2010 |

* cited by examiner

*Primary Examiner* — Mark A Chapman
(74) *Attorney, Agent, or Firm* — Muncy, Geissler, Olds & Lowe, PLLC

(57) ABSTRACT

A negatively chargeable developer includes: negatively chargeable toner mother particles including at least binding resin and colorant; and an external additive that is externally added to a surface of the toner mother particles, wherein the external additive includes polymethyl methacrylate that is within a range from approximately 0.4 parts by weight to approximately 0.8 parts by weight inclusive per 100 parts by weight of the toner mother particles and that has positive chargeability.

18 Claims, 2 Drawing Sheets

DEVELOPER, DEVELOPMENT DEVICE, IMAGE FORMING DEVICE AND METHOD OF FORMING DEVELOPER

CROSS REFERENCE TO RELATED APPLICATION

The present application is related to, claims priority from and incorporates by reference Japanese Patent Application No. 2010-195203, filed on Aug. 31, 2010.

TECHNICAL FIELD

This application relates to a developer, a development device, an image forming device and a method of forming the developer.

BACKGROUND

In a conventional image forming device, a developer is supplied from an image forming device to, and fixed on, a recording medium through an exposure process, a development process, a transfer process and a fusion process. The developer (hereinafter referred to as "toner") used the image forming device is generally produced by adjusting a molecular weight of toner mother particles composed of colorant, resin, wax and charge control agent and by adding an external additive to the toner mother particles. Of this type of toner, there is toner that suppresses occurrence of fogging (smear) in which toner is attached to non-printed areas of the recording medium by making a charging polarity of a part of the external additive reversed from a charging polarity of the toner mother particles (see, for example, Japanese Laid-Open Patent Application No. 2003-295500, paragraphs 0037-0048 and FIG. 1).

SUMMARY

However, in the above-described conventional technology, there are problems that the external additive attaches to a circumferential surface of a charge roller that uniformly charges a circumferential surface of a photosensitive drum used in the exposure process and the development process and that the photosensitive drum is insufficiently charged, causing smears on the recording medium.

To solve the above-describe problems, an object of the present application is to suppress the smearing on the recording medium due to the attachment of the external additive onto the charge roller.

For the purpose, a positively chargeable developer disposed in the application includes negatively chargeable toner mother particles including at least binding resin and colorant; and an external additive that is externally added to a surface of the toner mother particles. Wherein, the external additive includes polymethyl methacrylate that is within a range from approximately 0.4 parts by weight to approximately 0.8 parts by weight inclusive per 100 parts by weight of the toner mother particles and that has positive chargeability.

In another aspect, the present application discloses a method of forming a negatively chargeable developer includes: producing negatively chargeable toner mother particles including at least binding resin and colorant; and externally adding an external additive to a surface of the toner mother particles. Wherein, the external additive includes polymethyl methacrylate that is within a range from approximately 0.4 parts by weight to approximately 0.8 parts by weight inclusive per 100 parts by weight of the toner mother particles and that has positive chargeability.

The present application as described above achieves effects of suppressing smears on the recording medium due to the attachment of the external additive onto the charge roller.

DETAILED DESCRIPTION OF EMBODIMENTS

Embodiments of a developer, a development device and an image forming device according to the present application are explained below with reference to the drawings.

First Embodiment

Figure 1:
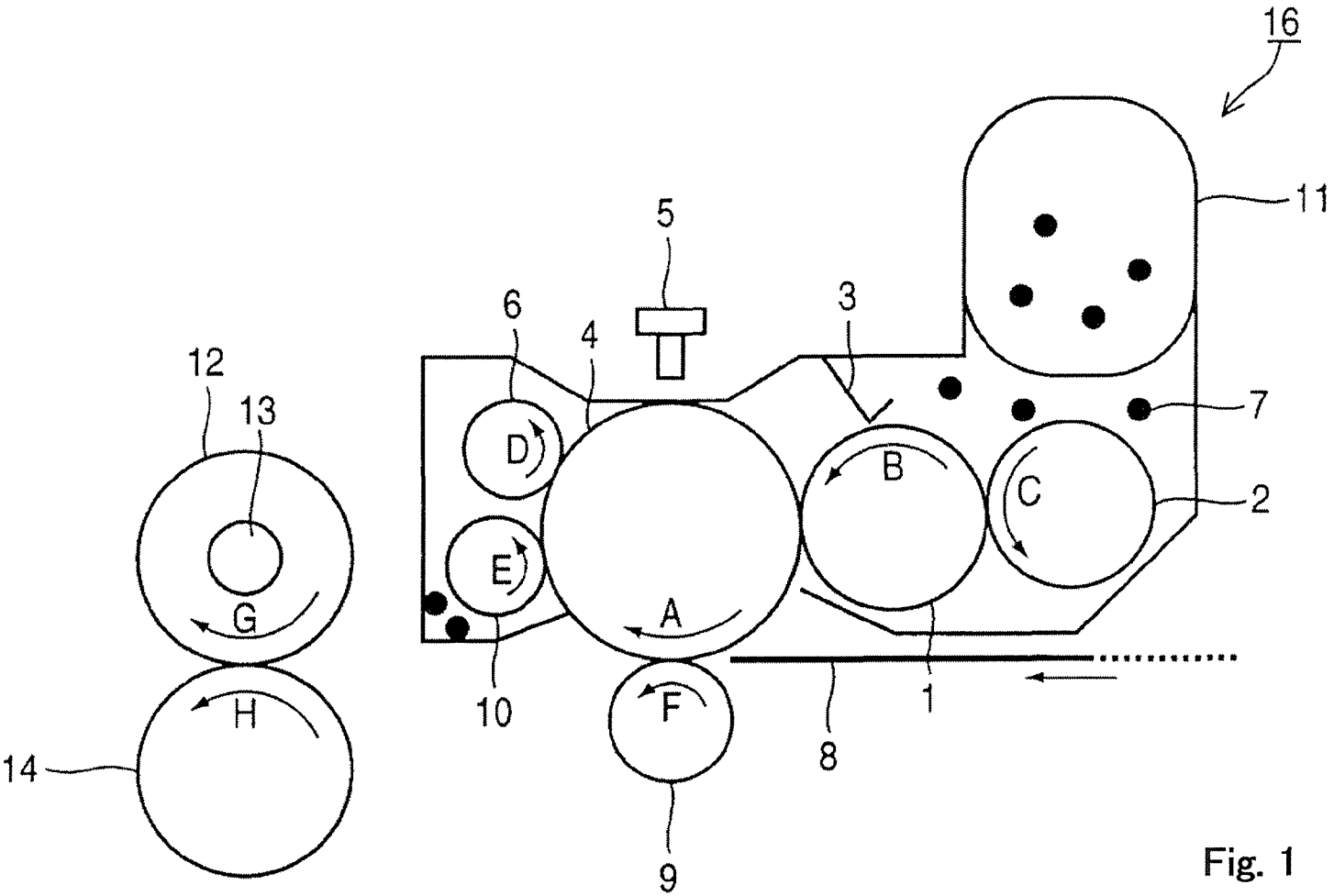
FIG. 1 is a schematic side view illustrating a configuration of a development device according to a first embodiment.

FIG. 1 is a schematic side view illustrating a configuration of a development device according to a first embodiment.

In FIG. 1, a development device 16 used in a development process and a transfer process of an electrographic image forming device includes a development roller 1 for example as a developer carrier, a sponge roller 2 for example as a developer supply member that supplies the developer to the development roller 1, a development blade 3 for example as a developer layer forming member that forms a developer layer on a surface of the development roller 1, a photosensitive drum 4 for example as a photosensitive body that forms an electrostatic latent image on a surface layer, a light emitting diode (LED) head 5 for example as an exposure device used in the exposure process to perform exposure to form the electrostatic latent image on the photosensitive drum 4, a charge roller 6 for example as a charging member that uniformly charges the surface of the photosensitive drum 4, toner 7 for example as the developer that develops the electrostatic latent image formed on the photosensitive drum 4, a recording medium 8 that is carried by a carrying member (not shown), a transfer roller 9 for example as a transferring member that transfers the toner 7 developed on the photosensitive drum 4 to the recording medium 8, a cleaning roller 10 for example as a cleaning member that scrapes the toner 7 that was not transferred and remained on the photosensitive drum 4 off from the photosensitive drum 4, and a toner cartridge 11 for example as a toner container that stores the toner 7 and supplies the toner 7 to the sponge roller 2.

In addition, the photosensitive drum 4 is positioned to contact with the development roller 1, the transfer roller 9, the charge roller 6 and the cleaning roller 10. The development roller 1 is positioned to contact with the sponge roller 2. The development blade 3 is positioned to contact with the development roller 1.

On the development roller 1, a semiconductor silicone rubber layer, on which an ultraviolet ray treatment is performed, is formed on a conductive shaft. The development roller 1 includes a surface coating layer, which is formed from urethane resin, and a silane coupling agent layer that are formed by being applied on the semiconductor silicone rubber layer as an elastic body. Silica particles are mixed in the surface coating layer for forming surface roughness. In addition, a thickness of the surface coating layer is 7 to 13 μm. Moreover, the development roller 1 is polished such that the surface roughness Rz after forming the surface coating is 3 to 12 μm (JIS B0601-1994) depending on necessity. Further, the surface roughness Rz is preferably large.

The resistance of the development roller 1 is 100 to 5,000 MΩ as measured by contacting a ball bearing that has a width of 2.0 mm and a diameter of 6.0 mm and that is made of a SUS (stainless steel) material at a force of 20 gf and as calculated by resistance R=voltage V/current I, when a voltage of 100 V is applied between the ball bearing and the shaft.

On the sponge roller 2, a semiconductor foam silicone rubber is formed on a conductive shaft and is polished such that the sponge roller 2 has a predetermined outer circumference. The compound of the silicone rubber is formed by adding a reinforcing silica filter, a vulcanization agent needed for vulcanization hardening, and foaming agent to various raw rubbers, such as dimethyle silicone raw rubber, methylphenyl silicone raw rubber, and the like. As the foaming agent, an inorganic foaming agent, such as sodium bicarbonate or the like, or an organic foaming agent, such as azodicarbonamide (ADCA), is used.

In addition, the hardness of the sponge roller 2 is 48±5 degrees as measured using Asker Durometer Type F (manufactured by Kobunshi Keiki Co., Ltd.). Moreover, the sponge roller 2 is pressed towards the rotational axis of the development roller 1 by 1.0±0.15 mm. Furthermore, the resistance of the sponge roller 2 is 1 to 100 MΩ when a voltage of 300 V is applied as measured by the same measurement method as the development roller 1.

The cleaning roller 10 includes a conductive foam layer formed with an ethylene-propylene-diene rubber (EPDM) as a primary component that is adhered, via a primer, on an outer circumference of a metal cored bar having ϕ6. An average diameter of foam cells of the foam layer as observed using a stereo microscope is 100 to 300 μm. The rubber hardness of the cleaning roller 10 is 35 to 45 degrees as measured using Asker Durometer Type C (manufactured by Kobunshi Keiki Co., Ltd.) with a weight of 4.9 N. The cleaning roller 10 collects and discharges the toner that remains on the photosensitive drum 4 after the transfer by applying a positive voltage and a negative voltage by a predetermined cleaning device power source.

The cleaning roller 10 is pressed against the photosensitive drum 4 by an elastic force of springs on both sides of the shaft. The resistance of the cleaning roller 10 is 2.0E6 to 2.0E7 S2 as measured and calculated by resistance R=voltage V/current I, when a voltage of 400 V is applied while the cleaning roller 10 is pressed towards the rotational shaft of the photosensitive drum 4 having ϕ30 by 0.25 mm (while surface resistance) and rotated.

A conductive elastic layer of the charge roller 6 is an ionic conductive rubber elastic layer formed with an epichlorohydrin rubber (ECO) as a primary component. By applying on the surface of the elastic layer a hardening surface treatment by impregnating a surface treatment solution including isocyanate (HDI), contamination of the photosensitive drum is prevented, and releasability of the toner and external additive is obtained. The hardness of the elastic layer of the charge roller 6 is 73 degrees as measured using Asker Durometer Type C (manufactured by Kobunshi Keiki Co., Ltd.), and the resistance value of the charge roller 6 is 6.3 (log Ω). The resistance value is measured by pressing the charge roller 6, at the same pressure as inside of the image forming device, against a conductive metal drum having the same outer diameter and surface roughness as the photosensitive drum used, at a temperature of 20° C. and a humidity of 50% RH, and by applying a direct current voltage of 500 V.

The fusion process is provided at a downstream side of the development process and the transfer process (the photosensitive drum 4 and transfer roller 9) in the carrying direction of the recording medium. In the fusion process, a tubular heat roller 12, in which a surface of an aluminum tube is coated by perfluoro alkoxy alkane (PFA) or polytetrafluoroethylene (PTFE), a halogen lamp 13 as a heat source that is arranged inside the heat roller 12, and a backup roller 14 as an elastic roller are positioned. The heat roller 12 and the backup roller 14 are in contact under a pressure.

To each of the rollers and drum except the backup roller 14, a gear (not shown) for transmitting the drive is fixed by press fit or other methods. A gear fixed to the photosensitive drum 4 is referred to as a drum gear. A gear fixed to the development roller 1 is referred to as a development gear. A gear fixed to the sponge roller 2 is referred to as a sponge gear. A gear fixed to the charge roller 6 is referred to as a charge gear. A gear fixed to the cleaning roller 10 is referred to as a cleaning gear. A gear fixed to the transfer roller 9 is referred to as a transfer gear. A gear arranged between the development gear and the sponge gear is referred to as an idle gear. A gear fixed to the heat roller 12 is referred to as a heat roller gear.

In addition, to each of the rollers and the LED head 5 in the development process and the transfer process and the halogen lamp 13 in the fusion process, bias charge is applied by a power source (not shown) provided in the image forming device. The power source of the image forming device discussed here is a power source that is generally used as a high voltage power source for electrographic printers and is controlled by a controller (not shown).

Figure 2:
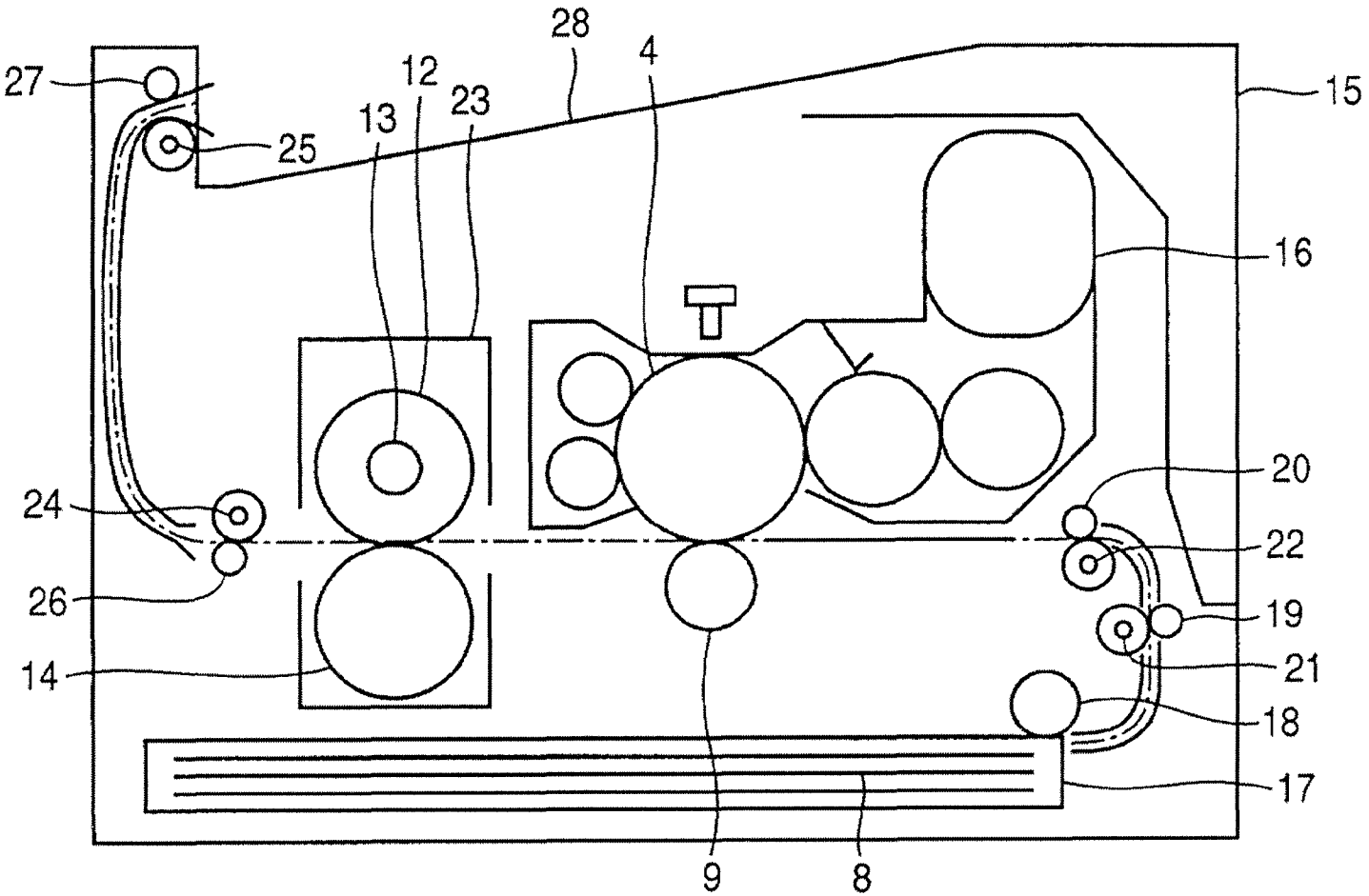
FIG. 2 is a schematic side view illustrating a configuration of an image forming device according to the first embodiment.

FIG. 2 is a schematic side view illustrating a configuration of an image forming device according to the first embodiment.

In FIG. 2, an image forming device 15 includes the detachable development device 16 that forms a toner image in black.

In addition, in the image forming device 15, a sheet cassette 17 that stores recording media 8, such as paper, in a stacked state is mounted in a lower part thereof, and a hopping roller 18 for carrying the recording media 8 sheet by sheet is positioned above the sheet cassette 17.

Further, a carrying roller 21 that carries the recording medium 8 by pinching the recording medium 8 with pinch rollers 19 and 20, and a registration roller 22 that corrects offset of, and carries, the recording medium 8 are positioned in the downstream side of the hopping roller 18 in the carrying direction of the recording medium 8.

The hopping roller 18, the carrying roller 21 and the registration roller 22 are rotated as a motive force is transmitted from a drive source (hot shown) via gears and the like.

The transfer roller 9 formed by a conductive rubber or the like is positioned at a position that opposes the photosensitive drum 4 of the development device 16. To the transfer roller 9, a voltage is applied for causing a potential difference between a surface potential of the photosensitive drum 4 and a surface potential of the transfer roller 9 when a toner image formed by toner attached to the photosensitive drum 4 is transferred to the recording medium 8.

A fuser 23 includes the heat roller 12 and the backup roller 14 and fuses the toner transferred onto the recording medium 8 by pressure and heat. Ejection rollers 24 and 25 provided at the downstream side of the heat roller 12 and the backup roller 14 pinch the recording medium 8 ejected from the fuser 23 with ejection side pinch rollers 26 and 27 and carry the recording medium 8 to a recording medium stacker 28.

The heat roller 12 of the fuser 23, the ejection rollers 24 and 25 and the like are rotated as a motive force is transmitted from a drive source (hot shown) via gears and the like.

Operation of the entire image forming device 15 configured as described above is controlled by a controller, such as a central processing unit (not shown), based on a program (software) stored in a memory or a storage part such as a magnetic disk (not shown).

Operation of the above-described configuration is described based on FIG. 1.

In the development device 16 shown in FIG. 1, when a print instruction is transmitted from the controller (not shown), a motor of the image forming device (not shown) starts rotating, and the drive is transmitted to the drum gear via a number of gears in the image forming device (not shown). As a result, the photosensitive drum 4 rotates in the direction indicated by arrow A in the drawing, and the development roller 1 rotates in the direction of arrow B in the drawing as the drive is transmitted from the drum gear to the development gear. In addition, as the drive is transmitted from the development gear to the sponge gear via the idle gear, the sponge roller 2 rotates in the direction indicated by arrow C in the drawing. In the meantime, the charge roller 6 rotates in the direction indicated by arrow D in the drawing as the drive is transmitted from the drum gear to the charge gear. The cleaning roller 10 rotates in the direction indicated by arrow E in the drawing as the drive is transmitted from the drum gear to the cleaning gear. The transfer roller 9 rotates in the direction indicated by arrow F in the drawing as the drive is transmitted from the drum gear to the transfer gear.

Moreover, the drive from the rotation of the motor in the image forming device is transmitted to the heat roller gear via a number of gears of another system in the image forming device and rotates the heat roller 12 in the direction indicated by arrow G in the drawing. The backup roller 14 rotates in the direction indicted by arrow H in the drawing to follow in accordance with the rotation of the heat roller 12.

Furthermore, approximately at the same time as when the motor in the image forming device starts rotating, the predetermined bias voltages are applied respectively to the rollers in the development process and the transfer process and the halogen lamp 13 in the fusion process by the power source (not shown) in the image forming device. For instance, −300 V is applied to the sponge roller 2, and −200 V is applied to the development roller 1.

The surface layer of the photosensitive drum 4 is uniformly charged (e.g., −600 V) by the voltage applied to the charge roller 6 and the rotation of the charge roller 6. When the charged part of the photosensitive drum 4 reaches below the LED head 5, the LED head 5 emits light in accordance with image data to be printed that is transmitted to the controller (not shown) and forms an electrostatic latent image on the photosensitive drum 4.

When the part of the photosensitive drum 4 on which the electrostatic latent image has been formed reaches the development roller 1, toner 7 on the development roller 1, which has been thinned by the development blade 3, moves onto the photosensitive drum 4 because of the potential difference between the electrostatic latent image (e.g., −20V) on the photosensitive drum 4 and the development roller 1.

In the transfer process, the toner 7 on the photosensitive drum 4 is transferred onto the recording medium 8. The transferred toner 7 is fixed onto the recording medium by the heat from the heat roller 12 heated by the halogen lamp 13 and by the pressure between the heat roller 12 and the backup roller 14.

In the meantime, a part of the toner 7 that is not transferred to the recording medium 8 and remains on the photosensitive drum 4 is scraped by the cleaning roller 10 and collected to the development process side after the completion of printing in accordance with a sequence defined by the controller (not shown).

Next, the toner used in the development device is explained.

With a binding resin (polyester resin, glass transition temperature Tg=62° C., softening temperature $T_{1/2}$=115° C.) being 100 [parts by weight], 0.5 [parts by weight] of T-77 (manufactured by Hodogaya Chemical Co., Ltd.) as a charge control agent, 5.0 [parts by weight] of carbon black (MOGUL-L manufactured by Cabot Corporation) as a colorant, and 4.0 [parts by weight] of carnauba wax (Carnauba Wax No. 1 powder manufactured by S. Kato & Co.) as a release agent, are melted and kneaded by a biaxial extruder after mixing them using a Henschel mixer. After cooling, the mixture is cracked by a cutter mill having a 2 mm-diameter screen. Thereafter, by pulverizing the cracked mixture using an impact pulverizer "Dispersion Separator" (manufactured by Nippon Pneumatic Mfg. Co., Ltd.) and by classifying using a wind classifier, toner mother particles A having a volume mean particle diameter of 7.0 μm are obtained.

The volume mean particle diameter of the obtained toner mother particles is found by counting 30,000 particles using a cell count and analysis device "Coulter Multisizer 3" (manufactured by Beckman Coulter, Inc.) with an aperture diameter of 100 μm.

In addition, the circularity degree is measured using "flow type particle image analysis device FPIA-2100" manufactured by Simex Corporation based on an equation Circularity Degree=L1/L2. Here, L1 is a boundary length of a circle having the same area as an area of the projected image of a particle, and L2 is a boundary length of the projected image of the particle. If the circularity degree is 1.00, it is a true sphere. As the circularity degree becomes less than 1.00, the shape of the particle becomes more irregular.

The circularity degree of toner mother particles A was 0.90. By changing the pulverization time of the above-described pulverizer, toner mother particles A to F having various circularity degrees (0.90 to 0.99) can be obtained. The obtained toners are negatively chargeable.

In addition, in 100 parts by weight of the toner mother particles A having the circularity degree of 0.90, 0.2 parts by weight of "MP-1000 (polymethyl methacrylate; PMMA)" (manufactured Soken Chemical & Engineering Co., Ltd.) by having positive polarity and 1.8 parts by weight of "Aerosil RX50 (silica ($SiO_2$))" (manufactured by Nippon Aerosil Co., Ltd.) were added and mixed for 25 minutes to obtain toner A-1.

Here, a reason for use of "MP-1000" is to consider that melamine resin is easy to stick to the charge roller because the melamine resin has a higher charging property than PMMA. In addition, if $Al_2O_3$ (alumina) is used, because $Al_2O_3$ is harder than PMMA, it is considered that $Al_2O_3$ particles scrapes off the photosensitive drum, causing toner filming. In the present embodiment, PMMA which mean particle size is 0.15 μm or more and 2.0 μm or less is used.

With the same method as the above-described method, below toner A-2 to toner F-25 were obtained.

In 100 parts by weight of the toner mother particles A having the circularity degree of 0.90, 0.4 parts by weight of "MP-1000" and 1.8 parts by weight of "Aerosil RX50" were added and mixed for 25 minutes to obtain toner A-2.

In 100 parts by weight of the toner mother particles A having the circularity degree of 0.90, 0.6 parts by weight of "MP-1000" and 1.8 parts by weight of "Aerosil RX50" were added and mixed for 25 minutes to obtain toner A-3.

In 100 parts by weight of the toner mother particles A having the circularity degree of 0.90, 0.8 parts by weight of "MP-1000" and 1.8 parts by weight of "Aerosil RX50" were added and mixed for 25 minutes to obtain toner A-4.

In 100 parts by weight of the toner mother particles A having the circularity degree of 0.90, 1.0 part by weight of "MP-1000" and 1.8 parts by weight of "Aerosil RX50" were added and mixed for 25 minutes to obtain toner A-5.

In 100 parts by weight of the toner mother particles A having the circularity degree of 0.90, 0.2 parts by weight of "MP-1000" and 2.2 parts by weight of "Aerosil RX50" were added and mixed for 25 minutes to obtain toner A-6.

In 100 parts by weight of the toner mother particles A having the circularity degree of 0.90, 0.4 parts by weight of "MP-1000" and 2.2 parts by weight of "Aerosil RX50" were added and mixed for 25 minutes to obtain toner A-7.

In 100 parts by weight of the toner mother particles A having the circularity degree of 0.90, 0.6 parts by weight of "MP-1000" and 2.2 parts by weight of "Aerosil RX50" were added and mixed for 25 minutes to obtain toner A-8.

In 100 parts by weight of the toner mother particles A having the circularity degree of 0.90, 0.8 parts by weight of "MP-1000" and 2.2 parts by weight of "Aerosil RX50" were added and mixed for 25 minutes to obtain toner A-9.

In 100 parts by weight of the toner mother particles A having the circularity degree of 0.90, 1.0 part by weight of "MP-1000" and 2.2 parts by weight of "Aerosil RX50" were added and mixed for 25 minutes to obtain toner A-10.

In 100 parts by weight of the toner mother particles A having the circularity degree of 0.90, 0.2 parts by weight of "MP-1000" and 3.6 parts by weight of "Aerosil RX50" were added and mixed for 25 minutes to obtain toner A-11.

In 100 parts by weight of the toner mother particles A having the circularity degree of 0.90, 0.4 parts by weight of "MP-1000" and 3.6 parts by weight of "Aerosil RX50" were added and mixed for 25 minutes to obtain toner A-12.

In 100 parts by weight of the toner mother particles A having the circularity degree of 0.90, 0.6 parts by weight of "MP-1000" and 3.6 parts by weight of "Aerosil RX50" were added and mixed for 25 minutes to obtain toner A-13.

In 100 parts by weight of the toner mother particles A having the circularity degree of 0.90, 0.8 parts by weight of "MP-1000" and 3.6 parts by weight of "Aerosil RX50" were added and mixed for 25 minutes to obtain toner A-14.

In 100 parts by weight of the toner mother particles A having the circularity degree of 0.90, 1.0 part by weight of "MP-1000" and 3.6 parts by weight of "Aerosil RX50" were added and mixed for 25 minutes to obtain toner A-15.

In 100 parts by weight of the toner mother particles A having the circularity degree of 0.90, 0.2 parts by weight of "MP-1000" and 5.0 parts by weight of "Aerosil RX50" were added and mixed for 25 minutes to obtain toner A-16.

In 100 parts by weight of the toner mother particles A having the circularity degree of 0.90, 0.4 parts by weight of "MP-1000" and 5.0 parts by weight of "Aerosil RX50" were added and mixed for 25 minutes to obtain toner A-17.

In 100 parts by weight of the toner mother particles A having the circularity degree of 0.90, 0.6 parts by weight of "MP-1000" and 5.0 parts by weight of "Aerosil RX50" were added and mixed for 25 minutes to obtain toner A-18.

In 100 parts by weight of the toner mother particles A having the circularity degree of 0.90, 0.8 parts by weight of "MP-1000" and 5.0 parts by weight of "Aerosil RX50" were added and mixed for 25 minutes to obtain toner A-19.

In 100 parts by weight of the toner mother particles A having the circularity degree of 0.90, 1.0 part by weight of "MP-1000" and 5.0 parts by weight of "Aerosil RX50" were added and mixed for 25 minutes to obtain toner A-20.

In 100 parts by weight of the toner mother particles A having the circularity degree of 0.90, 0.2 parts by weight of "MP-1000" and 5.4 parts by weight of "Aerosil RX50" were added and mixed for 25 minutes to obtain toner A-21.

In 100 parts by weight of the toner mother particles A having the circularity degree of 0.90, 0.4 parts by weight of "MP-1000" and 5.4 parts by weight of "Aerosil RX50" were added and mixed for 25 minutes to obtain toner A-22.

In 100 parts by weight of the toner mother particles A having the circularity degree of 0.90, 0.6 parts by weight of "MP-1000" and 5.4 parts by weight of "Aerosil RX50" were added and mixed for 25 minutes to obtain toner A-23.

In 100 parts by weight of the toner mother particles A having the circularity degree of 0.90, 0.8 parts by weight of "MP-1000" and 5.4 parts by weight of "Aerosil RX50" were added and mixed for 25 minutes to obtain toner A-24.

In 100 parts by weight of the toner mother particles A having the circularity degree of 0.90, 1.0 part by weight of "MP-1000" and 5.4 parts by weight of "Aerosil RX50" were added and mixed for 25 minutes to obtain toner A-25.

In 100 parts by weight of the toner mother particles B having the circularity degree of 0.92, 0.2 parts by weight of "MP-1000" and 1.8 parts by weight of "Aerosil RX50" were added and mixed for 25 minutes to obtain toner B-1.

In 100 parts by weight of the toner mother particles B having the circularity degree of 0.92, 0.4 parts by weight of "MP-1000" and 1.8 parts by weight of "Aerosil RX50" were added and mixed for 25 minutes to obtain toner B-2.

In 100 parts by weight of the toner mother particles B having the circularity degree of 0.92, 0.6 parts by weight of "MP-1000" and 1.8 parts by weight of "Aerosil RX50" were added and mixed for 25 minutes to obtain toner B-3.

In 100 parts by weight of the toner mother particles B having the circularity degree of 0.92, 0.8 parts by weight of "MP-1000" and 1.8 parts by weight of "Aerosil RX50" were added and mixed for 25 minutes to obtain toner B-4.

In 100 parts by weight of the toner mother particles B having the circularity degree of 0.92, 1.0 part by weight of "MP-1000" and 1.8 parts by weight of "Aerosil RX50" were added and mixed for 25 minutes to obtain toner B-5.

In 100 parts by weight of the toner mother particles B having the circularity degree of 0.92, 0.2 parts by weight of "MP-1000" and 2.2 parts by weight of "Aerosil RX50" were added and mixed for 25 minutes to obtain toner B-6.

In 100 parts by weight of the toner mother particles B having the circularity degree of 0.92, 0.4 parts by weight of "MP-1000" and 2.2 parts by weight of "Aerosil RX50" were added and mixed for 25 minutes to obtain toner B-7.

In 100 parts by weight of the toner mother particles B having the circularity degree of 0.92, 0.6 parts by weight of "MP-1000" and 2.2 parts by weight of "Aerosil RX50" were added and mixed for 25 minutes to obtain toner B-8.

In 100 parts by weight of the toner mother particles B having the circularity degree of 0.92, 0.8 parts by weight of "MP-1000" and 2.2 parts by weight of "Aerosil RX50" were added and mixed for 25 minutes to obtain toner B-9.

In 100 parts by weight of the toner mother particles B having the circularity degree of 0.92, 1.0 part by weight of "MP-1000" and 2.2 parts by weight of "Aerosil RX50" were added and mixed for 25 minutes to obtain toner B-10.

In 100 parts by weight of the toner mother particles B having the circularity degree of 0.92, 0.2 parts by weight of "MP-1000" and 3.6 parts by weight of "Aerosil RX50" were added and mixed for 25 minutes to obtain toner B-11.

In 100 parts by weight of the toner mother particles B having the circularity degree of 0.92, 0.4 parts by weight of "MP-1000" and 3.6 parts by weight of "Aerosil RX50" were added and mixed for 25 minutes to obtain toner B-12.

In 100 parts by weight of the toner mother particles B having the circularity degree of 0.92, 0.6 parts by weight of "MP-1000" and 3.6 parts by weight of "Aerosil RX50" were added and mixed for 25 minutes to obtain toner B-13.

In 100 parts by weight of the toner mother particles B having the circularity degree of 0.92, 0.8 parts by weight of "MP-1000" and 3.6 parts by weight of "Aerosil RX50" were added and mixed for 25 minutes to obtain toner B-14.

In 100 parts by weight of the toner mother particles B having the circularity degree of 0.92, 1.0 part by weight of "MP-1000" and 3.6 parts by weight of "Aerosil RX50" were added and mixed for 25 minutes to obtain toner B-15.

In 100 parts by weight of the toner mother particles B having the circularity degree of 0.92, 0.2 parts by weight of "MP-1000" and 5.0 parts by weight of "Aerosil RX50" were added and mixed for 25 minutes to obtain toner B-16.

In 100 parts by weight of the toner mother particles B having the circularity degree of 0.92, 0.4 parts by weight of "MP-1000" and 5.0 parts by weight of "Aerosil RX50" were added and mixed for 25 minutes to obtain toner B-17.

In 100 parts by weight of the toner mother particles B having the circularity degree of 0.92, 0.6 parts by weight of "MP-1000" and 5.0 parts by weight of "Aerosil RX50" were added and mixed for 25 minutes to obtain toner B-18.

In 100 parts by weight of the toner mother particles B having the circularity degree of 0.92, 0.8 parts by weight of "MP-1000" and 5.0 parts by weight of "Aerosil RX50" were added and mixed for 25 minutes to obtain toner B-19.

In 100 parts by weight of the toner mother particles B having the circularity degree of 0.92, 1.0 part by weight of "MP-1000" and 5.0 parts by weight of "Aerosil RX50" were added and mixed for 25 minutes to obtain toner B-20.

In 100 parts by weight of the toner mother particles B having the circularity degree of 0.92, 0.2 parts by weight of "MP-1000" and 5.4 parts by weight of "Aerosil RX50" were added and mixed for 25 minutes to obtain toner B-21.

In 100 parts by weight of the toner mother particles B having the circularity degree of 0.92, 0.4 parts by weight of "MP-1000" and 5.4 parts by weight of "Aerosil RX50" were added and mixed for 25 minutes to obtain toner B-22.

In 100 parts by weight of the toner mother particles B having the circularity degree of 0.92, 0.6 parts by weight of "MP-1000" and 5.4 parts by weight of "Aerosil RX50" were added and mixed for 25 minutes to obtain toner B-23.

In 100 parts by weight of the toner mother particles B having the circularity degree of 0.92, 0.8 parts by weight of "MP-1000" and 5.4 parts by weight of "Aerosil RX50" were added and mixed for 25 minutes to obtain toner B-24.

In 100 parts by weight of the toner mother particles B having the circularity degree of 0.92, 1.0 part by weight of "MP-1000" and 5.4 parts by weight of "Aerosil RX50" were added and mixed for 25 minutes to obtain toner B-25.

In 100 parts by weight of the toner mother particles C having the circularity degree of 0.94, 0.2 parts by weight of "MP-1000" and 1.8 parts by weight of "Aerosil RX50" were added and mixed for 25 minutes to obtain toner C-1.

In 100 parts by weight of the toner mother particles C having the circularity degree of 0.94, 0.4 parts by weight of "MP-1000" and 1.8 parts by weight of "Aerosil RX50" were added and mixed for 25 minutes to obtain toner C-2.

In 100 parts by weight of the toner mother particles C having the circularity degree of 0.94, 0.6 parts by weight of "MP-1000" and 1.8 parts by weight of "Aerosil RX50" were added and mixed for 25 minutes to obtain toner C-3.

In 100 parts by weight of the toner mother particles C having the circularity degree of 0.94, 0.8 parts by weight of "MP-1000" and 1.8 parts by weight of "Aerosil RX50" were added and mixed for 25 minutes to obtain toner C-4.

In 100 parts by weight of the toner mother particles C having the circularity degree of 0.94, 1.0 part by weight of "MP-1000" and 1.8 parts by weight of "Aerosil RX50" were added and mixed for 25 minutes to obtain toner C-5.

In 100 parts by weight of the toner mother particles C having the circularity degree of 0.94, 0.2 parts by weight of "MP-1000" and 2.2 parts by weight of "Aerosil RX50" were added and mixed for 25 minutes to obtain toner C-6.

In 100 parts by weight of the toner mother particles C having the circularity degree of 0.94, 0.4 parts by weight of "MP-1000" and 2.2 parts by weight of "Aerosil RX50" were added and mixed for 25 minutes to obtain toner C-7.

In 100 parts by weight of the toner mother particles C having the circularity degree of 0.94, 0.6 parts by weight of "MP-1000" and 2.2 parts by weight of "Aerosil RX50" were added and mixed for 25 minutes to obtain toner C-8.

In 100 parts by weight of the toner mother particles C having the circularity degree of 0.94, 0.8 parts by weight of "MP-1000" and 2.2 parts by weight of "Aerosil RX50" were added and mixed for 25 minutes to obtain toner C-9.

In 100 parts by weight of the toner mother particles C having the circularity degree of 0.94, 1.0 part by weight of "MP-1000" and 2.2 parts by weight of "Aerosil RX50" were added and mixed for 25 minutes to obtain toner C-10.

In 100 parts by weight of the toner mother particles C having the circularity degree of 0.94, 0.2 parts by weight of "MP-1000" and 3.6 parts by weight of "Aerosil RX50" were added and mixed for 25 minutes to obtain toner C-11.

In 100 parts by weight of the toner mother particles C having the circularity degree of 0.94, 0.4 parts by weight of "MP-1000" and 3.6 parts by weight of "Aerosil RX50" were added and mixed for 25 minutes to obtain toner C-12.

In 100 parts by weight of the toner mother particles C having the circularity degree of 0.94, 0.6 part by weight of "MP-1000" and 3.6 parts by weight of "Aerosil RX50" were added and mixed for 25 minutes to obtain toner C-13.

In 100 parts by weight of the toner mother particles C having the circularity degree of 0.94, 0.8 parts by weight of "MP-1000" and 3.6 parts by weight of "Aerosil RX50" were added and mixed for 25 minutes to obtain toner C-14.

In 100 parts by weight of the toner mother particles C having the circularity degree of 0.94, 1.0 part by weight of "MP-1000" and 3.6 parts by weight of "Aerosil RX50" were added and mixed for 25 minutes to obtain toner C-15.

In 100 parts by weight of the toner mother particles C having the circularity degree of 0.94, 0.2 parts by weight of "MP-1000" and 5.0 parts by weight of "Aerosil RX50" were added and mixed for 25 minutes to obtain toner C-16.

In 100 parts by weight of the toner mother particles C having the circularity degree of 0.94, 0.4 parts by weight of "MP-1000" and 5.0 parts by weight of "Aerosil RX50" were added and mixed for 25 minutes to obtain toner C-17.

In 100 parts by weight of the toner mother particles C having the circularity degree of 0.94, 0.6 parts by weight of "MP-1000" and 5.0 parts by weight of "Aerosil RX50" were added and mixed for 25 minutes to obtain toner C-18.

In 100 parts by weight of the toner mother particles C having the circularity degree of 0.94, 0.8 parts by weight of "MP-1000" and 5.0 parts by weight of "Aerosil RX50" were added and mixed for 25 minutes to obtain toner C-19.

In 100 parts by weight of the toner mother particles C having the circularity degree of 0.94, 0.9 parts by weight of "MP-1000" and 5.0 parts by weight of "Aerosil RX50" were added and mixed for 25 minutes to obtain toner C-20.

In 100 parts by weight of the toner mother particles C having the circularity degree of 0.94, 0.2 parts by weight of "MP-1000" and 5.4 parts by weight of "Aerosil RX50" were added and mixed for 25 minutes to obtain toner C-21.

In 100 parts by weight of the toner mother particles C having the circularity degree of 0.94, 0.4 parts by weight of "MP-1000" and 5.4 parts by weight of "Aerosil RX50" were added and mixed for 25 minutes to obtain toner C-22.

In 100 parts by weight of the toner mother particles C having the circularity degree of 0.94, 0.6 part by weight of "MP-1000" and 5.4 parts by weight of "Aerosil RX50" were added and mixed for 25 minutes to obtain toner C-23.

In 100 parts by weight of the toner mother particles C having the circularity degree of 0.94, 0.8 parts by weight of "MP-1000" and 5.4 parts by weight of "Aerosil RX50" were added and mixed for 25 minutes to obtain toner C-24.

In 100 parts by weight of the toner mother particles C having the circularity degree of 0.94, 0.9 parts by weight of "MP-1000" and 5.4 parts by weight of "Aerosil RX50" were added and mixed for 25 minutes to obtain toner C-25.

In 100 parts by weight of the toner mother particles D having the circularity degree of 0.96, 0.2 parts by weight of "MP-1000" and 1.8 parts by weight of "Aerosil RX50" were added and mixed for 25 minutes to obtain toner D-1.

In 100 parts by weight of the toner mother particles D having the circularity degree of 0.96, 0.4 parts by weight of "MP-1000" and 1.8 parts by weight of "Aerosil RX50" were added and mixed for 25 minutes to obtain toner D-2.

In 100 parts by weight of the toner mother particles D having the circularity degree of 0.96, 0.6 parts by weight of "MP-1000" and 1.8 parts by weight of "Aerosil RX50" were added and mixed for 25 minutes to obtain toner D-3.

In 100 parts by weight of the toner mother particles D having the circularity degree of 0.96, 0.8 parts by weight of "MP-1000" and 1.8 parts by weight of "Aerosil RX50" were added and mixed for 25 minutes to obtain toner D-4.

In 100 parts by weight of the toner mother particles D having the circularity degree of 0.96, 1.0 part by weight of "MP-1000" and 1.8 parts by weight of "Aerosil RX50" were added and mixed for 25 minutes to obtain toner D-5.

In 100 parts by weight of the toner mother particles D having the circularity degree of 0.96, 0.2 parts by weight of "MP-1000" and 2.2 parts by weight of "Aerosil RX50" were added and mixed for 25 minutes to obtain toner D-6.

In 100 parts by weight of the toner mother particles D having the circularity degree of 0.96, 0.4 parts by weight of "MP-1000" and 2.2 parts by weight of "Aerosil RX50" were added and mixed for 25 minutes to obtain toner D-7.

In 100 parts by weight of the toner mother particles D having the circularity degree of 0.96, 0.6 parts by weight of "MP-1000" and 2.2 parts by weight of "Aerosil RX50" were added and mixed for 25 minutes to obtain toner D-8.

In 100 parts by weight of the toner mother particles D having the circularity degree of 0.96, 0.8 parts by weight of "MP-1000" and 2.2 parts by weight of "Aerosil RX50" were added and mixed for 25 minutes to obtain toner D-9.

In 100 parts by weight of the toner mother particles D having the circularity degree of 0.96, 1.0 part by weight of "MP-1000" and 2.2 parts by weight of "Aerosil RX50" were added and mixed for 25 minutes to obtain toner D-10.

In 100 parts by weight of the toner mother particles D having the circularity degree of 0.96, 0.2 parts by weight of "MP-1000" and 3.6 parts by weight of "Aerosil RX50" were added and mixed for 25 minutes to obtain toner D-11.

In 100 parts by weight of the toner mother particles D having the circularity degree of 0.96, 0.4 parts by weight of "MP-1000" and 3.6 parts by weight of "Aerosil RX50" were added and mixed for 25 minutes to obtain toner D-12.

In 100 parts by weight of the toner mother particles D having the circularity degree of 0.96, 0.6 parts by weight of "MP-1000" and 3.6 parts by weight of "Aerosil RX50" were added and mixed for 25 minutes to obtain toner D-13.

In 100 parts by weight of the toner mother particles D having the circularity degree of 0.96, 0.8 parts by weight of "MP-1000" and 3.6 parts by weight of "Aerosil RX50" were added and mixed for 25 minutes to obtain toner D-14.

In 100 parts by weight of the toner mother particles D having the circularity degree of 0.96, 1.0 part by weight of "MP-1000" and 3.6 parts by weight of "Aerosil RX50" were added and mixed for 25 minutes to obtain toner D-15.

In 100 parts by weight of the toner mother particles D having the circularity degree of 0.96, 0.2 parts by weight of "MP-1000" and 5.0 parts by weight of "Aerosil RX50" were added and mixed for 25 minutes to obtain toner D-16.

In 100 parts by weight of the toner mother particles D having the circularity degree of 0.96, 0.4 parts by weight of "MP-1000" and 5.0 parts by weight of "Aerosil RX50" were added and mixed for 25 minutes to obtain toner D-17.

In 100 parts by weight of the toner mother particles D having the circularity degree of 0.96, 0.6 parts by weight of "MP-1000" and 5.0 parts by weight of "Aerosil RX50" were added and mixed for 25 minutes to obtain toner D-18.

In 100 parts by weight of the toner mother particles D having the circularity degree of 0.96, 0.8 parts by weight of "MP-1000" and 5.0 parts by weight of "Aerosil RX50" were added and mixed for 25 minutes to obtain toner D-19.

In 100 parts by weight of the toner mother particles D having the circularity degree of 0.96, 0.9 parts by weight of "MP-1000" and 5.0 parts by weight of "Aerosil RX50" were added and mixed for 25 minutes to obtain toner D-20.

In 100 parts by weight of the toner mother particles D having the circularity degree of 0.96, 0.2 parts by weight of "MP-1000" and 5.4 parts by weight of "Aerosil RX50" were added and mixed for 25 minutes to obtain toner D-21.

In 100 parts by weight of the toner mother particles D having the circularity degree of 0.96, 0.4 parts by weight of "MP-1000" and 5.4 parts by weight of "Aerosil RX50" were added and mixed for 25 minutes to obtain toner D-22.

In 100 parts by weight of the toner mother particles D having the circularity degree of 0.96, 0.6 parts by weight of "MP-1000" and 5.4 parts by weight of "Aerosil RX50" were added and mixed for 25 minutes to obtain toner D-23.

In 100 parts by weight of the toner mother particles D having the circularity degree of 0.96, 0.8 parts by weight of "MP-1000" and 5.4 parts by weight of "Aerosil RX50" were added and mixed for 25 minutes to obtain toner D-24.

In 100 parts by weight of the toner mother particles D having the circularity degree of 0.96, 0.9 parts by weight of "MP-1000" and 5.4 parts by weight of "Aerosil RX50" were added and mixed for 25 minutes to obtain toner D-25.

In 100 parts by weight of the toner mother particles E having the circularity degree of 0.97, 0.2 parts by weight of "MP-1000" and 1.8 parts by weight of "Aerosil RX50" were added and mixed for 25 minutes to obtain toner E-1.

In 100 parts by weight of the toner mother particles E having the circularity degree of 0.97, 0.4 parts by weight of "MP-1000" and 1.8 parts by weight of "Aerosil RX50" were added and mixed for 25 minutes to obtain toner E-2.

In 100 parts by weight of the toner mother particles E having the circularity degree of 0.97, 0.6 parts by weight of "MP-1000" and 1.8 parts by weight of "Aerosil RX50" were added and mixed for 25 minutes to obtain toner E-3.

In 100 parts by weight of the toner mother particles E having the circularity degree of 0.97, 0.8 parts by weight of "MP-1000" and 1.8 parts by weight of "Aerosil RX50" were added and mixed for 25 minutes to obtain toner E-4.

In 100 parts by weight of the toner mother particles E having the circularity degree of 0.97, 1.0 part by weight of "MP-1000" and 1.8 parts by weight of "Aerosil RX50" were added and mixed for 25 minutes to obtain toner E-5.

In 100 parts by weight of the toner mother particles E having the circularity degree of 0.97, 0.2 parts by weight of "MP-1000" and 2.2 parts by weight of "Aerosil RX50" were added and mixed for 25 minutes to obtain toner E-6.

In 100 parts by weight of the toner mother particles E having the circularity degree of 0.97, 0.4 parts by weight of "MP-1000" and 2.2 parts by weight of "Aerosil RX50" were added and mixed for 25 minutes to obtain toner E-7.

In 100 parts by weight of the toner mother particles E having the circularity degree of 0.97, 0.6 parts by weight of "MP-1000" and 2.2 parts by weight of "Aerosil RX50" were added and mixed for 25 minutes to obtain toner E-8.

In 100 parts by weight of the toner mother particles E having the circularity degree of 0.97, 0.8 parts by weight of "MP-1000" and 2.2 parts by weight of "Aerosil RX50" were added and mixed for 25 minutes to obtain toner E-9.

In 100 parts by weight of the toner mother particles E having the circularity degree of 0.97, 1.0 part by weight of "MP-1000" and 2.2 parts by weight of "Aerosil RX50" were added and mixed for 25 minutes to obtain toner E-10.

In 100 parts by weight of the toner mother particles E having the circularity degree of 0.97, 0.2 parts by weight of "MP-1000" and 3.6 parts by weight of "Aerosil RX50" were added and mixed for 25 minutes to obtain toner E-11.

In 100 parts by weight of the toner mother particles E having the circularity degree of 0.97, 0.4 parts by weight of "MP-1000" and 3.6 parts by weight of "Aerosil RX50" were added and mixed for 25 minutes to obtain toner E-12.

In 100 parts by weight of the toner mother particles E having the circularity degree of 0.97, 0.6 parts by weight of "MP-1000" and 3.6 parts by weight of "Aerosil RX50" were added and mixed for 25 minutes to obtain toner E-13.

In 100 parts by weight of the toner mother particles E having the circularity degree of 0.97, 0.8 parts by weight of "MP-1000" and 3.6 parts by weight of "Aerosil RX50" were added and mixed for 25 minutes to obtain toner E-14.

In 100 parts by weight of the toner mother particles E having the circularity degree of 0.97, 1.0 part by weight of "MP-1000" and 3.6 parts by weight of "Aerosil RX50" were added and mixed for 25 minutes to obtain toner E-15.

In 100 parts by weight of the toner mother particles E having the circularity degree of 0.97, 0.2 parts by weight of "MP-1000" and 5.0 parts by weight of "Aerosil RX50" were added and mixed for 25 minutes to obtain toner E-16.

In 100 parts by weight of the toner mother particles E having the circularity degree of 0.97, 0.4 parts by weight of "MP-1000" and 5.0 parts by weight of "Aerosil RX50" were added and mixed for 25 minutes to obtain toner E-17.

In 100 parts by weight of the toner mother particles E having the circularity degree of 0.97, 0.6 parts by weight of "MP-1000" and 5.0 parts by weight of "Aerosil RX50" were added and mixed for 25 minutes to obtain toner E-18.

In 100 parts by weight of the toner mother particles E having the circularity degree of 0.97, 0.8 parts by weight of "MP-1000" and 5.0 parts by weight of "Aerosil RX50" were added and mixed for 25 minutes to obtain toner E-19.

In 100 parts by weight of the toner mother particles E having the circularity degree of 0.97, 0.9 parts by weight of "MP-1000" and 5.0 parts by weight of "Aerosil RX50" were added and mixed for 25 minutes to obtain toner E-20.

In 100 parts by weight of the toner mother particles E having the circularity degree of 0.97, 0.2 parts by weight of "MP-1000" and 5.4 parts by weight of "Aerosil RX50" were added and mixed for 25 minutes to obtain toner E-21.

In 100 parts by weight of the toner mother particles E having the circularity degree of 0.97, 0.4 parts by weight of "MP-1000" and 5.4 parts by weight of "Aerosil RX50" were added and mixed for 25 minutes to obtain toner E-22.

In 100 parts by weight of the toner mother particles E having the circularity degree of 0.97, 0.6 parts by weight of "MP-1000" and 5.4 parts by weight of "Aerosil RX50" were added and mixed for 25 minutes to obtain toner E-23.

In 100 parts by weight of the toner mother particles E having the circularity degree of 0.97, 0.8 parts by weight of "MP-1000" and 5.4 parts by weight of "Aerosil RX50" were added and mixed for 25 minutes to obtain toner E-24.

In 100 parts by weight of the toner mother particles E having the circularity degree of 0.97, 0.9 parts by weight of "MP-1000" and 5.4 parts by weight of "Aerosil RX50" were added and mixed for 25 minutes to obtain toner E-25.

In 100 parts by weight of the toner mother particles F having the circularity degree of 0.99, 0.2 parts by weight of "MP-1000" and 1.8 parts by weight of "Aerosil RX50" were added and mixed for 25 minutes to obtain toner F-1.

In 100 parts by weight of the toner mother particles F having the circularity degree of 0.99, 0.4 parts by weight of "MP-1000" and 1.8 parts by weight of "Aerosil RX50" were added and mixed for 25 minutes to obtain toner F-2.

In 100 parts by weight of the toner mother particles F having the circularity degree of 0.99, 0.6 parts by weight of "MP-1000" and 1.8 parts by weight of "Aerosil RX50" were added and mixed for 25 minutes to obtain toner F-3.

In 100 parts by weight of the toner mother particles F having the circularity degree of 0.99, 0.8 parts by weight of "MP-1000" and 1.8 parts by weight of "Aerosil RX50" were added and mixed for 25 minutes to obtain toner F-4.

In 100 parts by weight of the toner mother particles F having the circularity degree of 0.99, 1.0 part by weight of "MP-1000" and 1.8 parts by weight of "Aerosil RX50" were added and mixed for 25 minutes to obtain toner F-5.

In 100 parts by weight of the toner mother particles F having the circularity degree of 0.99, 0.2 parts by weight of "MP-1000" and 2.2 parts by weight of "Aerosil RX50" were added and mixed for 25 minutes to obtain toner F-6.

In 100 parts by weight of the toner mother particles F having the circularity degree of 0.99, 0.4 parts by weight of "MP-1000" and 2.2 parts by weight of "Aerosil RX50" were added and mixed for 25 minutes to obtain toner F-7.

In 100 parts by weight of the toner mother particles F having the circularity degree of 0.99, 0.6 parts by weight of "MP-1000" and 2.2 parts by weight of "Aerosil RX50" were added and mixed for 25 minutes to obtain toner F-8.

In 100 parts by weight of the toner mother particles F having the circularity degree of 0.99, 0.8 parts by weight of "MP-1000" and 2.2 parts by weight of "Aerosil RX50" were added and mixed for 25 minutes to obtain toner F-9.

In 100 parts by weight of the toner mother particles F having the circularity degree of 0.99, 1.0 part by weight of "MP-1000" and 2.2 parts by weight of "Aerosil RX50" were added and mixed for 25 minutes to obtain toner F-10.

In 100 parts by weight of the toner mother particles F having the circularity degree of 0.99, 0.2 parts by weight of "MP-1000" and 3.6 parts by weight of "Aerosil RX50" were added and mixed for 25 minutes to obtain toner F-11.

In 100 parts by weight of the toner mother particles F having the circularity degree of 0.99, 0.4 parts by weight of "MP-1000" and 3.6 parts by weight of "Aerosil RX50" were added and mixed for 25 minutes to obtain toner F-12.

In 100 parts by weight of the toner mother particles F having the circularity degree of 0.99, 0.6 parts by weight of "MP-1000" and 3.6 parts by weight of "Aerosil RX50" were added and mixed for 25 minutes to obtain toner F-13.

In 100 parts by weight of the toner mother particles F having the circularity degree of 0.99, 0.8 parts by weight of "MP-1000" and 3.6 parts by weight of "Aerosil RX50" were added and mixed for 25 minutes to obtain toner F-14.

In 100 parts by weight of the toner mother particles F having the circularity degree of 0.99, 1.0 part by weight of "MP-1000" and 3.6 parts by weight of "Aerosil RX50" were added and mixed for 25 minutes to obtain toner F-15.

In 100 parts by weight of the toner mother particles F having the circularity degree of 0.99, 0.2 parts by weight of "MP-1000" and 5.0 parts by weight of "Aerosil RX50" were added and mixed for 25 minutes to obtain toner F-16.

In 100 parts by weight of the toner mother particles F having the circularity degree of 0.99, 0.4 parts by weight of "MP-1000" and 5.0 parts by weight of "Aerosil RX50" were added and mixed for 25 minutes to obtain toner F-17.

In 100 parts by weight of the toner mother particles F having the circularity degree of 0.99, 0.6 parts by weight of "MP-1000" and 5.0 parts by weight of "Aerosil RX50" were added and mixed for 25 minutes to obtain toner F-18.

In 100 parts by weight of the toner mother particles F having the circularity degree of 0.99, 0.8 parts by weight of "MP-1000" and 5.0 parts by weight of "Aerosil RX50" were added and mixed for 25 minutes to obtain toner F-19.

In 100 parts by weight of the toner mother particles F having the circularity degree of 0.99, 0.9 parts by weight of "MP-1000" and 5.0 parts by weight of "Aerosil RX50" were added and mixed for 25 minutes to obtain toner F-20.

In 100 parts by weight of the toner mother particles F having the circularity degree of 0.99, 0.2 parts by weight of "MP-1000" and 5.4 parts by weight of "Aerosil RX50" were added and mixed for 25 minutes to obtain toner F-21.

In 100 parts by weight of the toner mother particles F having the circularity degree of 0.99, 0.4 parts by weight of "MP-1000" and 5.4 parts by weight of "Aerosil RX50" were added and mixed for 25 minutes to obtain toner F-22.

In 100 parts by weight of the toner mother particles F having the circularity degree of 0.99, 0.6 parts by weight of "MP-1000" and 5.4 parts by weight of "Aerosil RX50" were added and mixed for 25 minutes to obtain toner F-23.

In 100 parts by weight of the toner mother particles F having the circularity degree of 0.99, 0.8 parts by weight of "MP-1000" and 5.4 parts by weight of "Aerosil RX50" were added and mixed for 25 minutes to obtain toner F-24.

In 100 parts by weight of the toner mother particles F having the circularity degree of 0.99, 0.9 parts by weight of "MP-1000" and 5.4 parts by weight of "Aerosil RX50" were added and mixed for 25 minutes to obtain toner F-25.

A continuous print test was conducted by using toner A-1 to toner F-25 obtained in the development device 16 shown in FIG. 1. Letter size standard paper (e.g., Xerox 4200, whiteness=92, basis weight=20 lb) was fed in the portrait orientation (two short sides of the four sides constitute the front and back ends), and a 20% duty image (an image that results black parts in 20% of the sheet (an image that results black parts in 100% of the sheet is defined as a 100% duty image)) was printed. One white sheet (0% duty image) was printed for every 3,000 sheets, and during the printing of another sheet, the power was cut off to instantaneously interrupt the printing. Then, drum fog toner attached to the photosensitive drum was collected.

The drum fog toner was collected by removing the development device from the image forming device, by attaching a transparent mending tape on the photosensitive drum and pealing it for the purpose of removing the toner attached on the photosensitive drum, and by attaching the pending tape on white paper. After that, using a spectrophotometer CM-2600d (manufactured by Konica Minolta: measurement diameter=ϕ8 mm), an average color difference ΔE (Equation 1) of the mending tape after pealing from the photosensitive drum relative to the mending tape by itself (an average of five points at the same positions on the photosensitive drum) was measured. The average value is calculated to the first decimal, and the calculated color difference ΔE is defined as the drum fog.

$$\Delta E=\sqrt{(L_1-L_2)^2+(a_1-a_2)^2+(b_1-b_2)^2} \quad \text{(Equation 1)}$$

L, a and b are indexes of the L*a*b* color system. L indicates a lightness index, and a and b indicate chromaticness indexes that indicate hue and chroma saturation. $L_1$, $a_1$ and $b_1$ indicate lightness and chromaticness of the mending tape after pealing from the photosensitive drum. $L_2$, $a_2$ and $b_2$ indicate lightness and chromaticness of the mending tape by itself.

The drum fog was evaluated as follows: ◎ (excellent) when the drum fog (color difference ΔE) is 1.5 or less, ○ (good) when the drum fog (color difference ΔE) is 1.6 or more and 3.0 or less, and X (poor) when the drum fog (color difference ΔE) is 3.1 or more.

Smear was visually evaluated as follows: ◎ (excellent) when there was no prints in non-printed areas on the recording medium and when there was no attachment of the external additive on the charge roller, ○ (good) when there was no prints in non-printed areas on the recording medium but when a small amount of the external additive was attached to an end of the charge roller, and X (poor) when the toner is attached to the non-printed areas of the recording medium, causing smear.

In addition, if the continuous print test using the 20% duty image did not results in the drum fog or smear, the test was conducted for 50,000 sheets.

Results of the continuous print test are described below based on Table 1 to Table 6.

TABLE 1

| | Toner | Circularity Degree | PMMA | $SiO_2$ | Smear | Fog |
|---|---|---|---|---|---|---|
| Comparative Example 1-1 | A-1 | 0.90 | 0.2 | 1.8 | ○ | X |
| Comparative Example 1-2 | A-2 | | 0.4 | 1.8 | ○ | X |
| Comparative Example 1-3 | A-3 | | 0.6 | 1.8 | ○ | X |
| Comparative Example 1-4 | A-4 | | 0.8 | 1.8 | ○ | X |
| Comparative Example 1-5 | A-5 | | 1.0 | 1.8 | X | ○ |

TABLE 1-continued

| | Toner | Circularity Degree | PMMA | $SiO_2$ | Smear | Fog |
|---|---|---|---|---|---|---|
| Comparative Example 1-6 | A-6 | | 0.2 | 2.2 | ○ | X |
| Comparative Example 1-7 | A-7 | | 0.4 | 2.2 | ○ | X |
| Comparative Example 1-8 | A-8 | | 0.6 | 2.2 | ○ | X |
| Comparative Example 1-9 | A-9 | | 0.8 | 2.2 | ○ | X |
| Comparative Example 1-10 | A-10 | | 1.0 | 2.2 | X | ○ |
| Comparative Example 1-11 | A-11 | | 0.2 | 3.6 | ○ | X |
| Comparative Example 1-12 | A-12 | | 0.4 | 3.6 | ○ | X |
| Comparative Example 1-13 | A-13 | | 0.6 | 3.6 | ○ | X |
| Comparative Example 1-14 | A-14 | | 0.8 | 3.6 | ○ | X |
| Comparative Example 1-15 | A-15 | | 1.0 | 3.6 | X | ○ |
| Comparative Example 1-16 | A-16 | | 0.2 | 5.0 | ○ | X |
| Comparative Example 1-17 | A-17 | | 0.4 | 5.0 | ○ | X |
| Comparative Example 1-18 | A-18 | | 0.6 | 5.0 | ○ | X |
| Comparative Example 1-19 | A-19 | | 0.8 | 5.0 | ○ | X |
| Comparative Example 1-20 | A-20 | | 1.0 | 5.0 | X | ○ |
| Comparative Example 1-21 | A-21 | | 0.2 | 5.4 | ○ | X |
| Comparative Example 1-22 | A-22 | | 0.4 | 5.4 | ○ | X |
| Comparative Example 1-23 | A-23 | | 0.6 | 5.4 | ○ | X |
| Comparative Example 1-24 | A-24 | | 0.8 | 5.4 | X | ○ |
| Comparative Example 1-25 | A-25 | | 1.0 | 5.4 | X | ○ |

[Comparative Example 1-1] The smear did not occur with toner A-1. However, the drum fog (color difference ΔE) reached 3.6 after printing 6,000 sheets. Therefore, the continuous print test was stopped. In addition, when the development device was opened, attachment of a small amount of the external additive was observed on the end of the charge roller. [Comparative Example 1-2] The smear did not occur with toner A-2. However, the drum fog (color difference ΔE) reached 4.0 after printing 9,000 sheets. Therefore, the continuous print test was stopped. In addition, when the development device was opened, attachment of a small amount of the external additive was observed on the end of the charge roller. [Comparative Example 1-3] The smear did not occur with toner A-3. However, the drum fog (color difference ΔE) reached 3.8 after printing 6,000 sheets. Therefore, the continuous print test was stopped. In addition, when the development device was opened, attachment of a small amount of the external additive was observed on the end of the charge roller. [Comparative Example 1-4] The smear did not occur with toner A-4. However, the drum fog (color difference ΔE) reached 5.0 after printing 9,000 sheets. Therefore, the continuous print test was stopped. In addition, when the development device was opened, attachment of a small amount of the external additive was observed on the end of the charge roller. [Comparative Example 1-5] With toner A-5, the drum fog (color difference ΔE) was 1.8 at most, and the smear occurred at the left end part of the recording medium after printing 5,500 sheets. Therefore, the continuous print test was stopped. [Comparative Example 1-6] With toner A-6, the drum fog (color difference ΔE) reached 4.1 after printing 12,000 sheets. Therefore, the continuous print test was stopped. Although the smear did not occur, when the development device was opened, attachment of a small amount of the external additive was observed on the end of the charge roller. [Comparative Example 1-7] With toner A-7, the drum fog (color difference ΔE) reached 5.1 after printing 12,000 sheets. Therefore, the continuous print test was stopped. Although the smear did not occur, when the development device was opened, attachment of a small amount of the external additive was observed on the end of the charge roller. [Comparative Example 1-8] With toner A-8, the drum fog (color difference ΔE) reached 4.7 after printing 15,000 sheets. Therefore, the continuous print test was stopped. Although the smear did not occur, when the development device was opened, attachment of a small amount of the external additive was observed on the end of the charge roller. [Comparative Example 1-9] With toner A-9, the drum fog (color difference ΔE) reached 3.8 after printing 15,000 sheets. Therefore, the continuous print test was stopped. Although the smear did not occur, when the development device was opened, attachment of a small amount of the external additive was observed on the end of the charge roller. [Comparative Example 1-10] With toner A-10, the smear occurred on the recording medium after printing 9,000 sheets. Therefore, the continuous print test was stopped. In addition, the drum fog (color difference ΔE) reached 1.7 at most after printing the 9,000 sheets. [Comparative Example 1-11] With toner A-11, the drum fog (color difference ΔE) reached 4.0 after printing 9,000 sheets. Therefore, the continuous print test was stopped. Although the smear did not occur, when the development device was opened, attachment of a small amount of the external additive was observed on the end of the charge roller. [Comparative Example 1-12] With toner A-12, the drum fog (color difference ΔE) reached 3.9 after printing 6,000 sheets. Therefore, the continuous print test was stopped. Although the smear did not occur, when the development device was opened, attachment of a small amount of the external additive was observed on the end of the charge roller. [Comparative Example 1-13] With toner A-13, the drum fog (color difference ΔE) reached 4.2 after printing 9,000 sheets. Therefore, the continuous print test was stopped. Although the smear did not occur, when the development device was opened, attachment of a small amount of the external additive was observed on the end of the charge roller. [Comparative Example 1-14] With toner A-14, the drum fog (color difference ΔE) reached 4.2 after printing 12,000 sheets. Therefore, the continuous print test was stopped. Although the smear did not occur, when the development device was opened, attachment of a small amount of the external additive was observed on the end of the charge roller. [Comparative Example 1-15] With toner A-15, the smear occurred on an edge of the recording medium after printing 15,000 sheets. Therefore, the continuous print test was stopped. In addition, the drum fog (color difference ΔE) reached 1.8 at most after printing the 12,000 sheets. [Comparative Example 1-16] With toner A-16, the drum fog (color difference ΔE) reached 3.8 after printing 18,000 sheets. Therefore, the continuous print test was stopped. Although the smear did not occur, when the development device was opened, attachment of a small amount of the external additive was observed on the end of the charge roller. [Comparative Example 1-17] With toner A-17, the drum fog (color difference ΔE) reached 4.2 after printing 12,000 sheets. Therefore, the continuous print test was stopped. Although the smear did not occur, when the development device was opened, attachment of a small amount of the external additive was observed on the end of the charge roller. [Comparative Example 1-18] With toner A-18, the drum fog (color difference ΔE) reached 3.7 after printing 9,000 sheets. Therefore, the continuous print test was stopped. Although the smear did not occur, when the development device was opened, attachment of a small amount of the external additive was observed on the end of the charge roller. [Comparative Example 1-19] With toner A-19, the drum fog (color difference ΔE) reached 4.8 after printing 12,000 sheets. Therefore, the continuous print test was stopped. Although the smear did not occur, when the development device was opened, attachment of a small amount of the external additive was observed on the end of the charge roller. [Comparative Example 1-20] With toner A-20, the smear occurred on an edge of the recording medium after printing 12,000 sheets. Therefore, the continuous print test was stopped. In addition, the drum fog (color difference ΔE) reached 1.6 after printing the 12,000 sheets. [Comparative Example 1-21] With toner A-21, the drum fog (color difference ΔE) reached 3.5 after printing 12,000 sheets. Therefore, the continuous print test was stopped. Although the smear did not occur, when the development device was opened, attachment of a small amount of the external additive was observed on the end of the charge roller. [Comparative Example 1-22] With toner A-22, the drum fog (color difference ΔE) reached 4.9 after printing 15,000 sheets. Therefore, the continuous print test was stopped. Although the smear did not occur, when the development device was opened, attachment of a small amount of the external additive was observed on the end of the charge roller. [Comparative Example 1-23] With toner A-23, the drum fog (color difference ΔE) reached 4.1 after printing 12,000 sheets. Therefore, the continuous print test was stopped. Although the smear did not occur, when the development device was opened, attachment of a small amount of the external additive was observed on the end of the charge roller. [Comparative Example 1-24] With toner A-24, the smear occurred on an edge of the recording medium after printing 15,000 sheets. Therefore, the continuous print test was stopped. In addition, the drum fog (color difference ΔE) reached 1.9 at most after printing the 9,000 sheets. [Comparative Example 1-25] With toner A-25, the smear occurred on an edge of the recording medium after printing 9,000 sheets. Therefore, the continuous print test was stopped. In addition, the drum fog (color difference ΔE) reached 1.6 after printing the 9,000 sheets.

TABLE 2

| | Toner | Circularity Degree | PMMA | $SiO_2$ | Smear | Fog |
|---|---|---|---|---|---|---|
| Comparative Example 1-26 | B-1 | 0.92 | 0.2 | 1.8 | ○ | X |
| Embodiment 1-1 | B-2 | | 0.4 | 1.8 | ○ | ○ |
| Embodiment 1-2 | B-3 | | 0.6 | 1.8 | ○ | ○ |
| Embodiment 1-3 | B-4 | | 0.8 | 1.8 | ○ | ○ |
| Comparative Example 1-27 | B-5 | | 1.0 | 1.8 | X | ○ |
| Comparative Example 1-28 | B-6 | | 0.2 | 2.2 | ○ | X |
| Embodiment 1-4 | B-7 | | 0.4 | 2.2 | ◎ | ◎ |
| Embodiment 1-5 | B-8 | | 0.6 | 2.2 | ◎ | ◎ |
| Embodiment 1-6 | B-9 | | 0.8 | 2.2 | ◎ | ◎ |

TABLE 2-continued

| | Toner | Circularity Degree | PMMA | $SiO_2$ | Smear | Fog |
|---|---|---|---|---|---|---|
| Comparative Example 1-29 | B-10 | | 1.0 | 2.2 | X | ○ |
| Comparative Example 1-30 | B-11 | | 0.2 | 3.6 | ○ | X |
| Embodiment 1-7 | B-12 | | 0.4 | 3.6 | ◎ | ◎ |
| Embodiment 1-8 | B-13 | | 0.6 | 3.6 | ◎ | ◎ |
| Embodiment 1-9 | B-14 | | 0.8 | 3.6 | ◎ | ◎ |
| Comparative Example 1-31 | B-15 | | 1.0 | 3.6 | X | ○ |
| Comparative Example 1-32 | B-16 | | 0.2 | 5.0 | ○ | X |
| Embodiment 1-10 | B-17 | | 0.4 | 5.0 | ◎ | ◎ |
| Embodiment 1-11 | B-18 | | 0.6 | 5.0 | ◎ | ◎ |
| Embodiment 1-12 | B-19 | | 0.8 | 5.0 | ◎ | ◎ |
| Comparative Example 1-33 | B-20 | | 1.0 | 5.0 | X | ○ |
| Comparative Example 1-34 | B-21 | | 0.2 | 5.4 | ○ | X |
| Embodiment 1-13 | B-22 | | 0.4 | 5.4 | ○ | ○ |
| Embodiment 1-14 | B-23 | | 0.6 | 5.4 | ○ | ○ |
| Embodiment 1-15 | B-24 | | 0.8 | 5.4 | ○ | ○ |
| Comparative Example 1-35 | B-25 | | 1.0 | 5.4 | X | ○ |

[Comparative Example 1-26] With toner B-1, the drum fog (color difference ΔE) reached 3.9 after printing 18,000 sheets. Therefore, the continuous print test was stopped. Although the smear did not occur, when the development device was opened, attachment of a small amount of the external additive was observed on the end of the charge roller. [Embodiment 1-1] to [Embodiment 1-3] With toner B-2, toner B-3 and toner B-4, the drum fog (color difference ΔE) was 3.0 or less, and the continuous print test was conducted up to 50,000 sheets. Although the smear did not occur, when the development device was opened, attachment of a small amount of the external additive was observed on the end of the charge roller. [Comparative Example 1-27] With toner B-5, the smear occurred on an edge of the recording medium after printing 15,000 sheets. Therefore, the continuous print test was stopped. In addition, the drum fog (color difference ΔE) reached 2.2 at most after printing the 12,000 sheets. [Comparative Example 1-28] With toner B-6, the drum fog (color difference ΔE) reached 4.3 after printing 15,000 sheets. Therefore, the continuous print test was stopped. Although the smear did not occur, when the development device was opened, attachment of a small amount of the external additive was observed on the end of the charge roller. [Embodiment 1-4] to [Embodiment 1-6] With toner B-7, toner B-8 and toner B-9, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 1-29] With toner B-10, the smear occurred on an edge of the recording medium after printing 9,000 sheets. Therefore, the continuous print test was stopped. In addition, the drum fog (color difference ΔE) reached 2.1 after printing the 9,000 sheets. [Comparative Example 1-30] With toner B-11, the drum fog (color difference ΔE) reached 4.7 after printing 12,000 sheets. Therefore, the continuous print test was stopped. Although the smear did not occur, when the development device was opened, attachment of a small amount of the external additive was observed on the end of the charge roller. [Embodiment 1-7] to [Embodiment 1-9] With toner B-12, toner B-13 and toner B-14, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 1-31] With toner B-15, the smear occurred on an edge of the recording medium after printing 9,000 sheets. Therefore, the continuous print test was stopped. In addition, the drum fog (color difference ΔE) reached 2.4 after printing the 9,000 sheets. [Comparative Example 1-32] With toner B-16, the drum fog (color difference ΔE) reached 4.4 after printing 9,000 sheets. Therefore, the continuous print test was stopped. Although the smear did not occur, when the development device was opened, attachment of a small amount of the external additive was observed on the end of the charge roller. [Embodiment 1-10] to [Embodiment 1-12] With toner B-17, toner B-18 and toner B-19, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 1-33] With toner B-20, the smear occurred on an edge of the recording medium after printing 9,000 sheets. Therefore, the continuous print test was stopped. In addition, the drum fog (color difference ΔE) reached 2.4 after printing the 9,000 sheets. [Comparative Example 1-34] With toner B-21, the drum fog (color difference ΔE) reached 4.4 after printing 18,000 sheets. Therefore, the continuous print test was stopped. Although the smear did not occur, when the development device was opened, attachment of a small amount of the external additive was observed on the end of the charge roller. [Embodiment 1-13] to [Embodiment 1-15] With toner B-22, toner B-23 and toner B-24, the drum fog (color difference ΔE) was 3.0 or less, and the continuous print test was conducted up to 50,000 sheets. Although the smear did not occur, when the development device was opened, attachment of a small amount of the external additive was observed on end of the end of the charge roller. [Comparative Example 1-35] With toner B-25, the smear occurred on an edge of the recording medium after printing 6,000 sheets. Therefore, the continuous print test was stopped. In addition, the drum fog (color difference ΔE) reached 2.4 after printing the 6,000 sheets.

TABLE 3

| | Toner | Circularity Degree | PMMA | $SiO_2$ | Smear | Fog |
|---|---|---|---|---|---|---|
| Comparative Example 1-36 | C-1 | 0.94 | 0.2 | 1.8 | ○ | X |
| Embodiment 1-16 | C-2 | | 0.4 | 1.8 | ○ | ○ |
| Embodiment 1-17 | C-3 | | 0.6 | 1.8 | ○ | ○ |
| Embodiment 1-18 | C-4 | | 0.8 | 1.8 | ○ | ○ |
| Comparative Example 1-37 | C-5 | | 1.0 | 1.8 | X | ○ |
| Comparative Example 1-38 | C-6 | | 0.2 | 2.2 | ○ | X |
| Embodiment 1-19 | C-7 | | 0.4 | 2.2 | ◎ | ◎ |
| Embodiment 1-20 | C-8 | | 0.6 | 2.2 | ◎ | ◎ |
| Embodiment 1-21 | C-9 | | 0.8 | 2.2 | ◎ | ◎ |
| Comparative Example 1-39 | C-10 | | 1.0 | 2.2 | X | ○ |
| Comparative Example 1-40 | C-11 | | 0.2 | 3.6 | ○ | X |
| Embodiment 1-22 | C-12 | | 0.4 | 3.6 | ◎ | ◎ |
| Embodiment 1-23 | C-13 | | 0.6 | 3.6 | ◎ | ◎ |
| Embodiment 1-24 | C-14 | | 0.8 | 3.6 | ◎ | ◎ |
| Comparative Example 1-41 | C-15 | | 1.0 | 3.6 | X | ○ |
| Comparative Example 1-42 | C-16 | | 0.2 | 5.0 | ○ | X |

TABLE 3-continued

| | Toner | Circularity Degree | PMMA | $SiO_2$ | Smear | Fog |
|---|---|---|---|---|---|---|
| Embodiment 1-25 | C-17 | | 0.4 | 5.0 | ◎ | ◎ |
| Embodiment 1-26 | C-18 | | 0.6 | 5.0 | ◎ | ◎ |
| Embodiment 1-27 | C-19 | | 0.8 | 5.0 | ◎ | ◎ |
| Comparative Example 1-43 | C-20 | | 0.9 | 5.0 | X | ○ |
| Comparative Example 1-44 | C-21 | | 0.2 | 5.4 | ○ | X |
| Embodiment 1-28 | C-22 | | 0.4 | 5.4 | ○ | ○ |
| Embodiment 1-29 | C-23 | | 0.6 | 5.4 | ○ | ○ |
| Embodiment 1-30 | C-24 | | 0.8 | 5.4 | ○ | ○ |
| Comparative Example 1-45 | C-25 | | 0.9 | 5.4 | X | ○ |

[Comparative Example 1-36] With toner C-1, the drum fog (color difference ΔE) reached 4.4 after printing 15,000 sheets. Therefore, the continuous print test was stopped. Although the smear did not occur, when the development device was opened, attachment of a small amount of the external additive was observed on the end of the charge roller. [Embodiment 1-16] to [Embodiment 1-18] With toner C-2, toner C-3 and toner C-4, the drum fog (color difference ΔE) was 3.0 or less, and the continuous print test was conducted up to 50,000 sheets. Although the smear did not occur, when the development device was opened, attachment of a small amount of the external additive was observed on end of the end of the charge roller. [Comparative Example 1-37] With toner C-5, the smear occurred on an edge of the recording medium after printing 6,000 sheets. Therefore, the continuous print test was stopped. In addition, the drum fog (color difference ΔE) reached 2.4 after printing the 6,000 sheets. [Comparative Example 1-38] With toner C-6, the drum fog (color difference ΔE) reached 4.4 after printing 9,000 sheets. Therefore, the continuous print test was stopped. Although the smear did not occur, when the development device was opened, attachment of a small amount of the external additive was observed on the end of the charge roller. [Embodiment 1-19] to [Embodiment 1-21] With toner C-7, toner C-8 and toner C-9, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 1-39] With toner C-10, the smear occurred on an edge of the recording medium after printing 9,000 sheets. Therefore, the continuous print test was stopped. In addition, the drum fog (color difference ΔE) reached 2.4 after printing the 9,000 sheets. [Comparative Example 1-40] With toner C-11, the drum fog (color difference ΔE) reached 4.3 after printing 9,000 sheets. Therefore, the continuous print test was stopped. Although the smear did not occur, when the development device was opened, attachment of a small amount of the external additive was observed on the end of the charge roller. [Embodiment 1-22] to [Embodiment 1-24] With toner C-12, toner C-13 and toner C-14, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 1-41] With toner C-15, the smear occurred on an edge of the recording medium after printing 15,000 sheets. Therefore, the continuous print test was stopped. In addition, the drum fog (color difference ΔE) reached 2.4 after printing the 15,000 sheets. [Comparative Example 1-42] With toner C-16, the drum fog (color difference ΔE) reached 4.7 after printing 9,000 sheets. Therefore, the continuous print test was stopped. Although the smear did not occur, when the development device was opened, attachment of a small amount of the external additive was observed on the end of the charge roller. [Embodiment 1-25] to [Embodiment 1-27] With toner C-17, toner C-18 and toner C-19, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 1-43] With toner C-20, the smear occurred on an edge of the recording medium after printing 6,000 sheets. Therefore, the continuous print test was stopped. In addition, the drum fog (color difference ΔE) reached 2.1 after printing the 6,000 sheets. [Comparative Example 1-44] With toner C-21, the drum fog (color difference ΔE) reached 4.7 after printing 15,000 sheets. Therefore, the continuous print test was stopped. Although the smear did not occur, when the development device was opened, attachment of a small amount of the external additive was observed on the end of the charge roller. [Embodiment 1-28] to [Embodiment 1-30] With toner C-22, toner C-23 and toner C-24, the drum fog (color difference ΔE) was 3.0 or less, and the continuous print test was conducted up to 50,000 sheets. Although the smear did not occur, when the development device was opened, attachment of a small amount of the external additive was observed on end of the end of the charge roller. [Comparative Example 1-45] With toner C-25, the smear occurred on an edge of the recording medium after printing 12,000 sheets. Therefore, the continuous print test was stopped. In addition, the drum fog (color difference ΔE) reached 2.1 after printing the 12,000 sheets.

TABLE 4

| | Toner | Circularity Degree | PMMA | $SiO_2$ | Smear | Fog |
|---|---|---|---|---|---|---|
| Comparative Example 1-46 | D-1 | 0.96 | 0.2 | 1.8 | ○ | X |
| Embodiment 1-31 | D-2 | | 0.4 | 1.8 | ○ | ○ |
| Embodiment 1-32 | D-3 | | 0.6 | 1.8 | ○ | ○ |
| Embodiment 1-33 | D-4 | | 0.8 | 1.8 | ○ | ○ |
| Comparative Example 1-47 | D-5 | | 1.0 | 1.8 | X | ○ |
| Comparative Example 1-48 | D-6 | | 0.2 | 2.2 | ○ | X |
| Embodiment 1-34 | D-7 | | 0.4 | 2.2 | ◎ | ◎ |
| Embodiment 1-35 | D-8 | | 0.6 | 2.2 | ◎ | ◎ |
| Embodiment 1-36 | D-9 | | 0.8 | 2.2 | ◎ | ◎ |
| Comparative Example 1-49 | D-10 | | 1.0 | 2.2 | X | ○ |
| Comparative Example 1-50 | D-11 | | 0.2 | 3.6 | ○ | X |
| Embodiment 1-37 | D-12 | | 0.4 | 3.6 | ◎ | ◎ |
| Embodiment 1-38 | D-13 | | 0.6 | 3.6 | ◎ | ◎ |
| Embodiment 1-39 | D-14 | | 0.8 | 3.6 | ◎ | ◎ |
| Comparative Example 1-51 | D-15 | | 1.0 | 3.6 | X | ○ |
| Comparative Example 1-52 | D-16 | | 0.2 | 5.0 | ○ | X |
| Embodiment 1-40 | D-17 | | 0.4 | 5.0 | ◎ | ◎ |
| Embodiment 1-41 | D-18 | | 0.6 | 5.0 | ◎ | ◎ |
| Embodiment 1-42 | D-19 | | 0.8 | 5.0 | ◎ | ◎ |
| Comparative Example 1-53 | D-20 | | 0.9 | 5.0 | X | ○ |
| Comparative Example 1-54 | D-21 | | 0.2 | 5.4 | ○ | X |
| Embodiment 1-43 | D-22 | | 0.4 | 5.4 | ○ | ○ |
| Embodiment 1-44 | D-23 | | 0.6 | 5.4 | ○ | ○ |
| Embodiment 1-45 | D-24 | | 0.8 | 5.4 | ○ | ○ |
| Comparative Example 1-55 | D-25 | | 0.9 | 5.4 | X | ○ |

[Comparative Example 1-46] With toner D-1, the drum fog (color difference ΔE) reached 3.8 after printing 12,000 sheets. Therefore, the continuous print test was stopped. Although the smear did not occur, when the development device was opened, attachment of a small amount of the external additive was observed on the end of the charge roller. [Embodiment 1-31] to [Embodiment 1-33] With toner D-2, toner D-3 and toner D-4, the drum fog (color difference ΔE) was 3.0 or less, and the continuous print test was conducted up to 50,000 sheets. Although the smear did not occur, when the development device was opened, attachment of a small amount of the external additive was observed on end of the end of the charge roller. [Comparative Example 1-47] With toner D-5, the smear occurred on an edge of the recording medium after printing 15,000 sheets. Therefore, the continuous print test was stopped. In addition, the drum fog (color difference ΔE) reached 2.8 after printing the 15,000 sheets. [Comparative Example 1-48] With toner D-6, the drum fog (color difference ΔE) reached 3.6 after printing 18,000 sheets. Therefore, the continuous print test was stopped. Although the smear did not occur, when the development device was opened, attachment of a small amount of the external additive was observed on the end of the charge roller. [Embodiment 1-34] to [Embodiment 1-36] With toner D-7, toner D-8 and toner D-9, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 1-49] With toner D-10, the smear occurred on an edge of the recording medium after printing 12,000 sheets. Therefore, the continuous print test was stopped. In addition, the drum fog (color difference ΔE) reached 2.6 after printing the 12,000 sheets. [Comparative Example 1-50] With toner D-11, the drum fog (color difference ΔE) reached 4.1 after printing 9,000 sheets. Therefore, the continuous print test was stopped. Although the smear did not occur, when the development device was opened, attachment of a small amount of the external additive was observed on the end of the charge roller. [Embodiment 1-37] to [Embodiment 1-39] With toner D-12, toner D-13 and toner D-14, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 1-51] With toner D-15, the smear occurred on an edge of the recording medium after printing 18,000 sheets. Therefore, the continuous print test was stopped. In addition, the drum fog (color difference ΔE) reached 2.1 after printing the 18,000 sheets. [Comparative Example 1-52] With toner D-16, the drum fog (color difference ΔE) reached 4.4 after printing 18,000 sheets. Therefore, the continuous print test was stopped. Although the smear did not occur, when the development device was opened, attachment of a small amount of the external additive was observed on the end of the charge roller. [Embodiment 1-40] to [Embodiment 1-42] With toner D-17, toner D-18 and toner D-19, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 1-53] With toner D-20, the smear occurred on an edge of the recording medium after printing 12,000 sheets. Therefore, the continuous print test was stopped. In addition, the drum fog (color difference ΔE) reached 1.9 after printing the 12,000 sheets. [Comparative Example 1-54] With toner D-21, the drum fog (color difference ΔE) reached 3.9 after printing 15,000 sheets. Therefore, the continuous print test was stopped. Although the smear did not occur, when the development device was opened, attachment of a small amount of the external additive was observed on the end of the charge roller. [Embodiment 1-43] to [Embodiment 1-45] With toner D-22, toner D-23 and toner D-24, the drum fog (color difference ΔE) was 3.0 or less, and the continuous print test was conducted up to 50,000 sheets. Although the smear did not occur, when the development device was opened, attachment of a small amount of the external additive was observed on end of the end of the charge roller. [Comparative Example 1-55] With toner D-25, the smear occurred on an edge of the recording medium after printing 15,000 sheets. Therefore, the continuous print test was stopped. In addition, the drum fog (color difference ΔE) reached 2.2 after printing the 15,000 sheets.

TABLE 5

| | Toner | Circularity Degree | PMMA | $SiO_2$ | Smear | Fog |
|---|---|---|---|---|---|---|
| Comparative Example 1-56 | E-1 | 0.97 | 0.2 | 1.8 | ○ | X |
| Embodiment 1-46 | E-2 | | 0.4 | 1.8 | ○ | ○ |
| Embodiment 1-47 | E-3 | | 0.6 | 1.8 | ○ | ○ |
| Embodiment 1-48 | E-4 | | 0.8 | 1.8 | ○ | ○ |
| Comparative Example 1-57 | E-5 | | 1.0 | 1.8 | X | ○ |
| Comparative Example 1-58 | E-6 | | 0.2 | 2.2 | ○ | X |
| Embodiment 1-49 | E-7 | | 0.4 | 2.2 | ◎ | ◎ |
| Embodiment 1-50 | E-8 | | 0.6 | 2.2 | ◎ | ◎ |
| Embodiment 1-51 | E-9 | | 0.8 | 2.2 | ◎ | ◎ |
| Comparative Example 1-59 | E-10 | | 1.0 | 2.2 | X | ○ |
| Comparative Example 1-60 | E-11 | | 0.2 | 3.6 | ○ | X |
| Embodiment 1-52 | E-12 | | 0.4 | 3.6 | ◎ | ◎ |
| Embodiment 1-53 | E-13 | | 0.6 | 3.6 | ◎ | ◎ |
| Embodiment 1-54 | E-14 | | 0.8 | 3.6 | ◎ | ◎ |
| Comparative Example 1-61 | E-15 | | 1.0 | 3.6 | X | ○ |
| Comparative Example 1-62 | E-16 | | 0.2 | 5.0 | ○ | X |
| Embodiment 1-55 | E-17 | | 0.4 | 5.0 | ◎ | ◎ |
| Embodiment 1-56 | E-18 | | 0.6 | 5.0 | ◎ | ◎ |
| Embodiment 1-57 | E-19 | | 0.8 | 5.0 | ◎ | ◎ |
| Comparative Example 1-63 | E-20 | | 0.9 | 5.0 | X | ○ |
| Comparative Example 1-64 | E-21 | | 0.2 | 5.4 | ○ | X |
| Embodiment 1-58 | E-22 | | 0.4 | 5.4 | ○ | ○ |
| Embodiment 1-59 | E-23 | | 0.6 | 5.4 | ○ | ○ |
| Embodiment 1-60 | E-24 | | 0.8 | 5.4 | ○ | ○ |
| Comparative Example 1-65 | E-25 | | 0.9 | 5.4 | X | ○ |

[Comparative Example 1-56] With toner E-1, the drum fog (color difference ΔE) reached 3.7 after printing 18,000 sheets. Therefore, the continuous print test was stopped. Although the smear did not occur, when the development device was opened, attachment of a small amount of the external additive was observed on the end of the charge roller. [Embodiment 1-46] to [Embodiment 1-48] With toner E-2, toner E-3 and toner E-4, the drum fog (color difference ΔE) was 3.0 or less, and the continuous print test was conducted up to 50,000 sheets. Although the smear did not occur, when the development device was opened, attachment of a small amount of the external additive was observed on end of the end of the charge roller. [Comparative Example 1-57] With toner E-5, the smear occurred on an edge of the recording medium after printing 12,000 sheets. Therefore, the continuous print test was stopped. In addition, the drum fog (color difference ΔE) reached 2.9 after printing the 12,000 sheets. [Comparative Example 1-58] With toner E-6, the drum fog (color difference ΔE) reached 3.3 after printing 21,000 sheets. Therefore, the continuous print test was stopped. Although the smear did not occur, when the development device was opened, attachment of a small amount of the external additive was observed on the end of the charge roller. [Embodiment 1-49] to [Embodiment 1-51] With toner E-7, toner E-8 and toner E-9, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 1-59] With toner E-10, the smear occurred on an edge of the recording medium after printing 18,000 sheets. Therefore, the continuous print test was stopped. In addition, the drum fog (color difference ΔE) reached 2.6 after printing the 18,000 sheets. [Comparative Example 1-60] With toner E-11, the drum fog (color difference ΔE) reached 3.1 after printing 12,000 sheets. Therefore, the continuous print test was stopped. Although the smear did not occur, when the development device was opened, attachment of a small amount of the external additive was observed on the end of the charge roller. [Embodiment 1-52] to [Embodiment 1-54] With toner E-12, toner E-13 and toner E-14, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 1-61] With toner E-15, the smear occurred on an edge of the recording medium after printing 12,000 sheets. Therefore, the continuous print test was stopped. In addition, the drum fog (color difference ΔE) reached 2.3 after printing the 12,000 sheets. [Comparative Example 1-62] With toner E-16, the drum fog (color difference ΔE) reached 4.1 after printing 15,000 sheets. Therefore, the continuous print test was stopped. Although the smear did not occur, when the development device was opened, attachment of a small amount of the external additive was observed on the end of the charge roller. [Embodiment 1-55] to [Embodiment 1-57] With toner E-17, toner E-18 and toner E-19, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 1-63] With toner E-20, the smear occurred on an edge of the recording medium after printing 9,000 sheets. Therefore, the continuous print test was stopped. In addition, the drum fog (color difference ΔE) reached 1.9 after printing the 9,000 sheets. [Comparative Example 1-64] With toner E-21, the drum fog (color difference ΔE) reached 4.1 after printing 18,000 sheets. Therefore, the continuous print test was stopped. Although the smear did not occur, when the development device was opened, attachment of a small amount of the external additive was observed on the end of the charge roller. [Embodiment 1-58] to [Embodiment 1-60] With toner E-22, toner E-23 and toner E-24, the drum fog (color difference ΔE) was 3.0 or less, and the continuous print test was conducted up to 50,000 sheets. Although the smear did not occur, when the development device was opened, attachment of a small amount of the external additive was observed on end of the end of the charge roller. [Comparative Example 1-65] With toner E-25, the smear occurred on an edge of the recording medium after printing 12,000 sheets. Therefore, the continuous print test was stopped. In addition, the drum fog (color difference ΔE) reached 2.6 after printing the 12,000 sheets.

TABLE 6

| | Toner | Circularity Degree | PMMA | $SiO_2$ | Smear | Fog |
|---|---|---|---|---|---|---|
| Comparative Example 1-66 | F-1 | 0.99 | 0.2 | 1.8 | ○ | X |
| Comparative Example 1-67 | F-2 | | 0.4 | 1.8 | ○ | X |
| Comparative Example 1-68 | F-3 | | 0.6 | 1.8 | X | ○ |
| Comparative Example 1-69 | F-4 | | 0.8 | 1.8 | X | ○ |
| Comparative Example 1-70 | F-5 | | 1.0 | 1.8 | X | ○ |
| Comparative Example 1-71 | F-6 | | 0.2 | 2.2 | ○ | X |
| Comparative Example 1-72 | F-7 | | 0.4 | 2.2 | ○ | X |
| Comparative Example 1-73 | F-8 | | 0.6 | 2.2 | X | ○ |
| Comparative Example 1-74 | F-9 | | 0.8 | 2.2 | X | ○ |
| Comparative Example 1-75 | F-10 | | 1.0 | 2.2 | X | ○ |
| Comparative Example 1-76 | F-11 | | 0.2 | 3.6 | ○ | X |
| Comparative Example 1-77 | F-12 | | 0.4 | 3.6 | ○ | X |
| Comparative Example 1-78 | F-13 | | 0.6 | 3.6 | X | ○ |
| Comparative Example 1-79 | F-14 | | 0.8 | 3.6 | X | ○ |
| Comparative Example 1-80 | F-15 | | 1.0 | 3.6 | X | ○ |
| Comparative Example 1-81 | F-16 | | 0.2 | 5.0 | ○ | X |
| Comparative Example 1-82 | F-17 | | 0.4 | 5.0 | ○ | X |
| Comparative Example 1-83 | F-18 | | 0.6 | 5.0 | X | ○ |
| Comparative Example 1-84 | F-19 | | 0.8 | 5.0 | X | ○ |
| Comparative Example 1-85 | F-20 | | 0.9 | 5.0 | X | ○ |
| Comparative Example 1-86 | F-21 | | 0.2 | 5.4 | ○ | X |
| Comparative Example 1-87 | F-22 | | 0.4 | 5.4 | ○ | X |
| Comparative Example 1-88 | F-23 | | 0.6 | 5.4 | X | ○ |
| Comparative Example 1-89 | F-24 | | 0.8 | 5.4 | X | ○ |
| Comparative Example 1-90 | F-25 | | 0.9 | 5.4 | X | ○ |

[Comparative Example 1-66] The smear did not occur with toner F-1. However, the drum fog (color difference ΔE) reached 3.8 after printing 6,000 sheets. Therefore, the continuous print test was stopped. When the development device was opened, attachment of a small amount of the external additive was observed on the end of the charge roller. [Comparative Example 1-67] The smear did not occur with toner F-2. However, the drum fog (color difference ΔE) reached 4.2 after printing 12,000 sheets. Therefore, the continuous print test was stopped. When the development device was opened, attachment of a small amount of the external additive was observed on the end of the charge roller. [Comparative Example 1-68] With toner F-3, the smear occurred on an edge of the recording medium after printing 9,000 sheets. Therefore, the continuous print test was stopped. In addition, the drum fog (color difference ΔE) reached 2.7 at most. [Comparative Example 1-69] With toner F-4, the smear occurred on an edge of the recording medium after printing 6,000 sheets. Therefore, the continuous print test was stopped. In addition, the drum fog (color difference ΔE) reached 2.1 at most. [Comparative Example 1-70] With toner F-5, the drum fog (color difference ΔE) reached 1.8 at most. The smear occurred at the left end part of the recording medium after printing 5,500 sheets. Therefore, the continuous print test was stopped. [Comparative Example 1-71] With toner F-6, the drum fog (color difference ΔE) reached 4.1 after printing 12,000 sheets. Therefore, the continuous print test was stopped. Although the smear did not occur, when the development device was opened, attachment of a small amount of the external additive was observed on the end of the charge roller. [Comparative Example 1-72] With toner F-7, the drum fog (color difference ΔE) reached 5.1 after printing 9,000 sheets. Therefore, the continuous print test was stopped. Although the smear did not occur, when the development device was opened, attachment of a small amount of the external additive was observed on the end of the charge roller. [Comparative Example 1-73] With toner F-8, the smear occurred on an edge of the recording medium after printing 15,000 sheets. Therefore, the continuous print test was stopped. In addition, the drum fog (color difference ΔE) reached 2.7 at most. [Comparative Example 1-74] With toner F-9, the smear occurred on an edge of the recording medium after printing 15,000 sheets. Therefore, the continuous print test was stopped. In addition, the drum fog (color difference ΔE) reached 2.9 at most. [Comparative Example 1-75] With toner F-10, the smear occurred on an edge of the recording medium after printing 9,000 sheets. Therefore, the continuous print test was stopped. In addition, the drum fog (color difference ΔE) reached 1.8 at most after printing the 12,000 sheets. [Comparative Example 1-76] With toner F-11, the drum fog (color difference ΔE) reached 4.0 after printing 9,000 sheets. Therefore, the continuous print test was stopped. Although the smear did not occur, when the development device was opened, attachment of a small amount of the external additive was observed on the end of the charge roller. [Comparative Example 1-77] With toner F-12, the drum fog (color difference ΔE) reached 3.8 after printing 9,000 sheets. Therefore, the continuous print test was stopped. Although the smear did not occur, when the development device was opened, attachment of a small amount of the external additive was observed on the end of the charge roller. [Comparative Example 1-78] With toner F-13, the smear occurred on an edge of the recording medium after printing 12,000 sheets. Therefore, the continuous print test was stopped. In addition, the drum fog (color difference ΔE) reached 2.5 after printing the 12,000 sheets. [Comparative Example 1-79] With toner F-14, the smear occurred on an edge of the recording medium after printing 9,000 sheets. Therefore, the continuous print test was stopped. In addition, the drum fog (color difference ΔE) reached 2.4 at most. [Comparative Example 1-80] With toner F-15, the smear occurred on an edge of the recording medium after printing 15,000 sheets. Therefore, the continuous print test was stopped. In addition, the drum fog (color difference ΔE) reached 1.8 at most after printing the 12,000 sheets. [Comparative Example 1-81] With toner F-16, the drum fog (color difference ΔE) reached 3.1 after printing 12,000 sheets. Therefore, the continuous print test was stopped. Although the smear did not occur, when the development device was opened, attachment of a small amount of the external additive was observed on the end of the charge roller. [Comparative Example 1-82] With toner F-17, the drum fog (color difference ΔE) reached 4.2 after printing 12,000 sheets. Therefore, the continuous print test was stopped. Although the smear did not occur, when the development device was opened, attachment of a small amount of the external additive was observed on the end of the charge roller. [Comparative Example 1-83]

With toner F-18, the smear occurred on an edge of the recording medium after printing 9,000 sheets. Therefore, the continuous print test was stopped. In addition, the drum fog (color difference ΔE) reached 2.3 at most. [Comparative Example 1-84] With toner F-19, the smear occurred on an edge of the recording medium after printing 12,000 sheets. Therefore, the continuous print test was stopped. In addition, the drum fog (color difference ΔE) reached 2.5 at most. [Comparative Example 1-85] With toner F-20, the smear occurred on an edge of the recording medium after printing 12,000 sheets. Therefore, the continuous print test was stopped. In addition, the drum fog (color difference ΔE) reached 1.6 after printing the 12,000 sheets. [Comparative Example 1-86] With toner F-21, the drum fog (color difference ΔE) reached 3.5 after printing 12,000 sheets. Therefore, the continuous print test was stopped. Although the smear did not occur, when the development device was opened, attachment of a small amount of the external additive was observed on the end of the charge roller. [Comparative Example 1-87] With toner F-22, the drum fog (color difference ΔE) reached 4.8 after printing 15,000 sheets. Therefore, the continuous print test was stopped. Although the smear did not occur, when the development device was opened, attachment of a small amount of the external additive was observed on the end of the charge roller. [Comparative Example 1-88] With toner F-23, the smear occurred on an edge of the recording medium after printing 15,000 sheets. Therefore, the continuous print test was stopped. In addition, the drum fog (color difference ΔE) reached 2.3 at most after printing the 12,000 sheets. [Comparative Example 1-89] With toner F-24, the smear occurred on an edge of the recording medium after printing 15,000 sheets. Therefore, the continuous print test was stopped. In addition, the drum fog (color difference ΔE) reached 1.8 at most after printing the 9,000 sheets. [Comparative Example 1-90] With toner F-25, the smear occurred on an edge of the recording medium after printing 6,000 sheets. Therefore, the continuous print test was stopped. In addition, the drum fog (color difference ΔE) reached 1.9 after printing the 6,000 sheets.

As described above, it was observed that when the circularity degree of pulverized toner is within a range from 0.92 to 0.97 inclusive and when PMMP (polymethyl methacrylate) used as the external additive is within a range from 0.4 parts by weight to 0.8 parts by weight inclusive per 100 parts by weight of the toner mother particles, the smear of the photosensitive drum due to the attachment of the external additive to the charge roller does not occur for printing up to 50,000 sheets with the 20% duty image, and that the drum fog (color difference ΔE) is 3.0 or less.

In addition, it was determined that when the amount of external additives other than PMMP (polymethyl methacrylate) is within a range from 2.2 parts by weight to 5.0 parts by weight inclusive per 100 parts by weight of the toner mother particles, there is no attachment of the external additives to the charge roller for printing up to 50,000 sheets with the 20% duty image, and that the drum fog (color difference ΔE) is 1.5 or less. Next, reinvestigation of the external additive was conducted for toner B and toner E, which did not result in the smear or fog. Toner B and toner E were used for the toner mother particles.

In 100 parts by weight of the toner mother particles B having the circularity degree of 0.92, 0.2 parts by weight of "MP-1000," 1.6 parts by weight of "Aerosil RX50" and 0.2 parts by weight of oxidized titanium ($TiO_2$) (TTO-51(A) manufactured by Ishihara Sangyo Kaisha, Ltd., particle diameter 10 nm) were added and mixed for 25 minutes to obtain toner B-26.

In 100 parts by weight of the toner mother particles B having the circularity degree of 0.92, 0.4 parts by weight of "MP-1000," 1.6 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner B-27. In 100 parts by weight of the toner mother particles B having the circularity degree of 0.92, 0.6 parts by weight of "MP-1000," 1.6 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner B-28.

In 100 parts by weight of the toner mother particles B having the circularity degree of 0.92, 0.8 parts by weight of "MP-1000," 1.6 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner B-29. In 100 parts by weight of the toner mother particles B having the circularity degree of 0.92, 1.0 part by weight of "MP-1000," 1.6 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner B-30.

In 100 parts by weight of the toner mother particles B having the circularity degree of 0.92, 0.2 parts by weight of "MP-1000," 2.0 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner B-31. In 100 parts by weight of the toner mother particles B having the circularity degree of 0.92, 0.2 parts by weight of "MP-1000," 2.0 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner B-32.

In 100 parts by weight of the toner mother particles B having the circularity degree of 0.92, 0.6 parts by weight of "MP-1000," 2.0 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner B-33. In 100 parts by weight of the toner mother particles B having the circularity degree of 0.92, 0.8 parts by weight of "MP-1000," 2.0 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner B-34.

In 100 parts by weight of the toner mother particles B having the circularity degree of 0.92, 1.0 part by weight of "MP-1000," 2.0 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner B-35. In 100 parts by weight of the toner mother particles B having the circularity degree of 0.92, 0.2 parts by weight of "MP-1000," 3.2 parts by weight of "Aerosil RX50" and 0.4 parts by weight of oxidized titanium (TTO-51(A) manufactured by Ishihara Sangyo Kaisha, Ltd., particle diameter 10 nm) were added and mixed for 25 minutes to obtain toner B-36.

In 100 parts by weight of the toner mother particles B having the circularity degree of 0.92, 0.4 parts by weight of "MP-1000," 3.2 parts by weight of "Aerosil RX50" and 0.4 parts by weight of oxidized titanium (TTO-51(A) manufactured by Ishihara Sangyo Kaisha, Ltd., particle diameter 10 nm) were added and mixed for 25 minutes to obtain toner B-37. In 100 parts by weight of the toner mother particles B having the circularity degree of 0.92, 0.6 parts by weight of "MP-1000," 3.2 parts by weight of "Aerosil RX50" and 0.4 parts by weight of oxidized titanium (TTO-51(A) manufactured by Ishihara Sangyo Kaisha, Ltd., particle diameter 10 nm) were added and mixed for 25 minutes to obtain toner B-38.

In 100 parts by weight of the toner mother particles B having the circularity degree of 0.92, 0.8 parts by weight of "MP-1000," 3.2 parts by weight of "Aerosil RX50" and 0.4 parts by weight of oxidized titanium (TTO-51(A) manufactured by Ishihara Sangyo Kaisha, Ltd., particle diameter 10 nm) were added and mixed for 25 minutes to obtain toner B-39. In 100 parts by weight of the toner mother particles B having the circularity degree of 0.92, 1.0 part by weight of "MP-1000," 3.2 parts by weight of "Aerosil RX50" and 0.4 parts by weight of oxidized titanium (TTO-51(A) manufactured by Ishihara Sangyo Kaisha, Ltd., particle diameter 10 nm) were added and mixed for 25 minutes to obtain toner B-40.

In 100 parts by weight of the toner mother particles B having the circularity degree of 0.92, 0.2 parts by weight of "MP-1000," 4.5 parts by weight of "Aerosil RX50" and 0.5 parts by weight of oxidized titanium (TTO-51(A) manufactured by Ishihara Sangyo Kaisha, Ltd., particle diameter 10 nm) were added and mixed for 25 minutes to obtain toner B-41. In 100 parts by weight of the toner mother particles B having the circularity degree of 0.92, 0.4 parts by weight of "MP-1000," 4.5 parts by weight of "Aerosil RX50" and 0.5 parts by weight of oxidized titanium (TTO-51(A) manufactured by Ishihara Sangyo Kaisha, Ltd., particle diameter 10 nm) were added and mixed for 25 minutes to obtain toner B-42.

In 100 parts by weight of the toner mother particles B having the circularity degree of 0.92, 0.6 parts by weight of "MP-1000," 4.5 parts by weight of "Aerosil RX50" and 0.5 parts by weight of oxidized titanium (TTO-51(A) manufactured by Ishihara Sangyo Kaisha, Ltd., particle diameter 10 nm) were added and mixed for 25 minutes to obtain toner B-43. In 100 parts by weight of the toner mother particles B having the circularity degree of 0.92, 0.8 parts by weight of "MP-1000," 4.5 parts by weight of "Aerosil RX50" and 0.5 parts by weight of oxidized titanium (TTO-51(A) manufactured by Ishihara Sangyo Kaisha, Ltd., particle diameter 10 nm) were added and mixed for 25 minutes to obtain toner B-44.

In 100 parts by weight of the toner mother particles B having the circularity degree of 0.92, 1.0 part by weight of "MP-1000," 4.5 parts by weight of "Aerosil RX50" and 0.5 parts by weight of oxidized titanium (TTO-51(A) manufactured by Ishihara Sangyo Kaisha, Ltd., particle diameter 10 nm) were added and mixed for 25 minutes to obtain toner B-45. In 100 parts by weight of the toner mother particles B having the circularity degree of 0.92, 0.2 parts by weight of "MP-1000," 4.8 parts by weight of "Aerosil RX50" and 0.6 parts by weight of oxidized titanium (TTO-51(A) manufactured by Ishihara Sangyo Kaisha, Ltd., particle diameter 10 nm) were added and mixed for 25 minutes to obtain toner B-46.

In 100 parts by weight of the toner mother particles B having the circularity degree of 0.92, 0.4 parts by weight of "MP-1000," 4.8 parts by weight of "Aerosil RX50" and 0.6 parts by weight of oxidized titanium (TTO-51(A) manufactured by Ishihara Sangyo Kaisha, Ltd., particle diameter 10 nm) were added and mixed for 25 minutes to obtain toner B-47. In 100 parts by weight of the toner mother particles B having the circularity degree of 0.92, 0.6 parts by weight of "MP-1000," 4.8 parts by weight of "Aerosil RX50" and 0.6 parts by weight of oxidized titanium (TTO-51(A) manufactured by Ishihara Sangyo Kaisha, Ltd., particle diameter 10 nm) were added and mixed for 25 minutes to obtain toner B-48.

In 100 parts by weight of the toner mother particles B having the circularity degree of 0.92, 0.8 parts by weight of "MP-1000," 4.8 parts by weight of "Aerosil RX50" and 0.6 parts by weight of oxidized titanium (TTO-51(A) manufactured by Ishihara Sangyo Kaisha, Ltd., particle diameter 10 nm) were added and mixed for 25 minutes to obtain toner B-49. In 100 parts by weight of the toner mother particles B having the circularity degree of 0.92, 1.0 part by weight of "MP-1000," 4.8 parts by weight of "Aerosil RX50" and 0.6 parts by weight of oxidized titanium (TTO-51(A) manufactured by Ishihara Sangyo Kaisha, Ltd., particle diameter 10 nm) were added and mixed for 25 minutes to obtain toner B-50.

Moreover, in 100 parts by weight of the toner mother particles E having the circularity degree of 0.97, 0.2 parts by weight of "MP-1000," 1.6 parts by weight of "Aerosil RX50" and 0.2 parts by weight of oxidized titanium ($TiO_2$) (TTO-51 (A) manufactured by Ishihara Sangyo Kaisha, Ltd., particle diameter 10 nm) were added and mixed for 25 minutes to obtain toner E-26. In 100 parts by weight of the toner mother particles E having the circularity degree of 0.97, 0.4 parts by weight of "MP-1000," 1.6 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner E-27.

In 100 parts by weight of the toner mother particles E having the circularity degree of 0.97, 0.6 parts by weight of "MP-1000," 1.6 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner E-28. In 100 parts by weight of the toner mother particles E having the circularity degree of 0.97, 0.8 parts by weight of "MP-1000," 1.6 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner E-29.

In 100 parts by weight of the toner mother particles E having the circularity degree of 0.97, 1.0 part by weight of "MP-1000," 1.6 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner E-30. In 100 parts by weight of the toner mother particles E having the circularity degree of 0.97, 0.2 parts by weight of "MP-1000," 2.0 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner E-31.

In 100 parts by weight of the toner mother particles E having the circularity degree of 0.97, 0.4 parts by weight of "MP-1000," 2.0 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner E-32. In 100 parts by weight of the toner mother particles E having the circularity degree of 0.97, 0.6 parts by weight of "MP-1000," 2.0 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner E-33.

In 100 parts by weight of the toner mother particles E having the circularity degree of 0.97, 0.8 parts by weight of "MP-1000," 2.0 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner E-34. In 100 parts by weight of the toner mother particles E having the circularity degree of 0.97, 1.0 part by weight of "MP-1000," 2.0 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner E-35.

In 100 parts by weight of the toner mother particles E having the circularity degree of 0.97, 0.2 parts by weight of "MP-1000," 3.2 parts by weight of "Aerosil RX50" and 0.4 parts by weight of oxidized titanium (TTO-51(A) manufactured by Ishihara Sangyo Kaisha, Ltd., particle diameter 10 nm) were added and mixed for 25 minutes to obtain toner E-36. In 100 parts by weight of the toner mother particles E having the circularity degree of 0.97, 0.4 parts by weight of "MP-1000," 3.2 parts by weight of "Aerosil RX50" and 0.4 parts by weight of oxidized titanium (TTO-51(A) manufactured by Ishihara Sangyo Kaisha, Ltd., particle diameter 10 nm) were added and mixed for 25 minutes to obtain toner E-37.

In 100 parts by weight of the toner mother particles E having the circularity degree of 0.97, 0.6 parts by weight of "MP-1000," 3.2 parts by weight of "Aerosil RX50" and 0.4 parts by weight of oxidized titanium (TTO-51(A) manufactured by Ishihara Sangyo Kaisha, Ltd., particle diameter 10 nm) were added and mixed for 25 minutes to obtain toner E-38. In 100 parts by weight of the toner mother particles E having the circularity degree of 0.97, 0.8 parts by weight of "MP-1000," 3.2 parts by weight of "Aerosil RX50" and 0.4 parts by weight of oxidized titanium (TTO-51(A) manufactured by Ishihara Sangyo Kaisha, Ltd., particle diameter 10 nm) were added and mixed for 25 minutes to obtain toner E-39.

In 100 parts by weight of the toner mother particles E having the circularity degree of 0.97, 1.0 part by weight of "MP-1000," 3.2 parts by weight of "Aerosil RX50" and 0.4 parts by weight of oxidized titanium (TTO-51(A) manufactured by Ishihara Sangyo Kaisha, Ltd., particle diameter 10 nm) were added and mixed for 25 minutes to obtain toner E-40. In 100 parts by weight of the toner mother particles E having the circularity degree of 0.97, 0.2 parts by weight of "MP-1000," 4.5 parts by weight of "Aerosil RX50" and 0.5 parts by weight of oxidized titanium (TTO-51(A) manufactured by Ishihara Sangyo Kaisha, Ltd., particle diameter 10 nm) were added and mixed for 25 minutes to obtain toner E-41.

In 100 parts by weight of the toner mother particles E having the circularity degree of 0.97, 0.4 parts by weight of "MP-1000," 4.5 parts by weight of "Aerosil RX50" and 0.5 parts by weight of oxidized titanium (TTO-51(A) manufactured by Ishihara Sangyo Kaisha, Ltd., particle diameter 10 nm) were added and mixed for 25 minutes to obtain toner E-42. In 100 parts by weight of the toner mother particles E having the circularity degree of 0.97, 0.6 parts by weight of "MP-1000," 4.5 parts by weight of "Aerosil RX50" and 0.5 parts by weight of oxidized titanium (TTO-51(A) manufactured by Ishihara Sangyo Kaisha, Ltd., particle diameter 10 nm) were added and mixed for 25 minutes to obtain toner E-43.

In 100 parts by weight of the toner mother particles E having the circularity degree of 0.97, 0.8 parts by weight of "MP-1000," 4.5 parts by weight of "Aerosil RX50" and 0.5 parts by weight of oxidized titanium (TTO-51(A) manufactured by Ishihara Sangyo Kaisha, Ltd., particle diameter 10 nm) were added and mixed for 25 minutes to obtain toner E-44. In 100 parts by weight of the toner mother particles E having the circularity degree of 0.97, 1.0 part by weight of "MP-1000," 4.5 parts by weight of "Aerosil RX50" and 0.5 parts by weight of oxidized titanium (TTO-51(A) manufactured by Ishihara Sangyo Kaisha, Ltd., particle diameter 10 nm) were added and mixed for 25 minutes to obtain toner E-45.

In 100 parts by weight of the toner mother particles E having the circularity degree of 0.97, 0.2 parts by weight of "MP-1000," 4.8 parts by weight of "Aerosil RX50" and 0.6 parts by weight of oxidized titanium (TTO-51(A) manufactured by Ishihara Sangyo Kaisha, Ltd., particle diameter 10 nm) were added and mixed for 25 minutes to obtain toner E-46. In 100 parts by weight of the toner mother particles E having the circularity degree of 0.97, 0.4 parts by weight of "MP-1000," 4.8 parts by weight of "Aerosil RX50" and 0.6 parts by weight of oxidized titanium (TTO-51(A) manufactured by Ishihara Sangyo Kaisha, Ltd., particle diameter 10 nm) were added and mixed for 25 minutes to obtain toner E-47.

In 100 parts by weight of the toner mother particles E having the circularity degree of 0.97, 0.6 parts by weight of "MP-1000," 4.8 parts by weight of "Aerosil RX50" and 0.6 parts by weight of oxidized titanium (TTO-51(A) manufactured by Ishihara Sangyo Kaisha, Ltd., particle diameter 10 nm) were added and mixed for 25 minutes to obtain toner E-48. In 100 parts by weight of the toner mother particles E having the circularity degree of 0.97, 0.8 parts by weight of "MP-1000," 4.8 parts by weight of "Aerosil RX50" and 0.6 parts by weight of oxidized titanium (TTO-51(A) manufactured by Ishihara Sangyo Kaisha, Ltd., particle diameter 10 nm) were added and mixed for 25 minutes to obtain toner E-49.

In 100 parts by weight of the toner mother particles E having the circularity degree of 0.97, 1.0 part by weight of "MP-1000," 4.8 parts by weight of "Aerosil RX50" and 0.6 parts by weight of oxidized titanium (TTO-51(A) manufactured by Ishihara Sangyo Kaisha, Ltd., particle diameter 10 nm) were added and mixed for 25 minutes to obtain toner E-50. For the obtained toner B-26 to toner B-50 and toner E-26 to toner E-50, a continuous print test similar to the above-described continuous print test was conducted. Results of the continuous print test are described based on Table 7 and Table 8.

TABLE 7

| | Toner | Circularity Degree | PMMA | $SiO_2$ | $TiO_2$ | Smear | Fog |
|---|---|---|---|---|---|---|---|
| Comparative Example 1-91 | B-26 | 0.92 | 0.2 | 1.6 | 0.2 | ○ | X |
| Embodiment 1-61 | B-27 | | 0.4 | 1.6 | 0.2 | ○ | ○ |
| Embodiment 1-62 | B-28 | | 0.6 | 1.6 | 0.2 | ○ | ○ |

TABLE 7-continued

| | Toner | Circularity Degree | PMMA | $SiO_2$ | $TiO_2$ | Smear | Fog |
|---|---|---|---|---|---|---|---|
| Embodiment 1-63 | B-29 | | 0.8 | 1.6 | 0.2 | ○ | ○ |
| Comparative Example 1-92 | B-30 | | 1.0 | 1.6 | 0.2 | X | ○ |
| Comparative Example 1-93 | B-31 | | 0.2 | 2.0 | 0.2 | ○ | X |
| Embodiment 1-64 | B-32 | | 0.4 | 2.0 | 0.2 | ◎ | ◎ |
| Embodiment 1-65 | B-33 | | 0.6 | 2.0 | 0.2 | ◎ | ◎ |
| Embodiment 1-66 | B-34 | | 0.8 | 2.0 | 0.2 | ◎ | ◎ |
| Comparative Example 1-94 | B-35 | | 1.0 | 2.0 | 0.2 | X | ○ |
| Comparative Example 1-95 | B-36 | | 0.2 | 3.2 | 0.4 | ○ | X |
| Embodiment 1-67 | B-37 | | 0.4 | 3.2 | 0.4 | ◎ | ◎ |
| Embodiment 1-68 | B-38 | | 0.6 | 3.2 | 0.4 | ◎ | ◎ |
| Embodiment 1-69 | B-39 | | 0.8 | 3.2 | 0.4 | ◎ | ◎ |
| Comparative Example 1-96 | B-40 | | 1.0 | 3.2 | 0.4 | X | ○ |
| Comparative Example 1-97 | B-41 | | 0.2 | 4.5 | 0.5 | ○ | X |
| Embodiment 1-70 | B-42 | | 0.4 | 4.5 | 0.5 | ◎ | ◎ |
| Embodiment 1-71 | B-43 | | 0.6 | 4.5 | 0.5 | ◎ | ◎ |
| Embodiment 1-72 | B-44 | | 0.8 | 4.5 | 0.5 | ◎ | ◎ |
| Comparative Example 1-98 | B-45 | | 1.0 | 4.5 | 0.5 | X | ○ |
| Comparative Example 1-99 | B-46 | | 0.2 | 4.8 | 0.6 | ○ | X |
| Embodiment 1-73 | B-47 | | 0.4 | 4.8 | 0.6 | ○ | ○ |
| Embodiment 1-74 | B-48 | | 0.6 | 4.8 | 0.6 | ○ | ○ |
| Embodiment 1-75 | B-49 | | 0.8 | 4.8 | 0.6 | ○ | ○ |
| Comparative Example 1-100 | B-50 | | 1.0 | 4.8 | 0.6 | X | ○ |

[Comparative Example 1-91] With toner B-26, the drum fog (color difference ΔE) reached 3.9 after printing 18,000 sheets. Therefore, the continuous print test was stopped. Although the smear did not occur, when the development device was opened, attachment of a small amount of the external additive was observed on the end of the charge roller. [Embodiment 1-61] to [Embodiment 1-63] With toner B-27, toner B-28 and toner B-29, the continuous print test was conducted up to 50,000 sheets, and the smear did not occur. The drum fog (color difference ΔE) was 3.0 or less. Although the smear did not occur, when the development device was opened, attachment of a small amount of the external additive was observed on the end of the charge roller. [Comparative Example 1-92] With toner B-30, the smear occurred on the recording medium after printing 12,000 sheets. Therefore, the continuous print test was stopped. In addition, the drum fog (color difference ΔE) reached 2.9 at most after printing the 12,000 sheets. [Comparative Example 1-93] With toner B-31, the drum fog (color difference ΔE) reached 3.8 after printing 9,000 sheets. Therefore, the continuous print test was stopped. Although the smear did not occur, when the development device was opened, attachment of the external additive was observed on the end of the charge roller. [Embodiment 1-64] to [Embodiment 1-66] With toner B-32, toner B-33 and toner B-34, the continuous print test was conducted up to 50,000 sheets, and the smear did not occur. The drum fog (color difference ΔE) was 1.5 or less. [Comparative Example 1-94] With toner B-35, the smear occurred on the recording medium after printing 9,000 sheets. Therefore, the continuous print test was stopped. In addition, the drum fog (color difference ΔE) reached 2.8 at most after printing the 9,000 sheets. [Comparative Example 1-95] With toner B-36, the drum fog (color difference ΔE) reached 4.1 after printing 18,000 sheets. Therefore, the continuous print test was stopped. Although the smear did not occur, when the development device was opened, attachment of the external additive was observed on the end of the charge roller. [Embodiment 1-67] to [Embodiment 1-69] With toner B-37, toner B-38 and toner B-39, the continuous print test was conducted up to 50,000 sheets, and the smear did not occur. The drum fog (color difference ΔE) was 1.5 or less. [Comparative Example 1-96] With toner B-40, the smear occurred on the recording medium after printing 24,000 sheets. In addition, the drum fog (color difference ΔE) reached 2.5 at most after printing the 21,000 sheets. [Comparative Example 1-97] With toner B-41, the drum fog (color difference ΔE) reached 3.8 after printing 15,000 sheets. Therefore, the continuous print test was stopped. Although the smear did not occur, when the development device was opened, attachment of the external additive was observed on the end of the charge roller. [Embodiment 1-70] to [Embodiment 1-72] With toner B-42, toner B-43 and toner B-44, the continuous print test was conducted up to 50,000 sheets, and the smear did not occur. The drum fog (color difference ΔE) was 1.5 or less. [Comparative Example 1-98] With toner B-45, the smear occurred on an edge of the recording medium after printing 15,000 sheets. Therefore, the continuous print test was stopped. In addition, the drum fog (color difference ΔE) reached 2.4 at most after printing the 12,000 sheets. [Comparative Example 1-99] With toner B-46, the drum fog (color difference ΔE) reached 3.6 after printing 12,000 sheets. Therefore, the continuous print test was stopped. Although the smear did not occur, when the development device was opened, attachment of the external additive was observed on the end of the charge roller. [Embodiment 1-73] to [Embodiment 1-75] With toner B-47, toner B-48 and toner B-49, the continuous print test was conducted up to 50,000 sheets, and the drum fog (color difference ΔE) was 3.0 or less. Although the smear did not occur, when the development device was opened, attachment of a small amount of the external additive was observed on the end of the charge roller. [Comparative Example 1-100] With toner B-50, the smear occurred on the recording medium after printing 12,000 sheets. Therefore, the continuous print test was stopped. In addition, the drum fog (color difference ΔE) reached 1.8 at most after printing the 9,000 sheets.

TABLE 8

| | Toner | Circularity Degree | PMMA | $SiO_2$ | $TiO_2$ | Smear | Fog |
|---|---|---|---|---|---|---|---|
| Comparative Example 1-101 | E-26 | 0.97 | 0.2 | 1.6 | 0.2 | ○ | X |

TABLE 8-continued

| | Toner | Circularity Degree | PMMA | $SiO_2$ | $TiO_2$ | Smear | Fog |
|---|---|---|---|---|---|---|---|
| Embodiment 1-76 | E-27 | | 0.4 | 1.6 | 0.2 | ○ | ○ |
| Embodiment 1-77 | E-28 | | 0.6 | 1.6 | 0.2 | ○ | ○ |
| Embodiment 1-78 | E-29 | | 0.8 | 1.6 | 0.2 | ○ | ○ |
| Comparative Example 1-102 | E-30 | | 1.0 | 1.6 | 0.2 | X | ○ |
| Comparative Example 1-103 | E-31 | | 0.2 | 2.0 | 0.2 | ○ | X |
| Embodiment 1-79 | E-32 | | 0.4 | 2.0 | 0.2 | ◎ | ◎ |
| Embodiment 1-80 | E-33 | | 0.6 | 2.0 | 0.2 | ◎ | ◎ |
| Embodiment 1-81 | E-34 | | 0.8 | 2.0 | 0.2 | ◎ | ◎ |
| Comparative Example 1-104 | E-35 | | 1.0 | 2.0 | 0.2 | X | ○ |
| Comparative Example 1-105 | E-36 | | 0.2 | 3.2 | 0.4 | ○ | X |
| Embodiment 1-82 | E-37 | | 0.4 | 3.2 | 0.4 | ◎ | ◎ |
| Embodiment 1-83 | E-38 | | 0.6 | 3.2 | 0.4 | ◎ | ◎ |
| Embodiment 1-84 | E-39 | | 0.8 | 3.2 | 0.4 | ◎ | ◎ |
| Comparative Example 1-106 | E-40 | | 1.0 | 3.2 | 0.4 | X | ○ |
| Comparative Example 1-107 | E-41 | | 0.2 | 4.5 | 0.5 | ○ | X |
| Embodiment 1-85 | E-42 | | 0.4 | 4.5 | 0.5 | ◎ | ◎ |
| Embodiment 1-86 | E-43 | | 0.6 | 4.5 | 0.5 | ◎ | ◎ |
| Embodiment 1-87 | E-44 | | 0.8 | 4.5 | 0.5 | ◎ | ◎ |
| Comparative Example 1-108 | E-45 | | 1.0 | 4.5 | 0.5 | X | ○ |
| Comparative Example 1-109 | E-46 | | 0.2 | 4.8 | 0.6 | ○ | X |
| Embodiment 1-88 | E-47 | | 0.4 | 4.8 | 0.6 | ○ | ○ |
| Embodiment 1-89 | E-48 | | 0.6 | 4.8 | 0.6 | ○ | ○ |
| Embodiment 1-90 | E-49 | | 0.8 | 4.8 | 0.6 | ○ | ○ |
| Comparative Example 1-110 | E-50 | | 1.0 | 4.8 | 0.6 | X | ○ |

[Comparative Example 1-101] With toner E-26, the drum fog (color difference ΔE) reached 3.3 after printing 18,000 sheets. Therefore, the continuous print test was stopped. Although the smear did not occur, when the development device was opened, attachment of a small amount of the external additive was observed on the end of the charge roller. [Embodiment 1-76] to [Embodiment 1-78] With toner E-27, toner E-28 and toner E-29, the continuous print test was conducted up to 50,000 sheets, and the drum fog (color difference ΔE) was 3.0 or less. Although the smear did not occur, when the development device was opened, attachment of a small amount of the external additive was observed on the end of the charge roller. [Comparative Example 1-102] With toner E-30, the smear occurred on the recording medium after printing 12,000 sheets. Therefore, the continuous print test was stopped. In addition, the drum fog (color difference ΔE) reached 2.3 at most after printing the 9,000 sheets. [Comparative Example 1-103] With toner E-31, the drum fog (color difference ΔE) reached 4.0 after printing 12,000 sheets. Therefore, the continuous print test was stopped. Although the smear did not occur, when the development device was opened, attachment of the external additive was observed on the end of the charge roller. [Embodiment 1-79] to [Embodiment 1-81] With toner E-32, toner E-33 and toner E-34, the continuous print test was conducted up to 50,000 sheets, and the smear did not occur. The drum fog (color difference ΔE) was 1.5 or less. [Comparative Example 1-104] With toner E-35, the smear occurred on the recording medium after printing 18,000 sheets. Therefore, the continuous print test was stopped. In addition, the drum fog (color difference ΔE) reached 2.9 at most after printing the 18,000 sheets. [Comparative Example 1-105] With toner E-36, the drum fog (color difference ΔE) reached 4.9 after printing 15,000 sheets. Therefore, the continuous print test was stopped. Although the smear did not occur, when the development device was opened, attachment of the external additive was observed on the end of the charge roller. [Embodiment 1-82] to [Embodiment 1-84] With toner E-37, toner E-38 and toner E-39, the continuous print test was conducted up to 50,000 sheets, and the smear did not occur. The drum fog (color difference ΔE) was 1.5 or less. [Comparative Example 1-106] With toner E-40, the smear occurred on the recording medium after printing 15,000 sheets. Therefore, the continuous print test was stopped. In addition, the drum fog (color difference ΔE) reached 2.5 at most after printing the 15,000 sheets. [Comparative Example 1-107] With toner E-41, the drum fog (color difference ΔE) reached 3.9 after printing 12,000 sheets. Therefore, the continuous print test was stopped. Although the smear did not occur, when the development device was opened, a small amount of attachment of the external additive was observed on the end of the charge roller. [Embodiment 1-85] to [Embodiment 1-87] With toner E-42, toner E-43 and toner E-44, the continuous print test was conducted up to 50,000 sheets, and the smear did not occur. The drum fog (color difference ΔE) was 1.5 or less. [Comparative Example 1-108] With toner E-45, the smear occurred on the recording medium after printing 12,000 sheets. Therefore, the continuous print test was stopped. In addition, the drum fog (color difference ΔE) reached 2.3 at most after printing the 12,000 sheets. [Comparative Example 1-109] With toner E-46, the drum fog (color difference ΔE) reached 3.8 after printing 9,000 sheets. Therefore, the continuous print test was stopped. Although the smear did not occur, when the development device was opened, attachment of the external additive was observed on the end of the charge roller. [Embodiment 1-88] to [Embodiment 1-90] With toner E-47, toner E-48 and toner E-49, the continuous print test was conducted up to 50,000 sheets, and the drum fog (color difference ΔE) was 3.0 or less. Although the smear did not occur, when the development device was opened, attachment of a small amount of the external additive was observed on the end of the charge roller. [Comparative Example 1-110] With toner E-50, the smear occurred on the recording medium after printing 9,000 sheets. Therefore, the continuous print test was stopped. In addition, the drum fog (color difference ΔE) reached 2.3 at most after printing the 9,000 sheets.

As described above, Embodiment 1-61 to Embodiment 1-90 indicate that the external additives other than PMMA are not limited to $SiO_2$ (silica).

As explained above, in the first embodiment, there is an effect that, when the circularity degree of the pulverized toner is from 0.92 to 0.97, the smear on the recording medium (attachment of the external additive on the charge roller) and the fog on the photosensitive drum are reduced in the continuous print test using the 20% duty image by including 0.4 to 0.8 parts by weight of PMMA (polymethyl methacrylate) having positive chargeability and an average particle diameter of 0.15 to 2.0 μm in 100 parts by weight of the pulverized toner.

Furthermore, there is an effect that the smear on the recording medium (attachment of the external additive on the charge roller) and the fog on the photosensitive drum are further reduced by including a total amount of 2.5 to 5.0 parts by weight of the external additives other than PMMA in 100 parts by weight of the pulverized toner.

Second Embodiment

The configuration of a development device and an image forming device according to the second embodiment is similar to the configuration of the development device and the image forming device according to the first embodiment. Therefore, by referring to the same symbols, the descriptions are omitted. In addition, the operation of the development device and the image forming device are the same as that in the second embodiment. Therefore, the description of the operation is omitted.

Toner used in the development device according to the second embodiment is explained. The toner used in the present embodiment is formed by adding silica and oxidized titanium fine powder in toner particles formed by mixing and aggregating styrene-acryl copolymer resin produced by an emulsion polymerization method, colorant and wax, and by mixing the compound by a mixer.

The emulsion polymerization method is a method to obtain toner particles by forming initial particles of a copolymer, which is a toner binding resin, in a water solvent, by mixing the colorant that has been emulsified by an emulsifier (surface active agent) in the same water solvent in which the initial particles are formed, by agglomerating the mixture to form the toner particles in the solvent, by by taking the toner particles out from the solvent, and by washing and drying the toner particles to remove unneeded solvent components and by-product components. Carbon black is used as the colorant, and stearyl stearate, which is high quality fatty acid ester wax, is used as the wax.

Toner particles, which have not been attached, having a volume mean particle diameter of 7.0 μm are obtained by the above-described method. The volume mean particle diameter of the obtained toner particles is found by counting 30,000 particles using a cell count and analysis device "Coulter Multisizer 3" (manufactured by Beckman Coulter, Inc.) with an aperture diameter of 100 μm.

In addition, the circularity degree is measured using "flow type particle image analysis device FPIA-2100" manufactured by Simex Corporation based on an equation Circularity degree=L1/L2. Here, L1 is a boundary length of a circle having the same area as an area of the projected image of a particle, and L2 is a boundary length of the projected image of the particle. If the circularity degree is 1.00, it is a true sphere. As the circularity degree becomes less than 1.00, the shape of the particle becomes more irregular. In the present embodiment, toner mother particles α to ζ having circularity degrees of 0.92 to 0.99 by changing the time for polymerization. Moreover, the obtained toner mother particles are negatively chargeable.

In addition, in 100 parts by weight of the toner mother particles α having the circularity degree of 0.92, 0.2 parts by weight of "MP-1000 (polymethyl methacrylate; PMMA)" (manufactured Soken Chemical & Engineering Co., Ltd.) by having positive polarity and 1.8 parts by weight of "Aerosil RX50 (silica ($SiO_2$))" (manufactured by Nippon Aerosil Co., Ltd.) were added and mixed for 25 minutes to obtain toner α-1. In the present embodiment, PMMA which mean particle size is 0.15 μm or more and 2.0 μm or less is used. With the same method as the above-described method, below toner α-2 to toner ζ-25 were obtained.

In 100 parts by weight of the toner mother particles α having the circularity degree of 0.92, 0.4 parts by weight of "MP-1000" and 1.8 parts by weight of "Aerosil RX50" were added and mixed for 25 minutes to obtain toner α-2. In 100 parts by weight of the toner mother particles α having the circularity degree of 0.92, 0.6 parts by weight of "MP-1000" and 1.8 parts by weight of "Aerosil RX50" were added and mixed for 25 minutes to obtain toner α-3.

In 100 parts by weight of the toner mother particles α having the circularity degree of 0.92, 0.8 parts by weight of "MP-1000" and 1.8 parts by weight of "Aerosil RX50" were added and mixed for 25 minutes to obtain toner α-4. In 100 parts by weight of the toner mother particles α having the circularity degree of 0.92, 1.0 part by weight of "MP-1000" and 1.8 parts by weight of "Aerosil RX50" were added and mixed for 25 minutes to obtain toner α-5.

In 100 parts by weight of the toner mother particles α having the circularity degree of 0.92, 0.2 parts by weight of "MP-1000" and 2.2 parts by weight of "Aerosil RX50" were added and mixed for 25 minutes to obtain toner α-6.

In 100 parts by weight of the toner mother particles α having the circularity degree of 0.92, 0.4 parts by weight of "MP-1000" and 2.2 parts by weight of "Aerosil RX50" were added and mixed for 25 minutes to obtain toner α-7. In 100 parts by weight of the toner mother particles α having the circularity degree of 0.92, 0.6 parts by weight of "MP-1000" and 2.2 parts by weight of "Aerosil RX50" were added and mixed for 25 minutes to obtain toner α-8.

In 100 parts by weight of the toner mother particles α having the circularity degree of 0.92, 0.8 parts by weight of "MP-1000" and 2.2 parts by weight of "Aerosil RX50" were added and mixed for 25 minutes to obtain toner α-9. In 100 parts by weight of the toner mother particles α having the circularity degree of 0.92, 1.0 part by weight of "MP-1000" and 2.2 parts by weight of "Aerosil RX50" were added and mixed for 25 minutes to obtain toner α-10.

In 100 parts by weight of the toner mother particles α having the circularity degree of 0.92, 0.2 parts by weight of "MP-1000" and 3.6 parts by weight of "Aerosil RX50" were added and mixed for 25 minutes to obtain toner α-11. In 100 parts by weight of the toner mother particles α having the circularity degree of 0.92, 0.4 parts by weight of "MP-1000" and 3.6 parts by weight of "Aerosil RX50" were added and mixed for 25 minutes to obtain toner α-12.

In 100 parts by weight of the toner mother particles α having the circularity degree of 0.92, 0.6 parts by weight of "MP-1000" and 3.6 parts by weight of "Aerosil RX50" were added and mixed for 25 minutes to obtain toner α-13. In 100 parts by weight of the toner mother particles α having the circularity degree of 0.92, 0.8 parts by weight of "MP-1000" and 3.6 parts by weight of "Aerosil RX50" were added and mixed for 25 minutes to obtain toner α-14.

In 100 parts by weight of the toner mother particles α having the circularity degree of 0.92, 1.0 part by weight of "MP-1000" and 3.6 parts by weight of "Aerosil RX50" were added and mixed for 25 minutes to obtain toner α-15. In 100 parts by weight of the toner mother particles α having the circularity degree of 0.92, 0.2 parts by weight of "MP-1000" and 5.0 parts by weight of "Aerosil RX50" were added and mixed for 25 minutes to obtain toner α-16.

In 100 parts by weight of the toner mother particles α having the circularity degree of 0.92, 0.4 parts by weight of "MP-1000" and 5.0 parts by weight of "Aerosil RX50" were added and mixed for 25 minutes to obtain toner α-17. In 100 parts by weight of the toner mother particles α having the circularity degree of 0.92, 0.6 parts by weight of "MP-1000" and 5.0 parts by weight of "Aerosil RX50" were added and mixed for 25 minutes to obtain toner α-18.

In 100 parts by weight of the toner mother particles α having the circularity degree of 0.92, 0.8 parts by weight of "MP-1000" and 5.0 parts by weight of "Aerosil RX50" were added and mixed for 25 minutes to obtain toner α-19. In 100 parts by weight of the toner mother particles α having the circularity degree of 0.92, 0.9 parts by weight of "MP-1000" and 5.0 parts by weight of "Aerosil RX50" were added and mixed for 25 minutes to obtain toner α-20.

In 100 parts by weight of the toner mother particles α having the circularity degree of 0.92, 0.2 parts by weight of "MP-1000" and 5.4 parts by weight of "Aerosil RX50" were added and mixed for 25 minutes to obtain toner α-21. In 100 parts by weight of the toner mother particles α having the circularity degree of 0.92, 0.4 parts by weight of "MP-1000" and 5.4 parts by weight of "Aerosil RX50" were added and mixed for 25 minutes to obtain toner α-22.

In 100 parts by weight of the toner mother particles α having the circularity degree of 0.92, 0.6 parts by weight of "MP-1000" and 5.4 parts by weight of "Aerosil RX50" were added and mixed for 25 minutes to obtain toner α-23. In 100 parts by weight of the toner mother particles α having the circularity degree of 0.92, 0.8 parts by weight of "MP-1000" and 5.4 parts by weight of "Aerosil RX50" were added and mixed for 25 minutes to obtain toner α-24.

In 100 parts by weight of the toner mother particles α having the circularity degree of 0.92, 0.9 parts by weight of "MP-1000" and 5.4 parts by weight of "Aerosil RX50" were added and mixed for 25 minutes to obtain toner α-25. In 100 parts by weight of the toner mother particles β having the circularity degree of 0.94, 0.2 parts by weight of "MP-1000" and 1.8 parts by weight of "Aerosil RX50" were added and mixed for 25 minutes to obtain toner β-1.

In 100 parts by weight of the toner mother particles β having the circularity degree of 0.94, 0.4 parts by weight of "MP-1000" and 1.8 parts by weight of "Aerosil RX50" were added and mixed for 25 minutes to obtain toner β-2. In 100 parts by weight of the toner mother particles β having the circularity degree of 0.94, 0.6 parts by weight of "MP-1000" and 1.8 parts by weight of "Aerosil RX50" were added and mixed for 25 minutes to obtain toner β-3.

In 100 parts by weight of the toner mother particles β having the circularity degree of 0.94, 0.8 parts by weight of "MP-1000" and 1.8 parts by weight of "Aerosil RX50" were added and mixed for 25 minutes to obtain toner β-4. In 100 parts by weight of the toner mother particles β having the circularity degree of 0.94, 1.0 part by weight of "MP-1000" and 1.8 parts by weight of "Aerosil RX50" were added and mixed for 25 minutes to obtain toner β-5.

In 100 parts by weight of the toner mother particles β having the circularity degree of 0.94, 0.2 parts by weight of "MP-1000" and 2.2 parts by weight of "Aerosil RX50" were added and mixed for 25 minutes to obtain toner β-6. In 100 parts by weight of the toner mother particles β having the circularity degree of 0.94, 0.4 parts by weight of "MP-1000" and 2.2 parts by weight of "Aerosil RX50" were added and mixed for 25 minutes to obtain toner β-7.

In 100 parts by weight of the toner mother particles β having the circularity degree of 0.94, 0.6 parts by weight of "MP-1000" and 2.2 parts by weight of "Aerosil RX50" were added and mixed for 25 minutes to obtain toner β-8. In 100 parts by weight of the toner mother particles β having the circularity degree of 0.94, 0.8 parts by weight of "MP-1000" and 2.2 parts by weight of "Aerosil RX50" were added and mixed for 25 minutes to obtain toner β-9.

In 100 parts by weight of the toner mother particles β having the circularity degree of 0.94, 1.0 part by weight of "MP-1000" and 2.2 parts by weight of "Aerosil RX50" were added and mixed for 25 minutes to obtain toner β-10. In 100 parts by weight of the toner mother particles β having the circularity degree of 0.94, 0.2 parts by weight of "MP-1000" and 3.6 parts by weight of "Aerosil RX50" were added and mixed for 25 minutes to obtain toner β-11.

In 100 parts by weight of the toner mother particles β having the circularity degree of 0.94, 0.4 parts by weight of "MP-1000" and 3.6 parts by weight of "Aerosil RX50" were added and mixed for 25 minutes to obtain toner β-12. In 100 parts by weight of the toner mother particles β having the circularity degree of 0.94, 0.6 parts by weight of "MP-1000" and 3.6 parts by weight of "Aerosil RX50" were added and mixed for 25 minutes to obtain toner β-13.

In 100 parts by weight of the toner mother particles β having the circularity degree of 0.94, 0.8 parts by weight of "MP-1000" and 3.6 parts by weight of "Aerosil RX50" were added and mixed for 25 minutes to obtain toner β-14. In 100 parts by weight of the toner mother particles β having the circularity degree of 0.94, 1.0 part by weight of "MP-1000" and 3.6 parts by weight of "Aerosil RX50" were added and mixed for 25 minutes to obtain toner β-15.

In 100 parts by weight of the toner mother particles β having the circularity degree of 0.94, 0.2 parts by weight of "MP-1000" and 5.0 parts by weight of "Aerosil RX50" were added and mixed for 25 minutes to obtain toner β-16. In 100 parts by weight of the toner mother particles β having the circularity degree of 0.94, 0.4 parts by weight of "MP-1000" and 5.0 parts by weight of "Aerosil RX50" were added and mixed for 25 minutes to obtain toner β-17.

In 100 parts by weight of the toner mother particles β having the circularity degree of 0.94, 0.6 parts by weight of "MP-1000" and 5.0 parts by weight of "Aerosil RX50" were added and mixed for 25 minutes to obtain toner β-18. In 100 parts by weight of the toner mother particles β having the circularity degree of 0.94, 0.8 parts by weight of "MP-1000" and 5.0 parts by weight of "Aerosil RX50" were added and mixed for 25 minutes to obtain toner β-19.

In 100 parts by weight of the toner mother particles β having the circularity degree of 0.94, 0.9 parts by weight of "MP-1000" and 5.0 parts by weight of "Aerosil RX50" were added and mixed for 25 minutes to obtain toner β-20. In 100 parts by weight of the toner mother particles β having the circularity degree of 0.94, 0.2 parts by weight of "MP-1000" and 5.4 parts by weight of "Aerosil RX50" were added and mixed for 25 minutes to obtain toner β-21.

In 100 parts by weight of the toner mother particles β having the circularity degree of 0.94, 0.4 parts by weight of "MP-1000" and 5.4 parts by weight of "Aerosil RX50" were added and mixed for 25 minutes to obtain toner β-22. In 100 parts by weight of the toner mother particles β having the circularity degree of 0.94, 0.6 parts by weight of "MP-1000" and 5.4 parts by weight of "Aerosil RX50" were added and mixed for 25 minutes to obtain toner β-23.

In 100 parts by weight of the toner mother particles β having the circularity degree of 0.94, 0.8 parts by weight of "MP-1000" and 5.4 parts by weight of "Aerosil RX50" were added and mixed for 25 minutes to obtain toner β-24. In 100 parts by weight of the toner mother particles β having the circularity degree of 0.94, 0.9 parts by weight of "MP-1000"

and 5.4 parts by weight of "Aerosil RX50" were added and mixed for 25 minutes to obtain toner β-25.

In 100 parts by weight of the toner mother particles γ having the circularity degree of 0.96, 0.2 part by weight of "MP-1000" and 1.8 parts by weight of "Aerosil RX50" were added and mixed for 25 minutes to obtain toner γ-1. In 100 parts by weight of the toner mother particles γ having the circularity degree of 0.96, 0.4 parts by weight of "MP-1000" and 1.8 parts by weight of "Aerosil RX50" were added and mixed for 25 minutes to obtain toner γ-2.

In 100 parts by weight of the toner mother particles γ having the circularity degree of 0.96, 0.6 parts by weight of "MP-1000" and 1.8 parts by weight of "Aerosil RX50" were added and mixed for 25 minutes to obtain toner γ-3. In 100 parts by weight of the toner mother particles γ having the circularity degree of 0.96, 0.8 parts by weight of "MP-1000" and 1.8 parts by weight of "Aerosil RX50" were added and mixed for 25 minutes to obtain toner γ-4.

In 100 parts by weight of the toner mother particles γ having the circularity degree of 0.96, 1.0 part by weight of "MP-1000" and 1.8 parts by weight of "Aerosil RX50" were added and mixed for 25 minutes to obtain toner γ-5. In 100 parts by weight of the toner mother particles γ having the circularity degree of 0.96, 0.2 parts by weight of "MP-1000" and 2.2 parts by weight of "Aerosil RX50" were added and mixed for 25 minutes to obtain toner γ-6.

In 100 parts by weight of the toner mother particles γ having the circularity degree of 0.96, 0.4 parts by weight of "MP-1000" and 2.2 parts by weight of "Aerosil RX50" were added and mixed for 25 minutes to obtain toner γ-7. In 100 parts by weight of the toner mother particles γ having the circularity degree of 0.96, 0.6 parts by weight of "MP-1000" and 2.2 parts by weight of "Aerosil RX50" were added and mixed for 25 minutes to obtain toner γ-8.

In 100 parts by weight of the toner mother particles γ having the circularity degree of 0.96, 0.8 parts by weight of "MP-1000" and 2.2 parts by weight of "Aerosil RX50" were added and mixed for 25 minutes to obtain toner γ-9. In 100 parts by weight of the toner mother particles γ having the circularity degree of 0.96, 1.0 part by weight of "MP-1000" and 2.2 parts by weight of "Aerosil RX50" were added and mixed for 25 minutes to obtain toner γ-10.

In 100 parts by weight of the toner mother particles γ having the circularity degree of 0.96, 0.2 parts by weight of "MP-1000" and 3.6 parts by weight of "Aerosil RX50" were added and mixed for 25 minutes to obtain toner γ-11. In 100 parts by weight of the toner mother particles γ having the circularity degree of 0.96, 0.4 parts by weight of "MP-1000" and 3.6 parts by weight of "Aerosil RX50" were added and mixed for 25 minutes to obtain toner γ-12.

In 100 parts by weight of the toner mother particles γ having the circularity degree of 0.96, 0.6 parts by weight of "MP-1000" and 3.6 parts by weight of "Aerosil RX50" were added and mixed for 25 minutes to obtain toner γ-13. In 100 parts by weight of the toner mother particles γ having the circularity degree of 0.96, 0.8 parts by weight of "MP-1000" and 3.6 parts by weight of "Aerosil RX50" were added and mixed for 25 minutes to obtain toner γ-14.

In 100 parts by weight of the toner mother particles γ having the circularity degree of 0.96, 1.0 part by weight of "MP-1000" and 3.6 parts by weight of "Aerosil RX50" were added and mixed for 25 minutes to obtain toner γ-15. In 100 parts by weight of the toner mother particles γ having the circularity degree of 0.96, 0.2 parts by weight of "MP-1000" and 5.0 parts by weight of "Aerosil RX50" were added and mixed for 25 minutes to obtain toner γ-16.

In 100 parts by weight of the toner mother particles γ having the circularity degree of 0.96, 0.4 parts by weight of "MP-1000" and 5.0 parts by weight of "Aerosil RX50" were added and mixed for 25 minutes to obtain toner γ-17. In 100 parts by weight of the toner mother particles γ having the circularity degree of 0.96, 0.6 parts by weight of "MP-1000" and 5.0 parts by weight of "Aerosil RX50" were added and mixed for 25 minutes to obtain toner γ-18.

In 100 parts by weight of the toner mother particles γ having the circularity degree of 0.96, 0.8 parts by weight of "MP-1000" and 5.0 parts by weight of "Aerosil RX50" were added and mixed for 25 minutes to obtain toner γ-19. In 100 parts by weight of the toner mother particles γ having the circularity degree of 0.96, 0.9 parts by weight of "MP-1000" and 5.0 parts by weight of "Aerosil RX50" were added and mixed for 25 minutes to obtain toner γ-20.

In 100 parts by weight of the toner mother particles γ having the circularity degree of 0.96, 0.2 parts by weight of "MP-1000" and 5.4 parts by weight of "Aerosil RX50" were added and mixed for 25 minutes to obtain toner γ-21. In 100 parts by weight of the toner mother particles γ having the circularity degree of 0.96, 0.4 parts by weight of "MP-1000" and 5.4 parts by weight of "Aerosil RX50" were added and mixed for 25 minutes to obtain toner γ-22.

In 100 parts by weight of the toner mother particles γ having the circularity degree of 0.96, 0.6 parts by weight of "MP-1000" and 5.4 parts by weight of "Aerosil RX50" were added and mixed for 25 minutes to obtain toner γ-23. In 100 parts by weight of the toner mother particles γ having the circularity degree of 0.96, 0.8 parts by weight of "MP-1000" and 5.4 parts by weight of "Aerosil RX50" were added and mixed for 25 minutes to obtain toner γ-24.

In 100 parts by weight of the toner mother particles γ having the circularity degree of 0.96, 0.9 parts by weight of "MP-1000" and 5.4 parts by weight of "Aerosil RX50" were added and mixed for 25 minutes to obtain toner γ-25. In 100 parts by weight of the toner mother particles δ having the circularity degree of 0.97, 0.2 parts by weight of "MP-1000" and 1.8 parts by weight of "Aerosil RX50" were added and mixed for 25 minutes to obtain toner δ-1.

In 100 parts by weight of the toner mother particles δ having the circularity degree of 0.97, 0.4 parts by weight of "MP-1000" and 1.8 parts by weight of "Aerosil RX50" were added and mixed for 25 minutes to obtain toner δ-2. In 100 parts by weight of the toner mother particles δ having the circularity degree of 0.97, 0.6 parts by weight of "MP-1000" and 1.8 parts by weight of "Aerosil RX50" were added and mixed for 25 minutes to obtain toner δ-3.

In 100 parts by weight of the toner mother particles δ having the circularity degree of 0.97, 0.8 parts by weight of "MP-1000" and 1.8 parts by weight of "Aerosil RX50" were added and mixed for 25 minutes to obtain toner δ-4. In 100 parts by weight of the toner mother particles δ having the circularity degree of 0.97, 1.0 part by weight of "MP-1000" and 1.8 parts by weight of "Aerosil RX50" were added and mixed for 25 minutes to obtain toner δ-5.

In 100 parts by weight of the toner mother particles δ having the circularity degree of 0.97, 0.2 parts by weight of "MP-1000" and 2.2 parts by weight of "Aerosil RX50" were added and mixed for 25 minutes to obtain toner δ-6. In 100 parts by weight of the toner mother particles δ having the circularity degree of 0.97, 0.4 parts by weight of "MP-1000" and 2.2 parts by weight of "Aerosil RX50" were added and mixed for 25 minutes to obtain toner δ-7.

In 100 parts by weight of the toner mother particles δ having the circularity degree of 0.97, 0.6 parts by weight of "MP-1000" and 2.2 parts by weight of "Aerosil RX50" were added and mixed for 25 minutes to obtain toner δ-8. In 100 parts by weight of the toner mother particles δ having the circularity degree of 0.97, 0.8 parts by weight of "MP-1000" and 2.2 parts by weight of "Aerosil RX50" were added and mixed for 25 minutes to obtain toner δ-9.

In 100 parts by weight of the toner mother particles δ having the circularity degree of 0.97, 1.0 part by weight of "MP-1000" and 2.2 parts by weight of "Aerosil RX50" were added and mixed for 25 minutes to obtain toner δ-10. In 100 parts by weight of the toner mother particles δ having the circularity degree of 0.97, 0.2 parts by weight of "MP-1000" and 3.6 parts by weight of "Aerosil RX50" were added and mixed for 25 minutes to obtain toner δ-11.

In 100 parts by weight of the toner mother particles δ having the circularity degree of 0.97, 0.4 parts by weight of "MP-1000" and 3.6 parts by weight of "Aerosil RX50" were added and mixed for 25 minutes to obtain toner δ-12. In 100 parts by weight of the toner mother particles δ having the circularity degree of 0.97, 0.6 parts by weight of "MP-1000" and 3.6 parts by weight of "Aerosil RX50" were added and mixed for 25 minutes to obtain toner δ-13.

In 100 parts by weight of the toner mother particles δ having the circularity degree of 0.97, 0.8 parts by weight of "MP-1000" and 3.6 parts by weight of "Aerosil RX50" were added and mixed for 25 minutes to obtain toner δ-14. In 100 parts by weight of the toner mother particles δ having the circularity degree of 0.97, 1.0 part by weight of "MP-1000" and 3.6 parts by weight of "Aerosil RX50" were added and mixed for 25 minutes to obtain toner δ-15.

In 100 parts by weight of the toner mother particles δ having the circularity degree of 0.97, 0.2 parts by weight of "MP-1000" and 5.0 parts by weight of "Aerosil RX50" were added and mixed for 25 minutes to obtain toner δ-16. In 100 parts by weight of the toner mother particles δ having the circularity degree of 0.97, 0.4 parts by weight of "MP-1000" and 5.0 parts by weight of "Aerosil RX50" were added and mixed for 25 minutes to obtain toner δ-17.

In 100 parts by weight of the toner mother particles δ having the circularity degree of 0.97, 0.6 parts by weight of "MP-1000" and 5.0 parts by weight of "Aerosil RX50" were added and mixed for 25 minutes to obtain toner δ-18. In 100 parts by weight of the toner mother particles δ having the circularity degree of 0.97, 0.8 parts by weight of "MP-1000" and 5.0 parts by weight of "Aerosil RX50" were added and mixed for 25 minutes to obtain toner δ-19.

In 100 parts by weight of the toner mother particles δ having the circularity degree of 0.97, 0.9 parts by weight of "MP-1000" and 5.0 parts by weight of "Aerosil RX50" were added and mixed for 25 minutes to obtain toner δ-20. In 100 parts by weight of the toner mother particles δ having the circularity degree of 0.97, 0.2 parts by weight of "MP-1000" and 5.4 parts by weight of "Aerosil RX50" were added and mixed for 25 minutes to obtain toner δ-21.

In 100 parts by weight of the toner mother particles δ having the circularity degree of 0.97, 0.4 parts by weight of "MP-1000" and 5.4 parts by weight of "Aerosil RX50" were added and mixed for 25 minutes to obtain toner δ-22. In 100 parts by weight of the toner mother particles δ having the circularity degree of 0.97, 0.6 parts by weight of "MP-1000" and 5.4 parts by weight of "Aerosil RX50" were added and mixed for 25 minutes to obtain toner δ-23.

In 100 parts by weight of the toner mother particles δ having the circularity degree of 0.97, 0.8 parts by weight of "MP-1000" and 5.4 parts by weight of "Aerosil RX50" were added and mixed for 25 minutes to obtain toner δ-24. In 100 parts by weight of the toner mother particles δ having the circularity degree of 0.97, 0.9 parts by weight of "MP-1000" and 5.4 parts by weight of "Aerosil RX50" were added and mixed for 25 minutes to obtain toner δ-25.

In 100 parts by weight of the toner mother particles ϵ having the circularity degree of 0.98, 0.2 parts by weight of "MP-1000" and 1.8 parts by weight of "Aerosil RX50" were added and mixed for 25 minutes to obtain toner ϵ-1. In 100 parts by weight of the toner mother particles ϵ having the circularity degree of 0.98, 0.4 parts by weight of "MP-1000" and 1.8 parts by weight of "Aerosil RX50" were added and mixed for 25 minutes to obtain toner ϵ-2.

In 100 parts by weight of the toner mother particles ϵ having the circularity degree of 0.98, 0.6 parts by weight of "MP-1000" and 1.8 parts by weight of "Aerosil RX50" were added and mixed for 25 minutes to obtain toner ϵ-3. In 100 parts by weight of the toner mother particles ϵ having the circularity degree of 0.98, 0.8 parts by weight of "MP-1000" and 1.8 parts by weight of "Aerosil RX50" were added and mixed for 25 minutes to obtain toner ϵ-4.

In 100 parts by weight of the toner mother particles ϵ having the circularity degree of 0.98, 1.0 part by weight of "MP-1000" and 1.8 parts by weight of "Aerosil RX50" were added and mixed for 25 minutes to obtain toner ϵ-5. In 100 parts by weight of the toner mother particles ϵ having the circularity degree of 0.98, 0.2 parts by weight of "MP-1000" and 2.2 parts by weight of "Aerosil RX50" were added and mixed for 25 minutes to obtain toner ϵ-6.

In 100 parts by weight of the toner mother particles ϵ having the circularity degree of 0.98, 0.4 parts by weight of "MP-1000" and 2.2 parts by weight of "Aerosil RX50" were added and mixed for 25 minutes to obtain toner ϵ-7. In 100 parts by weight of the toner mother particles ϵ having the circularity degree of 0.98, 0.6 parts by weight of "MP-1000" and 2.2 parts by weight of "Aerosil RX50" were added and mixed for 25 minutes to obtain toner ϵ-8.

In 100 parts by weight of the toner mother particles ϵ having the circularity degree of 0.98, 0.8 parts by weight of "MP-1000" and 2.2 parts by weight of "Aerosil RX50" were added and mixed for 25 minutes to obtain toner ϵ-9. In 100 parts by weight of the toner mother particles ϵ having the circularity degree of 0.98, 1.0 part by weight of "MP-1000" and 2.2 parts by weight of "Aerosil RX50" were added and mixed for 25 minutes to obtain toner ϵ-10.

In 100 parts by weight of the toner mother particles ϵ having the circularity degree of 0.98, 0.2 parts by weight of "MP-1000" and 3.6 parts by weight of "Aerosil RX50" were added and mixed for 25 minutes to obtain toner ϵ-11. In 100 parts by weight of the toner mother particles ϵ having the circularity degree of 0.98, 0.4 parts by weight of "MP-1000" and 3.6 parts by weight of "Aerosil RX50" were added and mixed for 25 minutes to obtain toner ϵ-12.

In 100 parts by weight of the toner mother particles ϵ having the circularity degree of 0.98, 0.6 parts by weight of "MP-1000" and 3.6 parts by weight of "Aerosil RX50" were added and mixed for 25 minutes to obtain toner ϵ-13. In 100 parts by weight of the toner mother particles ϵ having the circularity degree of 0.98, 0.8 parts by weight of "MP-1000" and 3.6 parts by weight of "Aerosil RX50" were added and mixed for 25 minutes to obtain toner ϵ-14.

In 100 parts by weight of the toner mother particles ϵ having the circularity degree of 0.98, 1.0 part by weight of "MP-1000" and 3.6 parts by weight of "Aerosil RX50" were added and mixed for 25 minutes to obtain toner ϵ-15. In 100 parts by weight of the toner mother particles ϵ having the circularity degree of 0.98, 0.2 parts by weight of "MP-1000" and 5.0 parts by weight of "Aerosil RX50" were added and mixed for 25 minutes to obtain toner ϵ-16.

In 100 parts by weight of the toner mother particles ϵ having the circularity degree of 0.98, 0.4 parts by weight of "MP-1000" and 5.0 parts by weight of "Aerosil RX50" were added and mixed for 25 minutes to obtain toner ϵ-17. In 100 parts by weight of the toner mother particles ϵ having the circularity degree of 0.98, 0.6 parts by weight of "MP-1000" and 5.0 parts by weight of "Aerosil RX50" were added and mixed for 25 minutes to obtain toner ϵ-18.

In 100 parts by weight of the toner mother particles ϵ having the circularity degree of 0.98, 0.8 parts by weight of "MP-1000" and 5.0 parts by weight of "Aerosil RX50" were added and mixed for 25 minutes to obtain toner ϵ-19. In 100 parts by weight of the toner mother particles ϵ having the circularity degree of 0.98, 0.9 parts by weight of "MP-1000" and 5.0 parts by weight of "Aerosil RX50" were added and mixed for 25 minutes to obtain toner ϵ-20.

In 100 parts by weight of the toner mother particles ϵ having the circularity degree of 0.98, 0.2 parts by weight of "MP-1000" and 5.4 parts by weight of "Aerosil RX50" were added and mixed for 25 minutes to obtain toner ϵ-21. In 100 parts by weight of the toner mother particles ϵ having the circularity degree of 0.98, 0.4 parts by weight of "MP-1000" and 5.4 parts by weight of "Aerosil RX50" were added and mixed for 25 minutes to obtain toner ϵ-22.

In 100 parts by weight of the toner mother particles ϵ having the circularity degree of 0.98, 0.6 parts by weight of "MP-1000" and 5.4 parts by weight of "Aerosil RX50" were added and mixed for 25 minutes to obtain toner ϵ-23. In 100 parts by weight of the toner mother particles ϵ having the circularity degree of 0.98, 0.8 parts by weight of "MP-1000" and 5.4 parts by weight of "Aerosil RX50" were added and mixed for 25 minutes to obtain toner ϵ-24.

In 100 parts by weight of the toner mother particles ϵ having the circularity degree of 0.98, 0.9 parts by weight of "MP-1000" and 5.4 parts by weight of "Aerosil RX50" were added and mixed for 25 minutes to obtain toner ϵ-25. In 100 parts by weight of the toner mother particles ζ having the circularity degree of 0.99, 0.2 parts by weight of "MP-1000" and 1.8 parts by weight of "Aerosil RX50" were added and mixed for 25 minutes to obtain toner ζ-1.

In 100 parts by weight of the toner mother particles ζ having the circularity degree of 0.99, 0.4 parts by weight of "MP-1000" and 1.8 parts by weight of "Aerosil RX50" were added and mixed for 25 minutes to obtain toner ζ-2. In 100 parts by weight of the toner mother particles ζ having the circularity degree of 0.99, 0.6 parts by weight of "MP-1000" and 1.8 parts by weight of "Aerosil RX50" were added and mixed for 25 minutes to obtain toner ζ-3.

In 100 parts by weight of the toner mother particles ζ having the circularity degree of 0.99, 0.8 parts by weight of "MP-1000" and 1.8 parts by weight of "Aerosil RX50" were added and mixed for 25 minutes to obtain toner ζ-4. In 100 parts by weight of the toner mother particles ζ having the circularity degree of 0.99, 1.0 part by weight of "MP-1000" and 1.8 parts by weight of "Aerosil RX50" were added and mixed for 25 minutes to obtain toner ζ-5.

In 100 parts by weight of the toner mother particles ζ having the circularity degree of 0.99, 0.2 parts by weight of "MP-1000" and 2.2 parts by weight of "Aerosil RX50" were added and mixed for 25 minutes to obtain toner ζ-6. In 100 parts by weight of the toner mother particles ζ having the circularity degree of 0.99, 0.4 parts by weight of "MP-1000" and 2.2 parts by weight of "Aerosil RX50" were added and mixed for 25 minutes to obtain toner ζ-7.

In 100 parts by weight of the toner mother particles ζ having the circularity degree of 0.99, 0.6 parts by weight of "MP-1000" and 2.2 parts by weight of "Aerosil RX50" were added and mixed for 25 minutes to obtain toner ζ-8. In 100 parts by weight of the toner mother particles ζ having the circularity degree of 0.99, 0.8 parts by weight of "MP-1000" and 2.2 parts by weight of "Aerosil RX50" were added and mixed for 25 minutes to obtain toner ζ-9.

In 100 parts by weight of the toner mother particles ζ having the circularity degree of 0.99, 1.0 part by weight of "MP-1000" and 2.2 parts by weight of "Aerosil RX50" were added and mixed for 25 minutes to obtain toner ζ-10. In 100 parts by weight of the toner mother particles ζ having the circularity degree of 0.99, 0.2 parts by weight of "MP-1000" and 3.6 parts by weight of "Aerosil RX50" were added and mixed for 25 minutes to obtain toner ζ-11.

In 100 parts by weight of the toner mother particles ζ having the circularity degree of 0.99, 0.4 parts by weight of "MP-1000" and 3.6 parts by weight of "Aerosil RX50" were added and mixed for 25 minutes to obtain toner ζ-12. In 100 parts by weight of the toner mother particles ζ having the circularity degree of 0.99, 0.6 parts by weight of "MP-1000" and 3.6 parts by weight of "Aerosil RX50" were added and mixed for 25 minutes to obtain toner ζ-13.

In 100 parts by weight of the toner mother particles ζ having the circularity degree of 0.99, 0.8 parts by weight of "MP-1000" and 3.6 parts by weight of "Aerosil RX50" were added and mixed for 25 minutes to obtain toner ζ-14. In 100 parts by weight of the toner mother particles ζ having the circularity degree of 0.99, 1.0 part by weight of "MP-1000" and 3.6 parts by weight of "Aerosil RX50" were added and mixed for 25 minutes to obtain toner ζ-15.

In 100 parts by weight of the toner mother particles ζ having the circularity degree of 0.99, 0.2 parts by weight of "MP-1000" and 5.0 parts by weight of "Aerosil RX50" were added and mixed for 25 minutes to obtain toner ζ-16. In 100 parts by weight of the toner mother particles ζ having the circularity degree of 0.99, 0.4 parts by weight of "MP-1000" and 5.0 parts by weight of "Aerosil RX50" were added and mixed for 25 minutes to obtain toner ζ-17.

In 100 parts by weight of the toner mother particles ζ having the circularity degree of 0.99, 0.6 parts by weight of "MP-1000" and 5.0 parts by weight of "Aerosil RX50" were added and mixed for 25 minutes to obtain toner ζ-18. In 100 parts by weight of the toner mother particles ζ having the circularity degree of 0.99, 0.8 parts by weight of "MP-1000" and 5.0 parts by weight of "Aerosil RX50" were added and mixed for 25 minutes to obtain toner ζ-19.

In 100 parts by weight of the toner mother particles ζ having the circularity degree of 0.99, 0.9 parts by weight of "MP-1000" and 5.0 parts by weight of "Aerosil RX50" were added and mixed for 25 minutes to obtain toner ζ-20. In 100 parts by weight of the toner mother particles ζ having the circularity degree of 0.99, 0.2 parts by weight of "MP-1000" and 5.4 parts by weight of "Aerosil RX50" were added and mixed for 25 minutes to obtain toner ζ-21.

In 100 parts by weight of the toner mother particles ζ having the circularity degree of 0.99, 0.4 parts by weight of "MP-1000" and 5.4 parts by weight of "Aerosil RX50" were added and mixed for 25 minutes to obtain toner ζ-22. In 100 parts by weight of the toner mother particles ζ having the circularity degree of 0.99, 0.6 parts by weight of "MP-1000" and 5.4 parts by weight of "Aerosil RX50" were added and mixed for 25 minutes to obtain toner ζ-23.

In 100 parts by weight of the toner mother particles ζ having the circularity degree of 0.99, 0.8 parts by weight of "MP-1000" and 5.4 parts by weight of "Aerosil RX50" were added and mixed for 25 minutes to obtain toner ζ-24. In 100 parts by weight of the toner mother particles ζ having the circularity degree of 0.99, 0.9 parts by weight of "MP-1000"

and 5.4 parts by weight of "Aerosil RX50" were added and mixed for 25 minutes to obtain toner ζ-25.

A continuous print test similar to that in the first embodiment was conducted by using toner α-1 to toner ζ-25 obtained in the development device 16 shown in FIG. 1. Results of the continuous print test are described based on Table 9 to Table 14.

TABLE 9

| | Toner | Circularity Degree | PMMA | $SiO_2$ | Smear | Fog |
|---|---|---|---|---|---|---|
| Comparative Example 2-1 | α-1 | 0.92 | 0.2 | 1.8 | ○ | X |
| Comparative Example 2-2 | α-2 | | 0.4 | 1.8 | ○ | X |
| Comparative Example 2-3 | α-3 | | 0.6 | 1.8 | ○ | X |
| Comparative Example 2-4 | α-4 | | 0.8 | 1.8 | X | ○ |
| Comparative Example 2-5 | α-5 | | 1.0 | 1.8 | X | ○ |
| Comparative Example 2-6 | α-6 | | 0.2 | 2.2 | ○ | X |
| Comparative Example 2-7 | α-7 | | 0.4 | 2.2 | ○ | X |
| Comparative Example 2-8 | α-8 | | 0.6 | 2.2 | ○ | X |
| Comparative Example 2-9 | α-9 | | 0.8 | 2.2 | X | ○ |
| Comparative Example 2-10 | α-10 | | 1.0 | 2.2 | X | ○ |
| Comparative Example 2-11 | α-11 | | 0.2 | 3.6 | ○ | X |
| Comparative Example 2-12 | α-12 | | 0.4 | 3.6 | ○ | X |
| Comparative Example 2-13 | α-13 | | 0.6 | 3.6 | ○ | X |
| Comparative Example 2-14 | α-14 | | 0.8 | 3.6 | X | ○ |
| Comparative Example 2-15 | α-15 | | 1.0 | 3.6 | X | ○ |
| Comparative Example 2-16 | α-16 | | 0.2 | 5.0 | ○ | X |
| Comparative Example 2-17 | α-17 | | 0.4 | 5.0 | ○ | X |
| Comparative Example 2-18 | α-18 | | 0.6 | 5.0 | ○ | X |
| Comparative Example 2-19 | α-19 | | 0.8 | 5.0 | X | ○ |
| Comparative Example 2-20 | α-20 | | 0.9 | 5.0 | X | ○ |
| Comparative Example 2-21 | α-21 | | 0.2 | 5.4 | ○ | X |
| Comparative Example 2-22 | α-22 | | 0.4 | 5.4 | ○ | X |
| Comparative Example 2-23 | α-23 | | 0.6 | 5.4 | X | ○ |
| Comparative Example 2-24 | α-24 | | 0.8 | 5.4 | X | ○ |
| Comparative Example 2-25 | α-25 | | 0.9 | 5.4 | X | ○ |

[Comparative Example 2-1] The smear did not occur with toner α-1. However, the drum fog (color difference ΔE) reached 4.5 after printing 9,000 sheets. Therefore, the continuous print test was stopped. In addition, when the development device was opened, attachment of a small amount of the external additive was observed on the end of the charge roller. [Comparative Example 2-2] The smear did not occur with toner α-2. However, the drum fog (color difference αE) reached 4.1 after printing 6,000 sheets. Therefore, the continuous print test was stopped. In addition, when the development device was opened, attachment of a small amount of the external additive was observed on the end of the charge roller. [Comparative Example 2-3] The smear did not occur with toner α-3. However, the drum fog (color difference ΔE) reached 3.5 after printing 9,000 sheets. Therefore, the continuous print test was stopped. In addition, when the development device was opened, attachment of a small amount of the external additive was observed on the end of the charge roller. [Comparative Example 2-4] With toner F4, the smear occurred on the recording medium after printing 9,000 sheets. The drum fog (color difference ΔE) reached 3.0 or less. [Comparative Example 2-5] With toner α-5, the drum fog (color difference ΔE) reached 1.7 at most. The smear occurred at the left end part of the recording medium after printing 7,500 sheets. Therefore, the continuous print test was stopped. [Comparative Example 2-6] With toner α-6, the drum fog (color difference ΔE) reached 4.9 after printing 18,000 sheets. Therefore, the continuous print test was stopped. Although the smear did not occur, when the development device was opened, attachment of a small amount of the external additive was observed on the end of the charge roller. [Comparative Example 2-7] With toner α-7, the drum fog (color difference ζE) reached 5.1 after printing 15,000 sheets. Therefore, the continuous print test was stopped. Although the smear did not occur, when the development device was opened, attachment of a small amount of the external additive was observed on the end of the charge roller. [Comparative Example 2-8] With toner α-8, the drum fog (color difference ΔE) reached 4.7 after printing 15,000 sheets. Therefore, the continuous print test was stopped. Although the smear did not occur, when the development device was opened, attachment of a small amount of the external additive was observed on the end of the charge roller. [Comparative Example 2-9] With toner α-9, the smear occurred on the recording medium after printing 15,000 sheets. The drum fog (color difference ΔE) reached 3.0 or less. [Comparative Example 2-10] With toner α-10, the smear occurred on the recording medium after printing 12,000 sheets. Therefore, the continuous print test was stopped. In addition, the drum fog (color difference ΔE) reached 1.7 at most after printing the 9,000 sheets. [Comparative Example 2-11] With toner α-11, the drum fog (color difference ΔE) reached 4.2 after printing 9,000 sheets. Therefore, the continuous print test was stopped. Although the smear did not occur, when the development device was opened, attachment of a small amount of the external additive was observed on the end of the charge roller. [Comparative Example 2-12] With toner α-12, the drum fog (color difference ΔE) reached 4.1 after printing 9,000 sheets. Therefore, the continuous print test was stopped. Although the smear did not occur, when the development device was opened, attachment of a small amount of the external additive was observed on the end of the charge roller. [Comparative Example 2-13] With toner α-13, the drum fog (color difference ΔE) reached 5.2 after printing 6,000 sheets. Therefore, the continuous print test was stopped. Although the smear did not occur, when the development device was opened, attachment of a small amount of the external additive was observed on the end of the charge roller. [Comparative Example 2-14] With toner α-14, the smear occurred on the recording medium after printing 12,000 sheets. Therefore, the continuous print test was stopped. The drum fog (color difference ΔE) reached 2.2 at most. [Comparative Example 2-15] With toner α-15, the smear occurred on an edge of the recording medium after printing 18,000 sheets. Therefore, the continuous print test was stopped. In addition, the drum fog (color difference ΔE) reached 1.8 at most after printing the 15,000 sheets. [Comparative Example 2-16] With toner α-16, the drum fog (color difference ΔE) reached 3.6 after printing 21,000 sheets.

Therefore, the continuous print test was stopped. Although the smear did not occur, when the development device was opened, attachment of a small amount of the external additive was observed on the end of the charge roller. [Comparative Example 2-17] With toner α-17, the drum fog (color difference ΔE) reached 4.2 after printing 9,000 sheets. Therefore, the continuous print test was stopped. Although the smear did not occur, when the development device was opened, attachment of a small amount of the external additive was observed on the end of the charge roller. [Comparative Example 2-18] With toner α-18, the drum fog (color difference ΔE) reached 3.5 after printing 12,000 sheets. Therefore, the continuous print test was stopped. Although the smear did not occur, when the development device was opened, attachment of a small amount of the external additive was observed on the end of the charge roller. [Comparative Example 2-19] With toner α-19, the smear occurred on the recording medium after printing 12,000 sheets. Therefore, the continuous print test was stopped. In addition, the drum fog (color difference ΔE) reached 2.1 at most after printing the 9,000 sheets. [Comparative Example 2-20] With toner α-20, the smear occurred on an edge of the recording medium after printing 15,000 sheets. Therefore, the continuous print test was stopped. In addition, the drum fog (color difference ΔE) reached 1.5 after printing the 12,000 sheets. [Comparative Example 2-21] With toner α-21, the drum fog (color difference ΔE) reached 3.9 after printing 12,000 sheets. Therefore, the continuous print test was stopped. Although the smear did not occur, when the development device was opened, attachment of a small amount of the external additive was observed on the end of the charge roller. [Comparative Example 2-22] With toner α-22, the drum fog (color difference ΔE) reached 4.8 after printing 12,000 sheets. Therefore, the continuous print test was stopped. Although the smear did not occur, when the development device was opened, attachment of a small amount of the external additive was observed on the end of the charge roller. [Comparative Example 2-23] With toner α-23, the smear occurred on the recording medium after printing 15,000 sheets. Therefore, the continuous print test was stopped. In addition, the drum fog (color difference ΔE) reached 2.5 at most. [Comparative Example 2-24] With toner α-24, the smear occurred on an edge of the recording medium after printing 12,000 sheets. Therefore, the continuous print test was stopped. In addition, the drum fog (color difference ΔE) reached 2.1 at most after printing the 9,000 sheets. [Comparative Example 2-25] With toner α-25, the smear occurred on an edge of the recording medium after printing 12,000 sheets. Therefore, the continuous print test was stopped. In addition, the drum fog (color difference ΔE) reached 1.6 after printing the 9,000 sheets.

TABLE 10

| | Toner | Circularity Degree | PMMA | $SiO_2$ | Smear | Fog |
|---|---|---|---|---|---|---|
| Comparative Example 2-26 | β-1 | 0.92 | 0.2 | 1.8 | ○ | X |
| Embodiment 2-1 | β-2 | | 0.4 | 1.8 | ○ | ○ |
| Embodiment 2-2 | β-3 | | 0.6 | 1.8 | ○ | ○ |
| Embodiment 2-3 | β-4 | | 0.8 | 1.8 | ○ | ○ |
| Comparative Example 2-27 | β-5 | | 1.0 | 1.8 | X | ○ |
| Comparative Example 2-28 | β-6 | | 0.2 | 2.2 | ○ | X |
| Embodiment 2-4 | β-7 | | 0.4 | 2.2 | ◎ | ◎ |
| Embodiment 2-5 | β-8 | | 0.6 | 2.2 | ◎ | ◎ |
| Embodiment 2-6 | β-9 | | 0.8 | 2.2 | ◎ | ◎ |

TABLE 10-continued

| | Toner | Circularity Degree | PMMA | $SiO_2$ | Smear | Fog |
|---|---|---|---|---|---|---|
| Comparative Example 2-29 | β-10 | | 1.0 | 2.2 | X | ○ |
| Comparative Example 2-30 | β-11 | | 0.2 | 3.6 | ○ | X |
| Embodiment 2-7 | β-12 | | 0.4 | 3.6 | ◎ | ◎ |
| Embodiment 2-8 | β-13 | | 0.6 | 3.6 | ◎ | ◎ |
| Embodiment 2-9 | β-14 | | 0.8 | 3.6 | ◎ | ◎ |
| Comparative Example 2-31 | β-15 | | 1.0 | 3.6 | X | ○ |
| Comparative Example 2-32 | β-16 | | 0.2 | 5.0 | ○ | X |
| Embodiment 2-10 | β-17 | | 0.4 | 5.0 | ◎ | ◎ |
| Embodiment 2-11 | β-18 | | 0.6 | 5.0 | ◎ | ◎ |
| Embodiment 2-12 | β-19 | | 0.8 | 5.0 | ◎ | ◎ |
| Comparative Example 2-33 | β-20 | | 0.9 | 5.0 | X | ○ |
| Comparative Example 2-34 | β-21 | | 0.2 | 5.4 | ○ | X |
| Embodiment 2-13 | β-22 | | 0.4 | 5.4 | ○ | ○ |
| Embodiment 2-14 | β-23 | | 0.6 | 5.4 | ○ | ○ |
| Embodiment 2-15 | β-24 | | 0.8 | 5.4 | ○ | ○ |
| Comparative Example 2-35 | β-25 | | 0.9 | 5.4 | X | ○ |

[Comparative Example 2-26] With toner β-1, the drum fog (color difference ΔE) reached 3.9 after printing 18,000 sheets. Therefore, the continuous print test was stopped. Although the smear did not occur, when the development device was opened, attachment of a small amount of the external additive was observed on the end of the charge roller. [Embodiment 2-1] to [Embodiment 2-3] With toner β-2, toner β-3 and toner β-4, the drum fog (color difference ΔE) was 3.0 or less, and the continuous print test was conducted up to 50,000 sheets. Although the smear did not occur, when the development device was opened, attachment of a small amount of the external additive was observed on the end of the charge roller. [Comparative Example 2-27] With toner β-5, the smear occurred on an edge of the recording medium after printing 12,000 sheets. Therefore, the continuous print test was stopped. In addition, the drum fog (color difference ΔE) reached 2.1 at most after printing the 12,000 sheets. [Comparative Example 2-28] With toner β-6, the drum fog (color difference ΔE) reached 4.3 after printing 18,000 sheets. Therefore, the continuous print test was stopped. Although the smear did not occur, when the development device was opened, attachment of a small amount of the external additive was observed on the end of the charge roller. [Embodiment 2-4] to [Embodiment 2-6] With toner β-7, toner β-8 and toner β-9, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 2-29] With toner β-10, the smear occurred on an edge of the recording medium after printing 15,000 sheets. Therefore, the continuous print test was stopped. In addition, the drum fog (color difference ΔE) reached 2.1 after printing the 9,000 sheets. [Comparative Example 2-30] With toner β-11, the drum fog (color difference ΔE) reached 4.5 after printing 12,000 sheets. Therefore, the continuous print test was stopped. Although the smear did not occur, when the development device was opened, attachment of a small amount of the external additive was observed on the end of the charge roller. [Embodiment 2-7] to [Embodiment 2-9] With toner β-12, toner β-13 and toner β-14, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 2-31] With toner β-15, the smear occurred on an edge of the recording medium after printing 15,000 sheets. Therefore, the continuous print test was stopped. In addition, the drum fog (color difference ΔE) reached 2.4 at most after printing the 9,000 sheets. [Comparative Example 2-32] With toner β-16, the drum fog (color difference ΔE) reached 4.9 after printing 12,000 sheets. Therefore, the continuous print test was stopped. Although the smear did not occur, when the development device was opened, attachment of a small amount of the external additive was observed on the end of the charge roller. [Embodiment 2-10] to [Embodiment 2-12] With toner β-17, toner β-18 and toner β-19, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 2-33] With toner β-20, the smear occurred on an edge of the recording medium after printing 9,000 sheets. Therefore, the continuous print test was stopped. In addition, the drum fog (color difference ΔE) reached 2.4 after printing the 9,000 sheets. [Comparative Example 2-34] With toner β-21, the drum fog (color difference ΔE) reached 3.9 after printing 15,000 sheets. Therefore, the continuous print test was stopped. Although the smear did not occur, when the development device was opened, attachment of a small amount of the external additive was observed on the end of the charge roller. [Embodiment 2-13] to [Embodiment 2-15] With toner β-22, toner β-23 and toner β-24, the drum fog (color difference ΔE) was 3.0 or less, and the continuous print test was conducted up to 50,000 sheets. Although the smear did not occur, when the development device was opened, attachment of a small amount of the external additive was observed on the end of the charge roller. [Comparative Example 2-35] With toner β-25, the smear occurred on an edge of the recording medium after printing 9,000 sheets. Therefore, the continuous print test was stopped. In addition, the drum fog (color difference ΔE) reached 2.7 after printing the 6,000 sheets.

TABLE 11

| | Toner | Circularity Degree | PMMA | $SiO_2$ | Smear | Fog |
|---|---|---|---|---|---|---|
| Comparative Example 2-36 | γ-1 | 0.96 | 0.2 | 1.8 | ○ | X |
| Embodiment 2-16 | γ-2 | | 0.4 | 1.8 | ○ | ○ |
| Embodiment 2-17 | γ-3 | | 0.6 | 1.8 | ○ | ○ |
| Embodiment 2-18 | γ-4 | | 0.8 | 1.8 | ○ | ○ |
| Comparative Example 2-37 | γ-5 | | 1.0 | 1.8 | X | ○ |
| Comparative Example 2-38 | γ-6 | | 0.2 | 2.2 | ○ | X |
| Embodiment 2-19 | γ-7 | | 0.4 | 2.2 | ◎ | ◎ |
| Embodiment 2-20 | γ-8 | | 0.6 | 2.2 | ◎ | ◎ |
| Embodiment 2-21 | γ-9 | | 0.8 | 2.2 | ◎ | ◎ |
| Comparative Example 2-39 | γ-10 | | 1.0 | 2.2 | X | ○ |
| Comparative Example 2-40 | γ-11 | | 0.2 | 3.6 | ○ | X |
| Embodiment 2-22 | γ-12 | | 0.4 | 3.6 | ◎ | ◎ |
| Embodiment 2-23 | γ-13 | | 0.6 | 3.6 | ◎ | ◎ |
| Embodiment 2-24 | γ-14 | | 0.8 | 3.6 | ◎ | ◎ |
| Comparative Example 2-41 | γ-15 | | 1.0 | 3.6 | X | ○ |
| Comparative Example 2-42 | γ-16 | | 0.2 | 5.0 | ○ | X |

TABLE 11-continued

| | Toner | Circularity Degree | PMMA | $SiO_2$ | Smear | Fog |
|---|---|---|---|---|---|---|
| Embodiment 2-25 | γ-17 | | 0.4 | 5.0 | ◎ | ◎ |
| Embodiment 2-26 | γ-18 | | 0.6 | 5.0 | ◎ | ◎ |
| Embodiment 2-27 | γ-19 | | 0.8 | 5.0 | ◎ | ◎ |
| Comparative Example 2-43 | γ-20 | | 0.9 | 5.0 | X | ○ |
| Comparative Example 2-44 | γ-21 | | 0.2 | 5.4 | ○ | X |
| Embodiment 2-28 | γ-22 | | 0.4 | 5.4 | ○ | ○ |
| Embodiment 2-29 | γ-23 | | 0.6 | 5.4 | ○ | ○ |
| Embodiment 2-30 | γ-24 | | 0.8 | 5.4 | ○ | ○ |
| Comparative Example 2-45 | γ-25 | | 0.9 | 5.4 | X | ○ |

[Comparative Example 2-36] With toner γ-1, the drum fog (color difference ΔE) reached 4.1 after printing 12,000 sheets. Therefore, the continuous print test was stopped. Although the smear did not occur, when the development device was opened, attachment of a small amount of the external additive was observed on the end of the charge roller. [Embodiment 2-16] to [Embodiment 2-18] With toner γ-2, toner γ-3 and toner γ-4, the drum fog (color difference ΔE) was 3.0 or less, and the continuous print test was conducted up to 50,000 sheets. Although the smear did not occur, when the development device was opened, attachment of a small amount of the external additive was observed on end of the end of the charge roller. [Comparative Example 2-37] With toner γ-5, the smear occurred on an edge of the recording medium after printing 9,000 sheets. Therefore, the continuous print test was stopped. In addition, the drum fog (color difference ΔE) reached 2.4 at most after printing the 6,000 sheets. [Comparative Example 2-38] With toner γ-6, the drum fog (color difference ΔE) reached 4.7 after printing 12,000 sheets. Therefore, the continuous print test was stopped. Although the smear did not occur, when the development device was opened, attachment of a small amount of the external additive was observed on the end of the charge roller. [Embodiment 2-19] to [Embodiment 2-21] With toner γ-7, toner γ-8 and toner γ-9, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 2-39] With toner γ-10, the smear occurred on an edge of the recording medium after printing 12,000 sheets. Therefore, the continuous print test was stopped. In addition, the drum fog (color difference ΔE) reached 2.1 at most after printing the 9,000 sheets. [Comparative Example 2-40] With toner γ-11, the drum fog (color difference ΔE) reached 4.3 after printing 9,000 sheets. Therefore, the continuous print test was stopped. Although the smear did not occur, when the development device was opened, attachment of a small amount of the external additive was observed on the end of the charge roller. [Embodiment 2-22] to [Embodiment 2-24] With toner γ-12, toner γ-13 and toner γ-14, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 2-41] With toner γ-15, the smear occurred on an edge of the recording medium after printing 12,000 sheets. Therefore, the continuous print test was stopped. In addition, the drum fog (color difference ΔE) reached 2.7 after printing the 12,000 sheets. [Comparative Example 2-42] With toner γ-16, the drum fog (color difference ΔE) reached 4.2 after printing 12,000 sheets. Therefore, the continuous print test was stopped. Although the smear did not occur, when the development device was opened, attachment of a small amount of the external additive was observed on the end of the charge roller. [Embodiment 2-25] to [Embodiment 2-27] With toner γ-17, toner γ-18 and toner γ-19, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 2-43] With toner γ-20, the smear occurred on an edge of the recording medium after printing 9,000 sheets. Therefore, the continuous print test was stopped. In addition, the drum fog (color difference ΔE) reached 2.1 at most after printing the 6,000 sheets. [Comparative Example 2-44] With toner γ-21, the drum fog (color difference ΔE) reached 4.1 after printing 18,000 sheets. Therefore, the continuous print test was stopped. Although the smear did not occur, when the development device was opened, attachment of a small amount of the external additive was observed on the end of the charge roller. [Embodiment 2-28] to [Embodiment 2-30] With toner γ-22, toner γ-23 and toner γ-24, the drum fog (color difference ΔE) was 3.0 or less, and the continuous print test was conducted up to 50,000 sheets. Although the smear did not occur, when the development device was opened, attachment of a small amount of the external additive was observed on the end of the charge roller. [Comparative Example 2-45] With toner γ-25, the smear occurred on an edge of the recording medium after printing 15,000 sheets. Therefore, the continuous print test was stopped. In addition, the drum fog (color difference ΔE) reached 2.1 at most after printing the 12,000 sheets.

TABLE 12

| | Toner | Circularity Degree | PMMA | $SiO_2$ | Smear | Fog |
|---|---|---|---|---|---|---|
| Comparative Example 2-46 | δ-1 | 0.97 | 0.2 | 1.8 | ○ | X |
| Embodiment 2-31 | δ-2 | | 0.4 | 1.8 | ○ | ○ |
| Embodiment 2-32 | δ-3 | | 0.6 | 1.8 | ○ | ○ |
| Embodiment 2-33 | δ-4 | | 0.8 | 1.8 | ○ | ○ |
| Comparative Example 2-47 | δ-5 | | 1.0 | 1.8 | X | ○ |
| Comparative Example 2-48 | δ-6 | | 0.2 | 2.2 | ○ | X |
| Embodiment 2-34 | δ-7 | | 0.4 | 2.2 | ◎ | ◎ |
| Embodiment 2-35 | δ-8 | | 0.6 | 2.2 | ◎ | ◎ |
| Embodiment 2-36 | δ-9 | | 0.8 | 2.2 | ◎ | ◎ |
| Comparative Example 2-49 | δ-10 | | 1.0 | 2.2 | X | ○ |
| Comparative Example 2-50 | δ-11 | | 0.2 | 3.6 | ○ | X |
| Embodiment 2-37 | δ-12 | | 0.4 | 3.6 | ◎ | ◎ |
| Embodiment 2-38 | δ-13 | | 0.6 | 3.6 | ◎ | ◎ |
| Embodiment 2-39 | δ-14 | | 0.8 | 3.6 | ◎ | ◎ |
| Comparative Example 2-51 | δ-15 | | 1.0 | 3.6 | X | ○ |
| Comparative Example 2-52 | δ-16 | | 0.2 | 5.0 | ○ | X |
| Embodiment 2-40 | δ-17 | | 0.4 | 5.0 | ◎ | ◎ |
| Embodiment 2-41 | δ-18 | | 0.6 | 5.0 | ◎ | ◎ |
| Embodiment 2-42 | δ-19 | | 0.8 | 5.0 | ◎ | ◎ |
| Comparative Example 2-53 | δ-20 | | 0.9 | 5.0 | X | ○ |
| Comparative Example 2-54 | δ-21 | | 0.2 | 5.4 | ○ | X |
| Embodiment 2-43 | δ-22 | | 0.4 | 5.4 | ○ | ○ |
| Embodiment 2-44 | δ-23 | | 0.6 | 5.4 | ○ | ○ |
| Embodiment 2-45 | δ-24 | | 0.8 | 5.4 | ○ | ○ |
| Comparative Example 2-55 | δ-25 | | 0.9 | 5.4 | X | ○ |

[Comparative Example 2-46] With toner δ-1, the drum fog (color difference ΔE) reached 3.7 after printing 9,000 sheets. Therefore, the continuous print test was stopped. Although the smear did not occur, when the development device was opened, attachment of a small amount of the external additive was observed on the end of the charge roller. [Embodiment 2-31] to [Embodiment 2-33] With toner δ-2, toner δ-3 and toner δ-4, the drum fog (color difference ΔE) was 3.0 or less, and the continuous print test was conducted up to 50,000 sheets. Although the smear did not occur, when the development device was opened, attachment of a small amount of the external additive was observed on end of the end of the charge roller. [Comparative Example 2-47] With toner δ-5, the smear occurred on an edge of the recording medium after printing 12,000 sheets. Therefore, the continuous print test was stopped. In addition, the drum fog (color difference ΔE) reached 2.8 at most after printing the 12,000 sheets. [Comparative Example 2-48] With toner δ-6, the drum fog (color difference ΔE) reached 3.8 after printing 15,000 sheets. Therefore, the continuous print test was stopped. Although the smear did not occur, when the development device was opened, attachment of a small amount of the external additive was observed on the end of the charge roller. [Embodiment 2-34] to [Embodiment 2-36] With toner δ-7, toner δ-8 and toner δ-9, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 2-49] With toner δ-10, the smear occurred on an edge of the recording medium after printing 18,000 sheets. Therefore, the continuous print test was stopped. In addition, the drum fog (color difference ΔE) reached 2.9 at most after printing the 12,000 sheets. [Comparative Example 2-50] With toner δ-11, the drum fog (color difference ΔE) reached 4.1 after printing 12,000 sheets. Therefore, the continuous print test was stopped. Although the smear did not occur, when the development device was opened, attachment of a small amount of the external additive was observed on the end of the charge roller. [Embodiment 2-37] to [Embodiment 2-39] With toner δ-12, toner δ-13 and toner δ-14, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 2-51] With toner δ-15, the smear occurred on an edge of the recording medium after printing 12,000 sheets. Therefore, the continuous print test was stopped. In addition, the drum fog (color difference ΔE) reached 2.1 at most after printing the 12,000 sheets. [Comparative Example 2-52] With toner δ-16, the drum fog (color difference ΔE) reached 4.1 after printing 12,000 sheets. Therefore, the continuous print test was stopped. Although the smear did not occur, when the development device was opened, attachment of a small amount of the external additive was observed on the end of the charge roller. [Embodiment 2-40] to [Embodiment 2-42] With toner δ-17, toner δ-18 and toner δ-19, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 2-53] With toner δ-20, the smear occurred on an edge of the recording medium after printing 18,000 sheets. Therefore, the continuous print test was stopped. In addition, the drum fog (color difference ΔE) reached 1.7 at most after printing the 12,000 sheets. [Comparative Example 2-54] With toner δ-21, the drum fog (color difference ΔE) reached 3.7 after printing 18,000 sheets. Therefore, the continuous print test was stopped. Although the smear did not occur, when the development device was opened, attachment of a small amount of the external additive was observed on the end of the charge roller. [Embodiment 2-43] to [Embodiment 2-45] With toner δ-22, toner δ-23 and toner δ-24, the drum fog (color difference ΔE) was 3.0 or less, and the continuous print test was conducted up to 50,000 sheets. Although the smear did not occur, when the development device was opened, attachment of a small amount of the external additive was observed on end of the end of the charge roller. [Comparative Example 2-55] With toner δ-25, the smear occurred on an edge of the recording medium after printing 18,000 sheets. Therefore, the continuous print test was stopped. In addition, the drum fog (color difference ΔE) reached 2.1 at most after printing the 15,000 sheets.

TABLE 13

| | Toner | Circularity Degree | PMMA | $SiO_2$ | Smear | Fog |
|---|---|---|---|---|---|---|
| Comparative Example 2-56 | ϵ-1 | 0.98 | 0.2 | 1.8 | ○ | X |
| Embodiment 2-46 | ϵ-2 | | 0.4 | 1.8 | ○ | ○ |
| Embodiment 2-47 | ϵ-3 | | 0.6 | 1.8 | ○ | ○ |
| Embodiment 2-48 | ϵ-4 | | 0.8 | 1.8 | ○ | ○ |
| Comparative Example 2-57 | ϵ-5 | | 1.0 | 1.8 | X | ○ |
| Comparative Example 2-58 | ϵ-6 | | 0.2 | 2.2 | ○ | X |
| Embodiment 2-49 | ϵ-7 | | 0.4 | 2.2 | ◎ | ◎ |
| Embodiment 2-50 | ϵ-8 | | 0.6 | 2.2 | ◎ | ◎ |
| Embodiment 2-51 | ϵ-9 | | 0.8 | 2.2 | ◎ | ◎ |
| Comparative Example 2-59 | ϵ-10 | | 1.0 | 2.2 | X | ○ |
| Comparative Example 2-60 | ϵ-11 | | 0.2 | 3.6 | ○ | X |
| Embodiment 2-52 | ϵ-12 | | 0.4 | 3.6 | ◎ | ◎ |
| Embodiment 2-53 | ϵ-13 | | 0.6 | 3.6 | ◎ | ◎ |
| Embodiment 2-54 | ϵ-14 | | 0.8 | 3.6 | ◎ | ◎ |
| Comparative Example 2-61 | ϵ-15 | | 1.0 | 3.6 | X | ○ |
| Comparative Example 2-62 | ϵ-16 | | 0.2 | 5.0 | ○ | X |
| Embodiment 2-55 | ϵ-17 | | 0.4 | 5.0 | ◎ | ◎ |
| Embodiment 2-56 | ϵ-18 | | 0.6 | 5.0 | ◎ | ◎ |
| Embodiment 2-57 | ϵ-19 | | 0.8 | 5.0 | ◎ | ◎ |
| Comparative Example 2-63 | ϵ-20 | | 0.9 | 5.0 | X | ○ |
| Comparative Example 2-64 | ϵ-21 | | 0.2 | 5.4 | ○ | X |
| Embodiment 2-58 | ϵ-22 | | 0.4 | 5.4 | ○ | ○ |
| Embodiment 2-59 | ϵ-23 | | 0.6 | 5.4 | ○ | ○ |
| Embodiment 2-60 | ϵ-24 | | 0.8 | 5.4 | ○ | ○ |
| Comparative Example 2-65 | ϵ-25 | | 0.9 | 5.4 | X | ○ |

[Comparative Example 2-56] With toner ϵ-1, the drum fog (color difference ΔE) reached 3.6 after printing 15,000 sheets. Therefore, the continuous print test was stopped. Although the smear did not occur, when the development device was opened, attachment of a small amount of the external additive was observed on the end of the charge roller. [Embodiment 2-46] to [Embodiment 2-48] With toner ϵ-2, toner ϵ-3 and toner ϵ-4, the drum fog (color difference ΔE) was 3.0 or less, and the continuous print test was conducted up to 50,000 sheets. Although the smear did not occur, when the development device was opened, attachment of a small amount of the external additive was observed on end of the end of the charge roller. [Comparative Example 2-57] With toner ϵ-5, the smear occurred on an edge of the recording medium after printing 15,000 sheets. Therefore, the continuous print test was stopped. In addition, the drum fog (color difference ΔE) reached 2.7 at most after printing the 12,000 sheets. [Comparative Example 2-58] With toner ϵ-6, the drum fog (color difference ΔE) reached 3.9 after printing 18,000 sheets. Therefore, the continuous print test was stopped. Although the smear did not occur, when the development device was opened, attachment of a small amount of the external additive was observed on the end of the charge roller. [Embodiment 2-49] to [Embodiment 2-51] With toner ϵ-7, toner ϵ-8 and toner ϵ-9, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 2-59] With toner ϵ-10, the smear occurred on an edge of the recording medium after printing 12,000 sheets. Therefore, the continuous print test was stopped. In addition, the drum fog (color difference ΔE) reached 2.6 at most after printing the 12,000 sheets. [Comparative Example 2-60] With toner ϵ-11, the drum fog (color difference ΔE) reached 3.7 after printing 15,000 sheets. Therefore, the continuous print test was stopped. Although the smear did not occur, when the development device was opened, attachment of a small amount of the external additive was observed on the end of the charge roller. [Embodiment 2-52] to [Embodiment 2-54] With toner ϵ-12, toner ϵ-13 and toner ϵ-14, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 2-61] With toner ϵ-15, the smear occurred on an edge of the recording medium after printing 15,000 sheets. Therefore, the continuous print test was stopped. In addition, the drum fog (color difference ΔE) reached 2.3 at most after printing the 12,000 sheets. [Comparative Example 2-62] With toner ϵ-16, the drum fog (color difference ΔE) reached 4.9 after printing 12,000 sheets. Therefore, the continuous print test was stopped. Although the smear did not occur, when the development device was opened, attachment of a small amount of the external additive was observed on the end of the charge roller. [Embodiment 2-55] to [Embodiment 2-57] With toner ϵ-17, toner ϵ-18 and toner ϵ-19, the drum fog (color difference ΔE) was 1.5 or less, and the continuous print test was conducted up to 50,000 sheets. The smear did not occur, and when the development device was opened, the attachment of the external additive to the charge roller was also not observed. [Comparative Example 2-63] With toner ϵ-20, the smear occurred on an edge of the recording medium after printing 12,000 sheets. Therefore, the continuous print test was stopped. In addition, the drum fog (color difference ΔE) reached 1.8 at most after printing the 9,000 sheets. [Comparative Example 2-64] With toner ϵ-21, the drum fog (color difference ΔE) reached 4.1 after printing 15,000 sheets. Therefore, the continuous print test was stopped. Although the smear did not occur, when the development device was opened, attachment of a small amount of the external additive was observed on the end of the charge roller. [Embodiment 2-58] to [Embodiment 2-60] With toner ϵ-22, toner ϵ-23 and toner ϵ-24, the drum fog (color difference ΔE) was 3.0 or less, and the continuous print test was conducted up to 50,000 sheets. Although the smear did not occur, when the development device was opened, attachment of a small amount of the external additive was observed on end of the end of the charge roller. [Comparative Example 2-65] With toner ϵ-25, the smear occurred on an edge of the recording medium after printing 18,000 sheets.

Therefore, the continuous print test was stopped. In addition, the drum fog (color difference ΔE) reached 2.9 at most after printing the 12,000 sheets.

TABLE 14

| | Toner | Circularity Degree | PMMA | $SiO_2$ | Smear | Fog |
|---|---|---|---|---|---|---|
| Comparative Example 2-66 | ζ-1 | 0.99 | 0.2 | 1.8 | ○ | X |
| Comparative Example 2-67 | ζ-2 | | 0.4 | 1.8 | ○ | X |
| Comparative Example 2-68 | ζ-3 | | 0.6 | 1.8 | X | ○ |
| Comparative Example 2-69 | ζ-4 | | 0.8 | 1.8 | X | ○ |
| Comparative Example 2-70 | ζ-5 | | 1.0 | 1.8 | X | ○ |
| Comparative Example 2-71 | ζ-6 | | 0.2 | 2.2 | ○ | X |
| Comparative Example 2-72 | ζ-7 | | 0.4 | 2.2 | ○ | X |
| Comparative Example 2-73 | ζ-8 | | 0.6 | 2.2 | X | ○ |
| Comparative Example 2-74 | ζ-9 | | 0.8 | 2.2 | X | ○ |
| Comparative Example 2-75 | ζ-10 | | 1.0 | 2.2 | X | ○ |
| Comparative Example 2-76 | ζ-11 | | 0.2 | 3.6 | ○ | X |
| Comparative Example 2-77 | ζ-12 | | 0.4 | 3.6 | ○ | X |
| Comparative Example 2-78 | ζ-13 | | 0.6 | 3.6 | X | ○ |
| Comparative Example 2-79 | ζ-14 | | 0.8 | 3.6 | X | ○ |
| Comparative Example 2-80 | ζ-15 | | 1.0 | 3.6 | X | ○ |
| Comparative Example 2-81 | ζ-16 | | 0.2 | 5.0 | ○ | X |
| Comparative Example 2-82 | ζ-17 | | 0.4 | 5.0 | ○ | X |
| Comparative Example 2-83 | ζ-18 | | 0.6 | 5.0 | X | ○ |
| Comparative Example 2-84 | ζ-19 | | 0.8 | 5.0 | X | ○ |
| Comparative Example 2-85 | ζ-20 | | 0.9 | 5.0 | X | ○ |
| Comparative Example 2-86 | ζ-21 | | 0.2 | 5.4 | ○ | X |
| Comparative Example 2-87 | ζ-22 | | 0.4 | 5.4 | ○ | X |
| Comparative Example 2-88 | ζ-23 | | 0.6 | 5.4 | X | ○ |
| Comparative Example 2-89 | ζ-24 | | 0.8 | 5.4 | X | ○ |
| Comparative Example 2-90 | ζ-25 | | 0.9 | 5.4 | X | ○ |

[Comparative Example 2-66] The smear did not occur with toner ζ-1. However, the drum fog (color difference ΔE) reached 3.7 after printing 9,000 sheets. Therefore, the continuous print test was stopped. When the development device was opened, attachment of a small amount of the external additive was observed on the end of the charge roller. [Comparative Example 2-67] The smear did not occur with toner ζ-2. However, the drum fog (color difference ΔE) reached 4.2 after printing 12,000 sheets. Therefore, the continuous print test was stopped. When the development device was opened, attachment of a small amount of the external additive was observed on the end of the charge roller. [Comparative Example 2-68] With toner ζ-3, the smear occurred on the recording medium after printing 12,000 sheets. Therefore, the continuous print test was stopped. In addition, the drum fog (color difference ΔE) reached 2.8 at most. [Comparative Example 2-69] With toner ζ-4, the smear occurred on the recording medium after printing 6,000 sheets. Therefore, the continuous print test was stopped. In addition, the drum fog (color difference ΔE) reached 1.8 at most. [Comparative Example 2-70] With toner ζ-5, the drum fog (color difference ΔE) reached 1.7 at most. The smear occurred at the left end part of the recording medium after printing 7,500 sheets. Therefore, the continuous print test was stopped. [Comparative Example 2-71] With toner ζ-6, the drum fog (color difference ΔE) reached 4.7 after printing 18,000 sheets. Therefore, the continuous print test was stopped. Although the smear did not occur, when the development device was opened, attachment of a small amount of the external additive was observed on the end of the charge roller. [Comparative Example 2-72] With toner ζ-7, the drum fog (color difference ΔE) reached 4.1 after printing 12,000 sheets. Therefore, the continuous print test was stopped. Although the smear did not occur, when the development device was opened, attachment of a small amount of the external additive was observed on the end of the charge roller. [Comparative Example 2-73] With toner ζ-8, the smear occurred on an edge of the recording medium after printing 18,000 sheets. Therefore, the continuous print test was stopped. In addition, the drum fog (color difference ΔE) reached 2.9 at most. [Comparative Example 2-74] With toner ζ-9, the smear occurred on an edge of the recording medium after printing 12,000 sheets. Therefore, the continuous print test was stopped. In addition, the drum fog (color difference ΔE) reached 2.6 at most. [Comparative Example 2-75] With toner ζ-10, the smear occurred on the recording medium after printing 6,000 sheets. Therefore, the continuous print test was stopped. In addition, the drum fog (color difference ΔE) reached 1.7 at most after printing the 6,000 sheets. [Comparative Example 2-76] With toner ζ-11, the drum fog (color difference ΔE) reached 5.0 after printing 12,000 sheets. Therefore, the continuous print test was stopped. Although the smear did not occur, when the development device was opened, attachment of a small amount of the external additive was observed on the end of the charge roller. [Comparative Example 2-77] With toner ζ-12, the drum fog (color difference ΔE) reached 3.7 after printing 9,000 sheets. Therefore, the continuous print test was stopped. Although the smear did not occur, when the development device was opened, attachment of a small amount of the external additive was observed on the end of the charge roller. [Comparative Example 2-78] With toner ζ-13, the smear occurred on the recording medium after printing 9,000 sheets. Therefore, the continuous print test was stopped. In addition, the drum fog (color difference ΔE) reached 2.5 after printing the 9,000 sheets. [Comparative Example 2-79] With toner ζ-14, the smear occurred on the recording medium after printing 12,000 sheets. Therefore, the continuous print test was stopped. In addition, the drum fog (color difference ΔE) reached 2.7 at most. [Comparative Example 2-80] With toner ζ-15, the smear occurred on an edge of the recording medium after printing 18,000 sheets. Therefore, the continuous print test was stopped. In addition, the drum fog (color difference ΔE) reached 1.9 at most after printing the 12,000 sheets. [Comparative Example 2-81] With toner ζ-16, the drum fog (color difference ΔE) reached 3.3 after printing 15,000 sheets. Therefore, the continuous print test was stopped. Although the smear did not occur, when the development device was opened, attachment of a small amount of the external additive was observed on the end of the charge roller. [Comparative Example 2-82] With toner ζ-17, the drum fog (color difference ΔE) reached 4.1 after printing 18,000 sheets. Therefore, the continuous print test was stopped. Although the smear did not occur, when the development device was opened, attachment of a small amount of the external additive was observed on the end of the charge roller. [Comparative Example 2-83] With toner ζ-18, the smear occurred on the recording medium after printing 15,000 sheets. Therefore, the continuous print test was stopped. In addition, the drum fog (color difference ΔE) reached 2.1 at most. [Comparative Example 2-84] With toner ζ-19, the smear occurred on an edge of the recording medium after printing 18,000 sheets. Therefore, the continuous print test was stopped. In addition, the drum fog (color difference ΔE) reached 2.1 at most. [Comparative Example 2-85] With toner ζ-20, the smear occurred on an edge of the recording medium after printing 12,000 sheets. Therefore, the continuous print test was stopped. In addition, the drum fog (color difference ΔE) reached 1.9 after printing the 12,000 sheets. [Comparative Example 2-86] With toner ζ-21, the drum fog (color difference ΔE) reached 3.5 after printing 9,000 sheets. Therefore, the continuous print test was stopped. Although the smear did not occur, when the development device was opened, attachment of a small amount of the external additive was observed on the end of the charge roller. [Comparative Example 2-87] With toner ζ-22, the drum fog (color difference ΔE) reached 4.7 after printing 18,000 sheets. Therefore, the continuous print test was stopped. Although the smear did not occur, when the development device was opened, attachment of a small amount of the external additive was observed on the end of the charge roller. [Comparative Example 2-88] With toner ζ-23, the smear occurred on an edge of the recording medium after printing 12,000 sheets. Therefore, the continuous print test was stopped. In addition, the drum fog (color difference ΔE) reached 22.8 at most after printing the 15,000 sheets. [Comparative Example 2-89] With toner ζ-24, the smear occurred on an edge of the recording medium after printing 12,000 sheets. Therefore, the continuous print test was stopped. In addition, the drum fog (color difference ΔE) reached 1.9 at most after printing the 9,000 sheets. [Comparative Example 1-90] With toner ζ-25, the smear occurred on an edge of the recording medium after printing 12,000 sheets. Therefore, the continuous print test was stopped. In addition, the drum fog (color difference ΔE) reached 1.9 after printing the 6,000 sheets.

As described above, it was observed that when the circularity degree of emulsion polymerized toner is within a range from 0.94 to 0.98 inclusive and when PMMP (polymethyl methacrylate) used as the external additive is within a range from 0.4 parts by weight to 0.8 parts by weight inclusive per 100 parts by weight of the toner mother particles, the smear due to the attachment of the external additive to the charge roller does not occur for printing up to 50,000 sheets with the 20% duty image, and that the drum fog (color difference ΔE) is 3.0 or less.

In addition, it was determined that when the amount of external additives other than PMMP (polymethyl methacrylate) is within a range from 2.2 parts by weight to 5.0 parts by weight inclusive per 100 parts by weight of the toner mother particles, there is not attachment of the external additives to the charge roller for printing up to 50,000 sheets with the 20% duty image, and that the drum fog (color difference ΔE) is 1.5 or less.

Next, reinvestigation of the external additive was conducted for toner β and toner ϵ, which did not result in the smear or fog. Toner β and toner ϵ were used for the toner mother particles. In 100 parts by weight of the toner mother particles β having the circularity degree of 0.94, 0.2 parts by weight of "MP-1000," 1.6 parts by weight of "Aerosil RX50" and 0.2 parts by weight of oxidized titanium ($TiO_2$) (TTO-51(A) manufactured by Ishihara Sangyo Kaisha, Ltd., particle diameter 10 nm) were added and mixed for 25 minutes to obtain toner β-26.

In 100 parts by weight of the toner mother particles β having the circularity degree of 0.94, 0.2 parts by weight of "MP-1000," 1.6 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner β-27. In 100 parts by weight of the toner mother particles β having the circularity degree of 0.94, 0.6 parts by weight of "MP-1000," 1.6 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner β-29.

In 100 parts by weight of the toner mother particles β having the circularity degree of 0.94, 0.8 parts by weight of "MP-1000," 1.6 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner β-29. In 100 parts by weight of the toner mother particles β having the circularity degree of 0.94, 1.0 parts by weight of "MP-1000," 1.6 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner β-30.

In 100 parts by weight of the toner mother particles β having the circularity degree of 0.94, 0.2 parts by weight of "MP-1000," 2.0 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner β-31. In 100 parts by weight of the toner mother particles β having the circularity degree of 0.94, 0.4 parts by weight of "MP-1000," 2.0 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner β-32.

In 100 parts by weight of the toner mother particles β having the circularity degree of 0.94, 0.6 parts by weight of "MP-1000," 2.0 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner β-33. In 100 parts by weight of the toner mother particles β having the circularity degree of 0.94, 0.8 parts by weight of "MP-1000," 2.0 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner β-34.

In 100 parts by weight of the toner mother particles β having the circularity degree of 0.94, 1.0 parts by weight of "MP-1000," 2.0 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner β-35. In 100 parts by weight of the toner mother particles β having the circularity degree of 0.94, 0.2 parts by weight of "MP-1000," 3.2 parts by weight of "Aerosil RX50" and 0.4 parts by weight of oxidized titanium (TTO-51(A) manufactured by Ishihara Sangyo Kaisha, Ltd., particle diameter 10 nm) were added and mixed for 25 minutes to obtain toner β-36.

In 100 parts by weight of the toner mother particles β having the circularity degree of 0.94, 0.4 parts by weight of "MP-1000," 3.2 parts by weight of "Aerosil RX50" and 0.4 parts by weight of oxidized titanium (TTO-51(A) manufactured by Ishihara Sangyo Kaisha, Ltd., particle diameter 10 nm) were added and mixed for 25 minutes to obtain toner β-37. In 100 parts by weight of the toner mother particles β having the circularity degree of 0.94, 0.6 parts by weight of "MP-1000," 3.2 parts by weight of "Aerosil RX50" and 0.4 parts by weight of oxidized titanium (TTO-51(A) manufactured by Ishihara Sangyo Kaisha, Ltd., particle diameter 10 nm) were added and mixed for 25 minutes to obtain toner β-38.

In 100 parts by weight of the toner mother particles β having the circularity degree of 0.94, 0.8 parts by weight of "MP-1000," 3.2 parts by weight of "Aerosil RX50" and 0.4 parts by weight of oxidized titanium (TTO-51(A) manufactured by Ishihara Sangyo Kaisha, Ltd., particle diameter 10 nm) were added and mixed for 25 minutes to obtain toner β-39. In 100 parts by weight of the toner mother particles β having the circularity degree of 0.94, 1.0 parts by weight of "MP-1000," 3.2 parts by weight of "Aerosil RX50" and 0.4 parts by weight of oxidized titanium (TTO-51(A) manufactured by Ishihara Sangyo Kaisha, Ltd., particle diameter 10 nm) were added and mixed for 25 minutes to obtain toner β-40.

In 100 parts by weight of the toner mother particles β having the circularity degree of 0.94, 0.2 parts by weight of "MP-1000," 4.5 parts by weight of "Aerosil RX50" and 0.5 parts by weight of oxidized titanium (TTO-51(A) manufactured by Ishihara Sangyo Kaisha, Ltd., particle diameter 10 nm) were added and mixed for 25 minutes to obtain toner β-41. In 100 parts by weight of the toner mother particles β having the circularity degree of 0.94, 0.4 parts by weight of "MP-1000," 4.5 parts by weight of "Aerosil RX50" and 0.5 parts by weight of oxidized titanium (TTO-51(A) manufactured by Ishihara Sangyo Kaisha, Ltd., particle diameter 10 nm) were added and mixed for 25 minutes to obtain toner β-42.

In 100 parts by weight of the toner mother particles β having the circularity degree of 0.94, 0.6 parts by weight of "MP-1000," 4.5 parts by weight of "Aerosil RX50" and 0.5 parts by weight of oxidized titanium (TTO-51(A) manufactured by Ishihara Sangyo Kaisha, Ltd., particle diameter 10 nm) were added and mixed for 25 minutes to obtain toner β-43. In 100 parts by weight of the toner mother particles β having the circularity degree of 0.94, 0.8 parts by weight of "MP-1000," 4.5 parts by weight of "Aerosil RX50" and 0.5 parts by weight of oxidized titanium (TTO-51(A) manufactured by Ishihara Sangyo Kaisha, Ltd., particle diameter 10 nm) were added and mixed for 25 minutes to obtain toner β-44.

In 100 parts by weight of the toner mother particles β having the circularity degree of 0.94, 0.9 parts by weight of "MP-1000," 4.5 parts by weight of "Aerosil RX50" and 0.5 parts by weight of oxidized titanium (TTO-51(A) manufactured by Ishihara Sangyo Kaisha, Ltd., particle diameter 10 nm) were added and mixed for 25 minutes to obtain toner β-45. In 100 parts by weight of the toner mother particles β having the circularity degree of 0.94, 0.2 parts by weight of "MP-1000," 4.8 parts by weight of "Aerosil RX50" and 0.6 parts by weight of oxidized titanium (TTO-51(A) manufactured by Ishihara Sangyo Kaisha, Ltd., particle diameter 10 nm) were added and mixed for 25 minutes to obtain toner β-46.

In 100 parts by weight of the toner mother particles β having the circularity degree of 0.94, 0.4 parts by weight of "MP-1000," 4.8 parts by weight of "Aerosil RX50" and 0.6 parts by weight of oxidized titanium (TTO-51(A) manufactured by Ishihara Sangyo Kaisha, Ltd., particle diameter 10 nm) were added and mixed for 25 minutes to obtain toner β-47. In 100 parts by weight of the toner mother particles β having the circularity degree of 0.94, 0.6 parts by weight of "MP-1000," 4.8 parts by weight of "Aerosil RX50" and 0.6 parts by weight of oxidized titanium (TTO-51(A) manufactured by Ishihara Sangyo Kaisha, Ltd., particle diameter 10 nm) were added and mixed for 25 minutes to obtain toner β-48.

In 100 parts by weight of the toner mother particles β having the circularity degree of 0.94, 0.8 parts by weight of "MP-1000," 4.8 parts by weight of "Aerosil RX50" and 0.6 parts by weight of oxidized titanium (TTO-51(A) manufactured by Ishihara Sangyo Kaisha, Ltd., particle diameter 10 nm) were added and mixed for 25 minutes to obtain toner β-49. In 100 parts by weight of the toner mother particles β having the circularity degree of 0.94, 0.9 parts by weight of "MP-1000," 4.8 parts by weight of "Aerosil RX50" and 0.6 parts by weight of oxidized titanium (TTO-51(A) manufactured by Ishihara Sangyo Kaisha, Ltd., particle diameter 10 nm) were added and mixed for 25 minutes to obtain toner β-50.

Moreover, in 100 parts by weight of the toner mother particles β having the circularity degree of 0.98, 0.2 parts by weight of "MP-1000," 1.6 parts by weight of "Aerosil RX50" and 0.2 parts by weight of oxidized titanium ($TiO_2$) (TTO-51 (A) manufactured by Ishihara Sangyo Kaisha, Ltd., particle diameter 10 nm) were added and mixed for 25 minutes to obtain toner β-26. In 100 parts by weight of the toner mother particles ϵ having the circularity degree of 0.98, 0.2 parts by weight of "MP-1000," 1.6 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner ϵ-27.

In 100 parts by weight of the toner mother particles ϵ having the circularity degree of 0.98, 1.0 parts by weight of "MP-1000," 2.0 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner ϵ-28. In 100 parts by weight of the toner mother particles ϵ having the circularity degree of 0.98, 0.8 parts by weight of "MP-1000," 1.6 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner ϵ-29.

In 100 parts by weight of the toner mother particles ϵ having the circularity degree of 0.98, 1.0 parts by weight of "MP-1000," 1.6 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner ϵ-30. In 100 parts by weight of the toner mother particles ϵ having the circularity degree of 0.98, 0.2 parts by weight of "MP-1000," 2.0 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner ϵ-31.

In 100 parts by weight of the toner mother particles ϵ having the circularity degree of 0.98, 0.2 parts by weight of "MP-1000," 2.0 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner ϵ-32. In 100 parts by weight of the toner mother particles ϵ having the circularity degree of 0.98, 0.6 parts by weight of "MP-1000," 2.0 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner ϵ-33.

In 100 parts by weight of the toner mother particles ϵ having the circularity degree of 0.98, 0.8 parts by weight of "MP-1000," 2.0 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner ϵ-34. In 100 parts by weight of the toner mother particles ϵ having the circularity degree of 0.98, 1.0 parts by weight of "MP-1000," 2.0 parts by weight of "Aerosil RX50" and 0.2 parts by weight of oxidized titanium (TTO-51(A) manufactured by Ishihara Sangyo Kaisha, Ltd., particle diameter 10 nm) were added and mixed for 25 minutes to obtain toner ϵ-35.

In 100 parts by weight of the toner mother particles ϵ having the circularity degree of 0.98, 0.2 parts by weight of "MP-1000," 3.2 parts by weight of "Aerosil RX50" and 0.4 parts by weight of oxidized titanium (TTO-51(A) manufactured by Ishihara Sangyo Kaisha, Ltd., particle diameter 10 nm) were added and mixed for 25 minutes to obtain toner ϵ-36. In 100 parts by weight of the toner mother particles ϵ having the circularity degree of 0.98, 0.4 parts by weight of "MP-1000," 3.2 parts by weight of "Aerosil RX50" and 0.4 parts by weight of oxidized titanium (TTO-51(A) manufactured by Ishihara Sangyo Kaisha, Ltd., particle diameter 10 nm) were added and mixed for 25 minutes to obtain toner ϵ-37.

In 100 parts by weight of the toner mother particles ϵ having the circularity degree of 0.98, 0.6 parts by weight of "MP-1000," 3.2 parts by weight of "Aerosil RX50" and 0.4 parts by weight of oxidized titanium (TTO-51(A) manufactured by Ishihara Sangyo Kaisha, Ltd., particle diameter 10 nm) were added and mixed for 25 minutes to obtain toner ϵ-38. In 100 parts by weight of the toner mother particles ϵ having the circularity degree of 0.98, 0.8 parts by weight of "MP-1000," 3.2 parts by weight of "Aerosil RX50" and 0.4 parts by weight of oxidized titanium (TTO-51(A) manufactured by Ishihara Sangyo Kaisha, Ltd., particle diameter 10 nm) were added and mixed for 25 minutes to obtain toner ϵ-39.

In 100 parts by weight of the toner mother particles ϵ having the circularity degree of 0.98, 1.0 parts by weight of "MP-1000," 3.2 parts by weight of "Aerosil RX50" and 0.4 parts by weight of oxidized titanium (TTO-51(A) manufactured by Ishihara Sangyo Kaisha, Ltd., particle diameter 10 nm) were added and mixed for 25 minutes to obtain toner ϵ-40. In 100 parts by weight of the toner mother particles ϵ having the circularity degree of 0.98, 0.2 parts by weight of "MP-1000," 4.5 parts by weight of "Aerosil RX50" and 0.5 parts by weight of oxidized titanium (TTO-51(A) manufactured by Ishihara Sangyo Kaisha, Ltd., particle diameter 10 nm) were added and mixed for 25 minutes to obtain toner ϵ-41.

In 100 parts by weight of the toner mother particles ϵ having the circularity degree of 0.98, 0.4 parts by weight of "MP-1000," 4.5 parts by weight of "Aerosil RX50" and 0.5 parts by weight of oxidized titanium (TTO-51(A) manufactured by Ishihara Sangyo Kaisha, Ltd., particle diameter 10 nm) were added and mixed for 25 minutes to obtain toner ϵ-42. In 100 parts by weight of the toner mother particles ϵ having the circularity degree of 0.98, 0.6 parts by weight of "MP-1000," 4.5 parts by weight of "Aerosil RX50" and 0.5 parts by weight of oxidized titanium (TTO-51(A) manufactured by Ishihara Sangyo Kaisha, Ltd., particle diameter 10 nm) were added and mixed for 25 minutes to obtain toner ϵ-43.

In 100 parts by weight of the toner mother particles ϵ having the circularity degree of 0.98, 0.8 parts by weight of "MP-1000," 4.5 parts by weight of "Aerosil RX50" and 0.5 parts by weight of oxidized titanium (TTO-51(A) manufactured by Ishihara Sangyo Kaisha, Ltd., particle diameter 10 nm) were added and mixed for 25 minutes to obtain toner ϵ-44. In 100 parts by weight of the toner mother particles ϵ having the circularity degree of 0.98, 0.9 parts by weight of "MP-1000," 4.5 parts by weight of "Aerosil RX50" and 0.5 parts by weight of oxidized titanium (TTO-51(A) manufactured by Ishihara Sangyo Kaisha, Ltd., particle diameter 10 nm) were added and mixed for 25 minutes to obtain toner ϵ-45.

In 100 parts by weight of the toner mother particles ϵ having the circularity degree of 0.98, 0.2 parts by weight of "MP-1000," 4.8 parts by weight of "Aerosil RX50" and 0.6 parts by weight of oxidized titanium (TTO-51(A) manufactured by Ishihara Sangyo Kaisha, Ltd., particle diameter 10 nm) were added and mixed for 25 minutes to obtain toner ϵ-46. In 100 parts by weight of the toner mother particles 8 having the circularity degree of 0.98, 0.4 parts by weight of "MP-1000," 4.8 parts by weight of "Aerosil RX50" and 0.6 parts by weight of oxidized titanium (TTO-51(A) manufactured by Ishihara Sangyo Kaisha, Ltd., particle diameter 10 nm) were added and mixed for 25 minutes to obtain toner ϵ-47.

In 100 parts by weight of the toner mother particles ϵ having the circularity degree of 0.98, 0.6 parts by weight of "MP-1000," 4.8 parts by weight of "Aerosil RX50" and 0.6 parts by weight of oxidized titanium (TTO-51(A) manufactured by Ishihara Sangyo Kaisha, Ltd., particle diameter 10 nm) were added and mixed for 25 minutes to obtain toner ϵ-48. In 100 parts by weight of the toner mother particles 8 having the circularity degree of 0.98, 0.8 parts by weight of "MP-1000," 4.8 parts by weight of "Aerosil RX50" and 0.6 parts by weight of oxidized titanium (TTO-51(A) manufactured by Ishihara Sangyo Kaisha, Ltd., particle diameter 10 nm) were added and mixed for 25 minutes to obtain toner ϵ-49.

In 100 parts by weight of the toner mother particles ϵ having the circularity degree of 0.98, 0.9 parts by weight of "MP-1000," 4.8 parts by weight of "Aerosil RX50" and 0.6 parts by weight of oxidized titanium (TTO-51(A) manufactured by Ishihara Sangyo Kaisha, Ltd., particle diameter 10 nm) were added and mixed for 25 minutes to obtain toner ϵ50.

For the obtained toner β-26 to toner β-50 and toner ϵ-26 to toner ϵ-50, a continuous print test similar to the above-described continuous print test was conducted. Results of the continuous print test are described based on Table 15 and Table 16.

TABLE 15

| | Toner | Circularity Degree | PMMA | $SiO_2$ | $TiO_2$ | Smear | Fog |
|---|---|---|---|---|---|---|---|
| Comparative Example 2-91 | β-26 | 0.94 | 0.2 | 1.6 | 0.2 | ○ | X |
| Embodiment 2-61 | β-27 | | 0.4 | 1.6 | 0.2 | ○ | ○ |
| Embodiment 2-62 | β-28 | | 0.6 | 1.6 | 0.2 | ○ | ○ |
| Embodiment 2-63 | β-29 | | 0.8 | 1.6 | 0.2 | ○ | ○ |
| Comparative Example 2-92 | β-30 | | 1.0 | 1.6 | 0.2 | X | ○ |
| Comparative Example 2-93 | β-31 | | 0.2 | 2.0 | 0.2 | ○ | X |
| Embodiment 2-64 | β-32 | | 0.4 | 2.0 | 0.2 | ◎ | ◎ |
| Embodiment 2-65 | β-33 | | 0.6 | 2.0 | 0.2 | ◎ | ◎ |
| Embodiment 2-66 | β-34 | | 0.8 | 2.0 | 0.2 | ◎ | ◎ |
| Comparative Example 2-94 | β-35 | | 1.0 | 2.0 | 0.2 | X | ○ |
| Comparative Example 2-95 | β-36 | | 0.2 | 3.2 | 0.4 | ○ | X |
| Embodiment 2-67 | β-37 | | 0.4 | 3.2 | 0.4 | ◎ | ◎ |
| Embodiment 2-68 | β-38 | | 0.6 | 3.2 | 0.4 | ◎ | ◎ |
| Embodiment 2-69 | β-39 | | 0.8 | 3.2 | 0.4 | ◎ | ◎ |
| Comparative Example 2-96 | β-40 | | 1.0 | 3.2 | 0.4 | X | ○ |
| Comparative Example 2-97 | β-41 | | 0.2 | 4.5 | 0.5 | ○ | X |
| Embodiment 2-70 | β-42 | | 0.4 | 4.5 | 0.5 | ◎ | ◎ |
| Embodiment 2-71 | β-43 | | 0.6 | 4.5 | 0.5 | ◎ | ◎ |
| Embodiment 2-72 | β-44 | | 0.8 | 4.5 | 0.5 | ◎ | ◎ |
| Comparative Example 2-98 | β-45 | | 0.9 | 4.5 | 0.5 | X | ○ |
| Comparative Example 2-99 | β-46 | | 0.2 | 4.8 | 0.6 | ○ | X |
| Embodiment 2-73 | β-47 | | 0.4 | 4.8 | 0.6 | ○ | ○ |
| Embodiment 2-74 | β-48 | | 0.6 | 4.8 | 0.6 | ○ | ○ |
| Embodiment 2-75 | β-49 | | 0.8 | 4.8 | 0.6 | ○ | ○ |
| Comparative Example 2-100 | β-50 | | 0.9 | 4.8 | 0.6 | X | ○ |

[Comparative Example 2-91] With toner β-26, the drum fog (color difference ΔE) reached 3.6 after printing 15,000 sheets. Therefore, the continuous print test was stopped. Although the smear did not occur, when the development device was opened, attachment of a small amount of the external additive was observed on the end of the charge roller. [Embodiment 2-61] to [Embodiment 2-63] With toner β-27, toner β-28 and toner β-29, the continuous print test was conducted up to 50,000 sheets, and the smear did not occur. The drum fog (color difference ΔE) was 3.0 or less. When the development device was opened, attachment of a small amount of the external additive was observed on the end of the charge roller. [Comparative Example 2-92] With toner β-30, the smear occurred on the recording medium after printing 18,000 sheets. Therefore, the continuous print test was stopped. In addition, the drum fog (color difference ΔE) reached 2.9 at most after printing the 12,000 sheets. [Comparative Example 2-93] With toner β-31, the drum fog (color difference ΔE) reached 3.9 after printing 12,000 sheets. Therefore, the continuous print test was stopped. Although the smear did not occur, when the development device was opened, attachment of the external additive was observed on the end of the charge roller. [Embodiment 2-64] to [Embodiment 2-66] With toner β-32, toner β-33 and toner β-34, the continuous print test was conducted up to 50,000 sheets, and the smear did not occur. The drum fog (color difference ΔE) was 1.5 or less. [Comparative Example 2-94] With toner β-35, the smear occurred on the recording medium after printing 12,000 sheets. Therefore, the continuous print test was stopped. In addition, the drum fog (color difference ΔE) reached 2.7 at most after printing the 12,000 sheets. [Comparative Example 2-95] With toner β-36, the drum fog (color difference ΔE) reached 4.1 after printing 12,000 sheets. Therefore, the continuous print test was stopped. Although the smear did not occur, when the development device was opened, attachment of the external additive was observed on the end of the charge roller. [Embodiment 2-67] to [Embodiment 2-69] With toner β-37, toner β-38 and toner β-39, the continuous print test was conducted up to 50,000 sheets, and the smear did not occur. The drum fog (color difference ΔE) was 1.5 or less. [Comparative Example 2-96] With toner β-40, the smear occurred on the recording medium after printing 24,000 sheets. Therefore, the continuous print test was stopped. In addition, the drum fog (color difference ΔE) reached 2.5 at most after printing the 21,000 sheets. [Comparative Example 2-97] With toner β-41, the drum fog (color difference ΔE) reached 3.9 after printing 15,000 sheets. Therefore, the continuous print test was stopped. Although the smear did not occur, when the development device was opened, attachment of the external additive was observed on the end of the charge roller. [Embodiment 2-70] to [Embodiment 2-72] With toner β-42, toner β-43 and toner β-44, the continuous print test was conducted up to 50,000 sheets, and the smear did not occur. The drum fog (color difference ΔE) was 1.5 or less. [Comparative Example 2-98] With toner β-45, the smear occurred on the recording medium after printing 15,000 sheets. Therefore, the continuous print test was stopped. In addition, the drum fog (color difference ΔE) reached 2.8 at most after printing the 15,000 sheets. [Comparative Example 2-99] With toner β-46, the drum fog (color difference ΔE) reached 3.9 after printing 9,000 sheets. Therefore, the continuous print test was stopped. Although the smear did not occur, when the development device was opened, attachment of the external additive was observed on the end of the charge roller. [Embodiment 2-73] to [Embodiment 2-75] With toner β-47, toner β-48 and toner β-49, the continuous print test was conducted up to 50,000 sheets, and the drum fog (color difference ΔE) was 3.0 or less. Although the smear did not occur, when the development device was opened, attachment of a small amount of the external additive was observed on the end of the charge roller. [Comparative Example 2-100] With toner β-50, the smear occurred on the recording medium after printing 18,000 sheets. Therefore, the continuous print test was stopped. In addition, the drum fog (color difference ΔE) reached 2.9 at most after printing the 15,000 sheets.

TABLE 16

| | Toner | Circularity Degree | PMMA | $SiO_2$ | $TiO_2$ | Smear | Fog |
|---|---|---|---|---|---|---|---|
| Comparative Example 2-101 | ϵ-26 | 0.98 | 0.2 | 1.6 | 0.2 | ○ | X |
| Embodiment 2-76 | ϵ-27 | | 0.4 | 1.6 | 0.2 | ○ | ○ |
| Embodiment 2-77 | ϵ-28 | | 0.6 | 1.6 | 0.2 | ○ | ○ |
| Embodiment 2-78 | ϵ-29 | | 0.8 | 1.6 | 0.2 | ○ | ○ |
| Comparative Example 2-102 | ϵ-30 | | 1.0 | 1.6 | 0.2 | X | ○ |
| Comparative Example 2-103 | ϵ-31 | | 0.2 | 2.0 | 0.2 | ○ | X |
| Embodiment 2-79 | ϵ-32 | | 0.4 | 2.0 | 0.2 | ◎ | ◎ |
| Embodiment 2-80 | ϵ-33 | | 0.6 | 2.0 | 0.2 | ◎ | ◎ |
| Embodiment 2-81 | ϵ-34 | | 0.8 | 2.0 | 0.2 | ◎ | ◎ |
| Comparative Example 2-104 | ϵ-35 | | 1.0 | 2.0 | 0.2 | X | ○ |
| Comparative Example 2-105 | ϵ-36 | | 0.2 | 3.2 | 0.4 | ○ | X |
| Embodiment 2-82 | ϵ-37 | | 0.4 | 3.2 | 0.4 | ◎ | ◎ |
| Embodiment 2-83 | ϵ-38 | | 0.6 | 3.2 | 0.4 | ◎ | ◎ |
| Embodiment 2-84 | ϵ-39 | | 0.8 | 3.2 | 0.4 | ◎ | ◎ |
| Comparative Example 2-106 | ϵ-40 | | 1.0 | 3.2 | 0.4 | X | ○ |
| Comparative Example 2-107 | ϵ-41 | | 0.2 | 4.5 | 0.5 | ○ | X |
| Embodiment 2-85 | ϵ-42 | | 0.4 | 4.5 | 0.5 | ◎ | ◎ |
| Embodiment 2-86 | ϵ-43 | | 0.6 | 4.5 | 0.5 | ◎ | ◎ |
| Embodiment 2-87 | ϵ-44 | | 0.8 | 4.5 | 0.5 | ◎ | ◎ |
| Comparative Example 2-108 | ϵ-45 | | 0.9 | 4.5 | 0.5 | X | ○ |
| Comparative Example 2-109 | ϵ-46 | | 0.2 | 4.8 | 0.6 | ○ | X |
| Embodiment 2-88 | ϵ-47 | | 0.4 | 4.8 | 0.6 | ○ | ○ |
| Embodiment 2-89 | ϵ-48 | | 0.6 | 4.8 | 0.6 | ○ | ○ |
| Embodiment 2-90 | ϵ-49 | | 0.8 | 4.8 | 0.6 | ○ | ○ |
| Comparative Example 2-110 | ϵ-50 | | 0.9 | 4.8 | 0.6 | X | ○ |

[Comparative Example 2-101] With toner ϵ-26, the drum fog (color difference ΔE) reached 3.2 after printing 15,000 sheets. Therefore, the continuous print test was stopped. Although the smear did not occur, when the development device was opened, attachment of a small amount of the external additive was observed on the end of the charge roller. [Embodiment 2-76] to [Embodiment 2-78] With toner ϵ-27, toner ϵ-28 and toner ϵ-29, the continuous print test was conducted up to 50,000 sheets, and the drum fog (color difference ΔE) was 3.0 or less. Although the smear did not occur, when the development device was opened, attachment of a small amount of the external additive was observed on the end of the charge roller. [Comparative Example 2-102] With toner ϵ-30, the smear occurred on the recording medium after printing 15,000 sheets. Therefore, the continuous print test was stopped. In addition, the drum fog (color difference ΔE) reached 2.7 at most after printing the 12,000 sheets. [Comparative Example 2-103] With toner ϵ-31, the drum fog (color difference ΔE) reached 4.0 after printing 9,000 sheets. Therefore, the continuous print test was stopped. Although the smear did not occur, when the development device was opened, attachment of the external additive was observed on the end of the charge roller. [Embodiment 2-79] to [Embodiment 2-81] With toner ϵ-32, toner ϵ-33 and toner ϵ-34, the continuous print test was conducted up to 50,000 sheets, and the smear did not occur. The drum fog (color difference ΔE) was 1.5 or less. [Comparative Example 2-104] With toner ϵ-35, the smear occurred on the recording medium after printing 18,000 sheets. Therefore, the continuous print test was stopped. In addition, the drum fog (color difference ΔE) reached 2.6 at most after printing the 15,000 sheets. [Comparative Example 2-105] With toner ϵ-36, the drum fog (color difference ΔE) reached 4.7 after printing 18,000 sheets. Therefore, the continuous print test was stopped. Although the smear did not occur, when the development device was opened, attachment of the external additive was observed on the end of the charge roller. [Embodiment 2-82] to [Embodiment 2-84] With toner ϵ-37, toner ϵ-38 and toner ϵ-39, the continuous print test was conducted up to 50,000 sheets, and the smear did not occur. The drum fog (color difference ΔE) was 1.5 or less. [Comparative Example 2-106] With toner ϵ-40, the smear occurred on the recording medium after printing 15,000 sheets. Therefore, the continuous print test was stopped. In addition, the drum fog (color difference ΔE) reached 2.8 at most after printing the 12,000 sheets. [Comparative Example 2-107] With toner ϵ-41, the drum fog (color difference ΔE) reached 3.7 after printing 9,000 sheets. Therefore, the continuous print test was stopped. Although the smear did not occur, when the development device was opened, attachment of the external additive was observed on the end of the charge roller. [Embodiment 2-85] to [Embodiment 2-87] With toner ϵ-42, toner ϵ-43 and toner ϵ-44, the continuous print test was conducted up to 50,000 sheets, and the smear did not occur. The drum fog (color difference ΔE) was 1.5 or less. [Comparative Example 2-108] With toner ϵ-45, the smear occurred on the recording medium after printing 12,000 sheets. Therefore, the continuous print test was stopped. In addition, the drum fog (color difference ΔE) reached 2.5 at most after printing the 9,000 sheets. [Comparative Example 2-109] With toner ϵ-46, the drum fog (color difference ΔE) reached 3.9 after printing 12,000 sheets. Therefore, the continuous print test was stopped. Although the smear did not occur, when the development device was opened, attachment of the external additive was observed on the end of the charge roller. [Embodiment 2-88] to [Embodiment 2-90] With toner ϵ-47, toner ϵ-48 and toner ϵ-49, the continuous print test was conducted up to 50,000 sheets, and the drum fog (color difference ΔE) was 3.0 or less. Although the smear did not occur, when the development device was opened, attachment of a small amount of the external additive was observed on the end of the charge roller. [Comparative Example 2-110] With toner ϵ-50, the smear occurred on the recording medium after printing 9,000 sheets. Therefore, the continuous print test was stopped. In addition, the drum fog (color difference ΔE) reached 2.9 at most after printing the 6,000 sheets.

As described above, Embodiment 2-61 to Embodiment 2-90 indicate that the external additives other than PMMA are not limited to $SiO_2$ (silica).

In the first and second embodiments, thermoplastic resins, such as polyvinyl resin, polyamide resin, polyester resin and the like, may be used as the resin used for the tone. Of these thermoplastic resins, monomers that form the polyvinyl resin include the following, for example: styrenes and styrene derivatives, such as styrene, 2,4-dimethyl styrene, α-methyl styrene, P-ethyl styrene, o-methyl styrene, m-methyl styrene, p-methyl styrene, p-chrorostyrene, vinylnaphthalene and the like; ethyleny monocarboxylic acids, such as 2-ethylhexyl acrylate, methyl methacrylate, acrylate, methyl acrylate, ethyl acrylate, n-propyl acrylate, isobutyl acrylate, t-butyl acrylate, amyl acrylate, cyclohyxyl acrylate, n-octyl acrylate, isooctyl acrylate, decyl acrylate, lauryl acrylate, stearyl acrylate, methoxyethyl acrylate, 2-hydroxyethyl acrylate, glycidyl acrylate, phenyl acrylate, methyl α-chloroacrylate, methacrylate acid, ethyl methacrylate, n-propyl methacrylate isopropyl methacrylate, n-butyl methacrylate, isobutyl methacrylate, t-butyl methacrylate, amyl methacrylate, cyclohyxyl methacrylate, n-octyl methacrylate, isooctyl methacrylate, decyl methacrylate, lauryl methacrylate, 2-ethylhexyl acrylate, stearyl methacrylate, methoxyethyl methacrylate, 2-hydroxyethyl methacrylate, glycidyl methacrylate, phenyl methacrylate, dimethylaminoethyl metacrylate, diethylaminoethyl metacrylate and the like, and esters thereof; ethylene unsaturated monoolefins, such as ethylene, propylene, butylenes, isobutylene and the like; vinyl esters, such as vinyl chloride, vinyl bromoacetate, vinyl propionate, vinyl formate, vinyl caproate and the like; ethylene monocarboxylate substitution products, such as acrylonitrile, methacrylonitrile, acrylamide and the like; ethyrene dicarbocylic acids, such as ester maleate and the like, and substitution products thereof; vinyl ketones, such as vinyl methyl ketone and the like; and vinyl ethers, such as vinyl methyl ether.

As explained above, in the second embodiment, there is an effect that, when the circularity degree of the emulsion polymerized toner is from 0.94 to 0.98, the smear on the recording medium (attachment of the external additive on the charge roller) and the fog on the photosensitive drum are reduced in the continuous print test using the 20% duty image by including 0.4 to 0.8 parts by weight of PMMA (polymethyl methacrylate) having positive chargeability and an average particle diameter of 0.15 to 2.0 μm in 100 parts by weight of the emulsion polymerized toner.

Furthermore, there is an effect that the smear on the recording medium (attachment of the external additive on the charge roller) and the fog on the photosensitive drum are further reduced by including a total amount of 2.5 to 5.0 parts by weight of the external additives other than PMMA in 100 parts by weight of the crushed toner.

According to the first and second embodiments, there is an effect that the smear on the recording medium (attachment of the external additive on the charge roller) and the fog on the photosensitive drum are reduced when the circularity degree of the toner mother particles is from 0.94 to 0.97 regardless of the manufacturing method of the toner.

In the first and second embodiment, the explanation was made with a single component electrographic printer as the image forming device. However, it may be a two-component electrographic printer. In addition, the image forming device may be a photocopy machine or a facsimile machine.

Moreover, the various numerical values describe in the above embodiments, including various parts by weight and circularity degrees, are not limited to those values unless specifically stated. Therefore, values near the respective numerical values that substantially result in the effects of the embodiments are also included in those values.

What is claimed is:

1. A negatively chargeable developer, comprising:

negatively chargeable toner mother particles including at least binding resin and colorant;

a first external additive having positive chargeability that is externally added to a surface of the toner mother particles, the first external additive including polymethyl methacrylate added in a range from approximately 0.4 parts by weight to approximately 0.8 parts by weight inclusive per 100 parts by weight of the toner mother particles; and a second external additive that is externally added to the surface of the toner mother particles, the second external additive being a member selected from the group consisting of silica, oxidized titanium and mixtures thereof and being added in a range from approximately 2.2 parts by weight to approximately 5.0 parts by weight inclusive per 100 parts by weight of the toner mother particles.

2. The developer of claim 1, wherein the toner mother particles have a circularity degree within a range from approximately 0.94 to approximately 0.97 inclusive that is calculated by dividing a circumferential length of a circle having the same area as an area of a projected image of a particle, by the length of the circumferential length of the projected image of the particle.

3. The developer of claim 1, wherein the toner mother particles are pulverized toner mother particles, and the toner mother particles have a circularity degree within a range from approximately 0.92 to approximately 0.97 inclusive that is calculated by dividing a circumferential length of a circle having the same area as an area of a projected image of a particle by the length of the circumferential length of the projected image of the particle.

4. The developer of claim 1, wherein the toner mother particles are emulsion-polymerized toner mother particles, and the toner mother particles have a circularity degree within a range from approximately 0.94 to approximately 0.98 inclusive that is calculated by dividing a circumferential length of a circle having the same area as an area of a projected image of a particle by the length of the circumferential length of the projected image of the particle.

5. A development device that develops an image using the developer of claim 1.

6. An image forming device, comprising:

the development device of claim 5.

7. The developer of claim 1, wherein the polymethyl methacrylate has an average particle size of 0.15-2.0 μm.

8. The developer of claim 1, wherein the second additive is only silica that is added in a range from approximately 2.2 parts by weight to approximately 5.0 parts by weight inclusive per 100 parts by weight of the toner mother particles.

9. The developer of claim 1, wherein the second additive is a mixture of silica and oxidized titanium, the silica is in a range from approximately 2.0 parts by weight to approximately 4.5 parts by weight inclusive per 100 parts by weight of the toner mother particles, and the oxidized titanium is in a range from approximately 0.2 parts by weight to approximately 0.5 parts by weight inclusive per 100 parts by weight of the toner mother particles.

10. A method of forming a negatively chargeable developer, comprising:

producing negatively chargeable toner mother particles including at least binding resin and colorant; and externally adding first and second external additives to a surface of the toner mother particles, wherein the first external additive includes polymethyl methacrylate that is added within a range from approximately 0.4 parts by weight to approximately 0.8 parts by weight inclusive per 100 parts by weight of the toner mother particles and that has positive chargeability, and the second external additive includes a member selected from the group consisting of silica, oxidized titanium and a mixture thereof that is added within a range from approximately 2.2 parts by weight to approximately 5.0 parts by weight inclusive per 100 parts by weight of the toner mother particles.

11. The method of claim 10, wherein the toner mother particles have a circularity degree within a range from approximately 0.94 to approximately 0.97 inclusive that is calculated by dividing a circumferential length of a circle having the same area as an area of a projected image of a particle, by the length of the circumferential length of the projected image of the particle.

12. The method of claim 10, wherein producing the toner mother particles comprises producing the toner mother particles by a pulverization method, and the toner mother particles have a circularity degree within a range from approximately 0.92 to approximately 0.97 inclusive that is calculated by dividing a circumferential length of a circle having the same area as an area of a projected image of a particle by the length of the circumferential length of the projected image of the particle.

13. The method of claim 12, wherein the pulverization method includes:

mixing, melting and kneading the binding resin and the colorant to form a mixture, cracking the mixture, and pulverization the cracked mixture.

14. The method of claim 10, wherein producing the toner mother particles comprises producing the toner mother particles by an emulsion polymerization method, and the toner mother particles have a circularity degree within a range from approximately 0.94 to approximately 0.98 inclusive that is calculated by dividing a circumferential length of a circle having the same area as an area of a projected image of a particle by the length of the circumferential length of the projected image of the particle.

15. The method of claim 14, wherein the emulsion polymerization method includes:

forming the binding resin in a water solvent, mixing emulsified colorant in the water solvent, agglomerating the mixture, and drying the agglomerated mixture.

16. The method of claim 10, wherein the polymethyl methacrylate has an average particle size of 0.15-2.0 μm.

17. The method of claim 10, wherein the second additive is only silica that is added in a range from approximately 2.2 parts by weight to approximately 5.0 parts by weight inclusive per 100 parts by weight of the toner mother particles.

18. The method of claim 10, wherein the second additive is a mixture of silica and oxidized titanium, the silica is in a range from approximately 2.0 parts by weight to approximately 4.5 parts by weight inclusive per 100 parts by weight of the toner mother particles, and the oxidized titanium is in a range from approximately 0.2 parts by weight to approximately 0.5 parts by weight inclusive per 100 parts by weight of the toner mother particles.

* * * * *